US008366425B2

(12) United States Patent
Arai et al.

(10) Patent No.: US 8,366,425 B2
(45) Date of Patent: Feb. 5, 2013

(54) COMPRESSOR SLIDER, SLIDER PREFORM, SCROLL PART, AND COMPRESSOR

(75) Inventors: Mie Arai, Sakai (JP); Hiroyuki Yamaji, Ashiya (JP); Mitsuhiko Kishikawa, Sakai (JP); Satoshi Yamamoto, Sakai (JP); Mikio Kajiwara, Sakai (JP); Takashi Hirouchi, Sakai (JP); Yasuhiro Murakami, Sakai (JP); Masanori Masuda, Sakai (JP); Kazuhiro Furusho, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 865 days.

(21) Appl. No.: 12/280,927

(22) PCT Filed: Feb. 26, 2007

(86) PCT No.: PCT/JP2007/053551

§ 371 (c)(1),
(2), (4) Date: Jul. 24, 2009

(87) PCT Pub. No.: WO2007/099919

PCT Pub. Date: Sep. 7, 2007

(65) Prior Publication Data

US 2010/0061871 A1 Mar. 11, 2010

(30) Foreign Application Priority Data

| | | |
|---|---|---|
| Feb. 28, 2006 | (JP) | 2006-053141 |
| Mar. 1, 2006 | (JP) | 2006-055129 |
| Mar. 2, 2006 | (JP) | 2006-056276 |
| Mar. 14, 2006 | (JP) | 2006-069141 |
| Mar. 17, 2006 | (JP) | 2006-074692 |
| Apr. 18, 2006 | (JP) | 2006-114819 |
| Sep. 14, 2006 | (JP) | 2006-250058 |
| Sep. 15, 2006 | (JP) | 2006-251427 |
| Sep. 29, 2006 | (JP) | 2006-269128 |

(51) Int. Cl.
*F01C 21/00* (2006.01)
*F03C 2/00* (2006.01)
*F03C 4/00* (2006.01)

(52) U.S. Cl. ..... 418/178; 418/11; 418/60; 418/63; 418/55.1; 418/179; 420/9; 420/13

(58) Field of Classification Search ..... 418/11, 418/60, 63, 55.1–55.6, 57, 178, 179; 29/888.021; 420/9, 13

See application file for complete search history.

(56) References Cited

U.S. PATENT DOCUMENTS 3,930,902 A * 1/1976 Hiraoka et al. ..... 418/178
5,087,181 A * 2/1992 Kamitsuma et al. ..... 418/178

(Continued)

FOREIGN PATENT DOCUMENTS

JP 58-57002 A 4/1983
JP 62-107283 A 5/1987

(Continued)

OTHER PUBLICATIONS

Japanese Office Action of corresponding Japanese Appiication No. 2006-074692 dated Dec. 13, 2011.

(Continued)

*Primary Examiner* — Theresa Trieu
(74) *Attorney, Agent, or Firm* — Global IP Counselors

(57) ABSTRACT

A compressor slider has a carbon content of 2.0 wt % to 2.7 wt %, a silicon content of 1.0 wt % to 3.0 wt %, a balance of iron that includes unavoidable impurities, graphite that is smaller than the flake graphite of flake graphite cast iron, and a hardness that is greater than HRB 90 but less than HRB 100 in at least a portion of the slider.

16 Claims, 56 Drawing Sheets

U.S. PATENT DOCUMENTS

| | | | | |
|---|---|---|---|---|
| 5,548,973 | A * | 8/1996 | Komine et al. | 62/469 |
| 6,302,665 | B1 * | 10/2001 | Esumi et al. | 418/178 |
| 7,811,071 | B2 * | 10/2010 | Fontaine et al. | 418/178 |

FOREIGN PATENT DOCUMENTS

| | | | |
|---|---|---|---|
| JP | 62-263859 | A | 11/1987 |
| JP | 63-93527 | A | 4/1988 |
| JP | 1-130083 | A | 5/1989 |
| JP | 1-225745 | A | 9/1989 |
| JP | H01-230746 | A | 9/1989 |
| JP | 2-81980 | A | 3/1990 |
| JP | H04-134686 | U | 12/1992 |
| JP | H05-060079 | A | 3/1993 |
| JP | 8-319523 | A | 12/1996 |
| JP | H10-085924 | A | 4/1998 |
| JP | 10-195586 | A | 7/1998 |
| JP | H11-336675 | A | 12/1999 |
| JP | 2001-221177 | A | 8/2001 |
| JP | 2002-192318 | A | 7/2002 |
| JP | 2003-176792 | A | 6/2003 |
| JP | 2003-269346 | A | 9/2003 |
| JP | 2005-036693 | A | 2/2005 |
| JP | 2005-290420 | A | 10/2005 |
| SU | 738760 | A1 | 6/1980 |
| SU | 1366551 | A1 | 1/1988 |
| SU | 1574673 | A1 | 6/1990 |

OTHER PUBLICATIONS

Japanese Office Action of corresponding Japanese Application No. 2006-328813 dated May 24, 2011.

Japanese Office Action of corresponding Japanese Application No. 2006-074692 dated Jun. 14, 2011.

Japanese Office Action of corresponding Japanese Application No. 2006-269128 dated Aug. 9, 2011.

Japanese Office Action od related Japanese Application No. 2006-328812 dated Aug. 9, 2011.

Japanese Office Action of corresponding Japanese Application No. 2006-328813 dated Nov. 29, 2011.

* cited by examiner

COMPRESSOR SLIDER, SLIDER PREFORM, SCROLL PART, AND COMPRESSOR

CROSS-REFERENCE TO RELATED APPLICATIONS

This U.S. National stage application claims priority under 35 U.S.C. §119(a) to Japanese Patent Application Nos. 2006-053141, 2006-055129, 2006-056276, 2006-069141, 2006-074692, 2006-114819, 2006-250058, 2006-251427, and 2006-269128 respectively filed in Japan on Feb. 28, 2006, Mar. 1, 2006, Mar. 2, 2006, Mar. 14, 2006, Mar. 17, 2006, Apr. 18, 2006, Sep. 14, 2006, Sep. 15, 2006, and Sep. 29, 2006, the entire contents of which are hereby incorporated herein by reference.

TECHNICAL FIELD

The present invention relates to a compressor, a compressor slider (scroll part, cylinder block, piston, roller, and the like), and a slider preform (scroll part preform, cylinder block preform, piston preform, roller preform, and the like).

BACKGROUND ART

A method for manufacturing a compressor slider has been proposed (e.g., see Japanese Laid-open Patent Application No. 2005-36693) in which "a compressor slider preform is manufactured by semi-molten die casting." Adopting this manufacturing method allows high tensile strength and high hardness to be obtained in comparison with adopting sand casting.

SUMMARY OF THE INVENTION

Problems that the Invention is to Solve

In a scroll compressor, for example, the distal end of a tooth tip of a scroll is ordinarily set so that an initial gap is provided with consideration given to deformation during operation. This is because when a portion of the tooth tip of the scroll makes contact during operation, large gaps are formed in other portion of the tooth tip, the thrust bearing surface becomes unstable, function cannot be achieved, the movable scroll becomes interposed between the fixed scroll and other components, damage is incurred, performance is reduced, or other problems occur. However, contact of the tooth tip may occur during operation due to machining tolerance of the parts, the condition of assembly based on geometric tolerance and/or combined tolerance, and an increase in temperature inside the scroll. The problem is gradually solved (this phenomenon is referred to as "breaking-in") by operating the compressor in this state and creating wear in the distal ends of the teeth of the scroll that are in contact with the fixed scroll or the movable scroll. In other words, rather ensuring maximum hardness in the movable scroll and the fixed scroll that is as hard as possible, a hardness is required that demonstrates sufficient durability and that allows "breaking-in" to occur as soon as possible. When the hardness of the movable scroll and the fixed scroll is extremely high, seizing resistance is degraded, seizing occurs between the teeth ends and the teeth bases (particularly in the center portion) in the scroll compressor wrap during pump-down operation (which readily occurs when a closed valve has inadvertently been left unopened during installation, or in a refrigerant recovery operation during moving and reinstallation) or gas shortage operation (which occurs when refrigerant is insufficiently charged, has leaked from the piping, or has otherwise become insufficient), and the compressor is likely to break down and must be replaced. On the other hand, when the hardness of the movable scroll and the fixed scroll is extremely low, abrasion resistance is reduced, abnormal abrasion (on the order of several tens of micrometers) occurs during short-term abnormal operation (pump-down operation, gas shortage operation, and the like), the gap at the distal ends of scroll portion during normal operation becomes excessive, and performance is reduced. In extreme cases, operation is likely to become impossible because the discharge gas becomes too hot due to a reduction in performance caused by gas leakage. Ordinarily, the scroll portion of the movable scroll and the fixed scroll requires end milling, and problems of tool service life and cutting resistance therefore readily occur when the hardness is markedly high. In other words, when the movable scroll and the fixed scroll require machining, a level of hardness is required that allows sufficient machinability to be achieved and yet provides sufficient durability after completion. On the other hand, when the hardness of the movable scroll and the fixed scroll is extremely low, a built-up edge is readily formed and grinding is impeded because the ductility of the movable scroll and the fixed scroll is excessively high. Therefore, from this point as well, the movable scroll, the fixed scroll, and the like must be of sufficient hardness.

The same applies to producing such a suitable hardness in the piston and cylinder block of a swing compressor, and in a roller and cylinder block of a rotary compressor. In particular, producing such a suitable hardness in a piston and cylinder block is as important as producing such a suitable hardness in a scroll part of a scroll compressor because the cylinder block and the piston always make contact in the same position in a swing compressor.

An object of the present invention is to provide a slider that has high tensile strength, can demonstrate sufficient durability during operation, is readily "broken in" as soon as possible, and does not seize during abnormal operation, and to provide a compressor that incorporates such a slider. Another object of the present invention is to provide a compressor slider preform that exhibits good machinability.

Means of Solving the Problems

The compressor slider according to a first aspect is a slider having a carbon content of 2.0 wt % to 2.7 wt %, a silicon content of 1.0 wt % to 3.0 wt %, a balance of iron that includes unavoidable impurities, graphite that is smaller than the flake graphite of flake graphite cast iron, and a hardness that is greater than HRB 90 but less than HRB 100 in at least a portion of the slider. The hardness is more preferably greater than HRB 90 but less than HRB 95. The hardness can be adjusted by a heating treatment that follows molding. As used herein, the term "slider" refers to a compressor slider, and examples include the following components of a scroll compressor: a movable scroll, a fixed scroll, a bearing, a rotating shaft (crankshaft), a rotation-preventing member, and a slide bush (slide block), as well as the following components of a swing compressor and a rotary compressor: a cylinder block, a front head, a rear head, a middle plate and rotating shaft (crankshaft), a piston, and a roller. When the "slider" is a cylinder block of a swing compressor or a rotary compressor, the hardness of at least the wall portion in which the cylinder hole is formed can be greater than HRB 90 but less than HRB 100. When the hardness of the slider is HRB 90 or less, the slider has poor abrasion resistance, abnormal abrasion (on the order of several tens of micrometers) occurs during short periods of abnormal operation (pump-down operation, insufficient gas operation, or the like), a gap at the distal end of the scroll portion during normal operation becomes excessively large, and performance is reduced. In extreme cases, performance is reduced due to gas leakage, the discharge gas becomes too hot, and operation is likely to be no longer possible. When the slider is a scroll part, it is possible that the effect of higher tensile strength of the scroll portion as a result of the improved tensile strength will no longer be sufficiently utilized. On the other hand, when the hardness of the slider is HRB 100 or greater, the seizing resistance of the slider is poor, seizing may occur in the scroll portion during abnormal operation (pump-down operation, insufficient gas operation, or the like) when the slider is a scroll part, and the compressor may malfunction and require replacement. The range in which the hardness is greater than HRB 90 but less than HRB 100 substantially corresponds to the range in which a ferrite surface area ratio of the base composition is from 50% to 5%. The graphite surface area ratio of the base composition substantially corresponds to a range from 6% to 2%. The range in which the hardness is greater than HRB 90 but less than HRB 95 substantially corresponds to the range in which the ferrite surface area ratio of the base composition is less than 50% and greater than 25%. The graphite surface area ratio of the base composition substantially corresponds to a range that is less than 6% and greater than 3%. Such a compressor slider is manufactured by the semi-molten or semi-solid die casting and metal-mold casting of the above-described iron material, then rapidly cooling the molded material to convert the entire material to white iron, and then adjusting the hardness by heat treatment. When such a compressor slider is molded by semi-molten die casting or semi-solid die casting, the molded material can be given a near-net shape (a shape that approximates the final shape of the product). On the other hand, the molded material must be brought to its final shape by precision machining when such a compressor slider is molded by metal-mold casting.

The tensile strength of a molded article can be freely adjusted by heat treatment in a molded article obtained by subjecting iron having the components described above to semi-molten or semi-solid die casting and metal-mold casting, and thereafter rapidly cooling the molded material to convert the entire material to white iron. It has been made apparent that the tensile strength of a molded article manufactured via the heat treatment is in a proportional relationship with the hardness of the molded article. The range in which the hardness is greater than HRB 90 but less than HRB 100 substantially corresponds to a range in which the tensile strength is from 600 MPa to 900 MPa. In other words, control of the tensile strength of the molded article can be substituted with the hardness, which is easy to measure. There are also merits when the slider is a scroll part in that the degree of freedom of design is considerably improved, and the scroll part has a reduced diameter and is provided with greater capacity. Therefore, the compressor slider demonstrates higher tensile strength than a slider composed of flake graphite cast iron. Based on experimental results obtained by the present inventor, it is apparent that when the hardness is in a range that is greater than HRB 90 but less than HRB 100, the slider can demonstrate sufficient durability during compressor operation, "breaking-in" can occur as soon as possible, and seizing during abnormal operation does not occur. Since the slider exhibits suitable hardness, there are merits in that the slider is not easily damaged and is easy to handle. In summary of the above, the compressor slider has high tensile strength, demonstrates sufficient durability during operation, can be "broken in" as early as possible, and does not undergo seizing during abnormal operation. The compressor slider is manufactured by a process in which iron having components such as those described above is subjected to semi-molten or semi-solid die casting and metal-mold casting, is then rapidly cooled to convert the entire material to white iron, and is thereafter heat treated. Therefore, merits and other advantages can be obtained in that thrust loss can be reduced due to a small diameter, and higher capacity can be obtained by reducing the thickness of the components, and damage is less likely to occur with regard to inclusion of foreign matter and a sudden increase in internal pressure because of the higher toughness in comparison with FC material. Even if damage were to occur, small scrapings are not produced and pipes do not need to be cleaned. Such a compressor can be regarded to be suitable in cases in which an upgrade is required.

The compressor slider according to a second aspect is the compressor slider according to the first aspect, being manufactured by semi-molten die casting or semi-solid die casting, then rapid cooling, and then a heat treatment.

This compressor slider is manufactured by semi-molten die casting or semi-solid die casting, then rapid cooling, and then a heat treatment. Accordingly, the slider preform can be made into a near-net shape. Therefore, the compressor slider can reduce machining costs and can be manufactured at lower cost.

The compressor slider according to a third aspect is the compressor slider according to the first aspect, being manufactured by metal-mold casting, then rapid cooling, and then a heat treatment.

This compressor slider is manufactured by metal-mold casting, then rapid cooling, and then a heat treatment. Accordingly, the pressure required in the molding step can be kept low. Therefore, a press apparatus or a heating apparatus in die casting is not required, and equipment costs can be reduced. As a result, the compressor slider reduces molding costs and can be manufactured at lower cost.

The compressor slider according to a fourth aspect is the compressor slider according to any of the first to third aspects, wherein the ratio of tensile strength to Young's modulus is 0.0046 or less. Young's modulus is preferably 175 to 190 GPa.

A compressor slider produced by die casting in which a semi-molten (semi-solid) iron material is pressed into a mold to manufacture a casting is subjected to heat treatment by being held at a prescribed temperature for a prescribed time, and by having the cooling speed adjusted, whereby the tensile strength can be improved in comparison with a conventional material such as FC250.

However, the inventors of the present invention discovered that when the tensile strength is increased to a level not conventionally done, other problems occur when the ratio (H/T), which is the ratio of the height (H) to thickness (T) of the scroll portion of the scroll, is determined based solely on the viewpoint of the strength that would prevent fatigue damage, as in a conventional manner. In other words, when the ratio (H/T) is made excessively high because of the strength, drawbacks were noted in that the machining tolerance of end milling or the like and the cutting speed cannot be increased even when there is no problem in terms of strength, because the amount of deformation (amount of flexing) of the scroll portion becomes excessive during cutting, machining time may be extended, the amount of deformation (amount of flexing) of the scroll portion increases during compressor operation, performance is reduced, and noise from contact with the counterpart scroll increases.

In view of the above, in the present invention, the ratio of the tensile strength in relation to Young's modulus of the scroll after heat processing is determined so that costs are not incurred to achieve excessive strength in heat treatment. The determination is based on research to determine the level of tensile strength that is sufficient from the viewpoint of fatigue strength. In this determination, the ratio (H/T) of the scroll portion is determined with consideration given to the required upper limit of the deformation amount of the scroll portion from the viewpoint of the machining time, performance reduction, and noise.

Specifically, the increase in strength by heat treatment is limited so that the ratio of the tensile strength in relation to Young's modulus is set to be 0.0046 or less. Since the ratio of the tensile strength in relation to Young's modulus is determined in this manner, a situation is avoided in the scroll part according to the present invention in which the scroll portion is subjected to an excessive increase in strength via heat treatment that involves costs and time, and the heat treatment can be suitably performed.

It is illogical to conversely extend the heat treatment to keep strength low, and since failure may occur in that abrasion resistance is reduced when the ferrite ratio of the metal structure is increased, the ratio of the tensile strength in relation to Young's modulus is preferably kept at 0.0033 or higher.

When such a scroll is incorporated into a scroll compressor that is incorporated into a refrigerant circuit of a refrigeration apparatus in which R410A is used as a refrigerant, the value obtained by dividing the length (hereinafter referred to as scroll portion height (H)) in the direction orthogonal to the flat plate portion of the scroll portion by the thickness (hereinafter referred to as scroll portion thickness (T)) of the scroll portion is preferably kept at 19 or less. Also, when such a scroll is incorporated into a scroll compressor that is incorporated into a refrigerant circuit of a refrigeration apparatus in which carbon dioxide is used as a refrigerant, the value obtained by dividing the scroll portion height (H) by the scroll portion thickness (T) is preferably kept at 8 or less. The toughness of the scroll portion (Young's modulus) becomes insufficient when the scroll portion height (H) is increased with respect to the scroll portion thickness (T) and the scroll portion is made thinner relative to the height of the scroll portion. Since molding is carried out by semi-molten or semi-solid die casting and strength is increased in comparison with the case in which a material such as a conventional FC250 is used, it is preferred that the ratio (H/T) be 10 or higher to assure a thinner scroll portion for the case in which such a scroll is incorporated into a scroll compressor that is incorporated into a refrigerant circuit of a refrigeration apparatus in which R410A is used as a refrigerant. It is preferred that the ratio (H/T) be 2 or higher to assure a thinner scroll portion for the case in which such a scroll part is incorporated into a scroll compressor that is incorporated into a refrigerant circuit of a refrigeration apparatus in which carbon dioxide is used as a refrigerant.

The compressor slider according to a fifth aspect is the compressor slider according to any of the first to fourth aspects, wherein a portion thereof, e.g., a stress concentration area or a sliding portion, is treated in partial heat treatment. As used herein, the term "partial heat treatment" refers to the use of a high-frequency heating method, a laser heating method, or another method. The eccentric shaft portion and the main shaft portion are preferably treated in partial heat treatment when the slider is a crankshaft of a compressor incorporated into a refrigerant circuit of a refrigerant apparatus in which carbon dioxide, R410A, or another high-pressure refrigerant is used as the refrigerant. When a notched portion is provided between the main shaft portion and the eccentric shaft portion in the crankshaft, the peripheral area of the notched portion is preferably treated in partial heat treatment. A balance weight is preferably integrally formed with the crankshaft. An inner-drive pin shaft portion is preferably treated in partial heat treatment when the slider is an inner drive-type movable scroll of a scroll compressor incorporated into the refrigerant circuit of a refrigerant apparatus in which carbon dioxide, R410A, or another high-pressure refrigerant is used as the refrigerant. The key portion, which is a slider portion, is preferably treated in partial heat treatment when the slider is a rotation-preventing member (e.g., an Oldham ring (Oldham coupling) or the like) of a scroll compressor incorporated into the refrigerant circuit of a refrigerant apparatus in which carbon dioxide, R410A, or another high-pressure refrigerant is used as the refrigerant. A wall portion in which a bushing accommodation hole is formed is preferably treated in partial heat treatment when the slider is a cylinder block of a swing compressor incorporated into the refrigerant circuit of a refrigerant apparatus in which carbon dioxide, R410A, or another high-pressure refrigerant is used as the refrigerant. The peripheral area of the base of the blade portion and the peripheral area of the notched portion formed in the base of the blade portion are preferably treated in partial heat treatment when the slider is a piston of a swing compressor incorporated into the refrigerant circuit of a refrigerant apparatus in which carbon dioxide, R410A, or another high-pressure refrigerant is used as the refrigerant. A wall portion in which a vane accommodation hole is formed is preferably treated in partial heat treatment when the slider is a cylinder block of a rotary compressor incorporated into the refrigerant circuit of a refrigerant apparatus in which carbon dioxide, R410A, or another high-pressure refrigerant is used as the refrigerant.

This compressor slider has a portion, e.g., a stress concentration area, a sliding portion, or the like, that is treated in partial heat treatment. Accordingly, sufficient fatigue strength and abrasion resistance can be imparted to the stress concentration area, sliding portion, or the like of the compressor slider. Such a slider is particularly effective in relation to a high-pressure refrigerant, e.g., carbon dioxide or the like. Since the strength of the partially heat-treated portions is increased, the partially heat-treated portions can be made thinner and more lightweight.

The compressor slider according to a sixth aspect is the compressor slider according to the fifth aspect, wherein the hardness of a location that is treated in partial heat treatment is greater than HRC 50 but less than HRC 65.

With this compressor slider, the hardness of a location that is treated in partial heat treatment is greater than HRC 50 but less than HRC 65. Accordingly, abrasion in such a portion can be sufficiently reduced by setting the hardness of this portion to be greater than HRC 50 but less than HRC 65 when, e.g., a bearing portion or other portion having particular hardness requirements is present in the compressor slider.

The compressor slider according to a seventh aspect is the compressor slider according to the fifth or sixth aspect, wherein a location that is treated in partial heat treatment is a stress concentration area. As used herein, the term "stress concentration area" refers to a peripheral area of the base of a scroll portion of the scroll, a notched area formed in the vicinity of the center of the first plate surface side of the flat plate portion of the scroll, a peripheral area of the base of the bearing portion of the scroll, or another area.

The stress concentration area of this compressor slider is treated in partial heat treatment. Accordingly, in this compressor slider, good breaking-in characteristics are imparted to the sliders that require slidability, and sufficient fatigue strength is imparted to the stress concentration area. Such a slider is particularly effective in relation to high-pressure refrigerant, e.g., carbon dioxide and the like.

The compressor slider according to an eighth aspect is the compressor slider according to any of the first to seventh aspects, being manufactured using a mold having a convexity. The convexity allows a prescribed portion in the vicinity of a center of the slider to be thinly formed. The slider is provided with a thin prescribed portion in the vicinity of the center. As used herein, the term "prescribed portion" is, e.g., an opening formation portion or the like. When the compressor slider is a scroll part, the "prescribed portion" is, e.g., a portion in the vicinity of the center of the end plate, a portion in which a discharge hole is to be formed in the vicinity of the center, or another portion. In this case, the height of the convexity is preferably set so that the thickness of the prescribed portion in the vicinity of the center of the scroll is 4 mm or less. When the slider is a movable scroll, a movable scroll having a bearing portion that fits onto the outside of a drive shaft reduces the generation of blowholes to a greater extent than does a movable scroll of an inner drive in which the bearing portion of a solid rounded rod fits inside the drive shaft. When the slider is a movable scroll of an inner drive in which the bearing portion of a solid rounded rod fits inside the drive shaft, it is preferred that at least a portion of the interior of the bearing portion is cored by using the convexity.

In semi-molten molding, a semi-molten metal material is molded in a mold. Accordingly, there is a problem in that blowholes will readily occur in the thick portions of a molded slider. When a hole is furthermore formed in the preform in a state in which blowholes are present inside the molded slider preform, the blowholes inside the preform tend to be exposed to the exterior through the holed portion. When blowholes are exposed on an external surface of the slider, the portion of the exposed blowhole readily becomes a source for fatigue failure of a slider and is likely to have an undesirable affect on fatigue strength.

In response to such a problem, in the present invention, a thin prescribed portion is formed in the vicinity of the center of the slider by subjecting a metal material to semi-molten molding using a mold having a convexity. For this reason, the occurrence of blowholes is reduced in this compressor slider.

The compressor slider according to a ninth aspect is the compressor slider according to any of the first to seventh aspects, wherein a slider preform provided with a thin prescribed portion in the vicinity of a center is molded using a mold having a convexity that allows a prescribed portion in the vicinity of the center to be thinly formed, and a through-hole is formed in the thin prescribed portion in the preform. As used herein, the term "prescribed portion" is, e.g., an opening formation portion or the like. When the compressor slider is a scroll part, the "prescribed portion" is, e.g., a portion in the vicinity of the center of the end plate, a portion in which a discharge hole is to be formed in the vicinity of the center, or another portion. In this case, the height of the convexity is preferably set so that the thickness of the prescribed portion in the vicinity of the center of the scroll is 4 mm or less. When the slider is a movable scroll, a movable scroll having a bearing portion that fits onto the outside of a drive shaft reduces the generation of blowholes to a greater extent than does a movable scroll part of an inner drive in which the bearing portion of a solid rounded rod fits inside the drive shaft. When the slider is a movable scroll of an inner drive in which the bearing portion of a solid rounded rod fits inside the drive shaft, it is preferred that at least a portion of the interior of the bearing portion be cored using the convexity.

This compressor slider is manufactured by molding a preform having a thin prescribed portion in the vicinity of the center with the aid of a mold having a convexity, and by forming a through-hole in the thin prescribed portion in the preform. For this reason, the occurrence of blowholes is reduced in the compressor slider. Blowholes inside a slider are unlikely to become exposed to the exterior when a through-hole is formed in the opening formation portion, and degradation in fatigue strength can be reduced.

The compressor scroll according to a tenth aspect has a carbon content of 2.0 wt % to 2.7 wt %, a silicon content of 1.0 wt % to 3.0 wt %, a balance of iron that includes unavoidable impurities, graphite that is smaller than the flake graphite of flake graphite cast iron, the compressor scroll comprising a plate portion and a scroll portion. The scroll portion extends from a first plate surface of the plate portion in a direction perpendicular to the first plate surface while a scroll shape is maintained. The plate portion and the scroll portion have a hardness that is greater than HRB 90 but less than HRB 100. It is particularly preferred that the hardness of the scroll portion at a distal end thereof be included in the hardness ranged noted above. It is preferred that the hardness be greater than HRB 90 but less than HRB 95. A range in which the hardness is greater than HRB 90 but less than HRB 100 substantially corresponds to a range in which the ferrite surface area ratio of the base composition is from 50% to 5%. The graphite surface area ratio of the base composition substantially corresponds to a range from 6% to 2%. The range in which the hardness is greater than HRB 90 but less than HRB 95 substantially corresponds to a range in which the ferrite surface area ratio of the base composition is less than 50% and greater than 25%. The graphite surface area ratio of the base composition substantially corresponds to a range that is less than 6% and greater than 3%. The hardness can be adjusted by a heating treatment that follows molding. It is preferred that the scroll portion have a height, as measured from the first plate surface, that is twice the width or less of the groove (trough portion) of the scroll portion. This is because machining can be relatively easily performed even if the pre-machining tolerance is high.

The compressor scroll is manufactured by performing the semi-molten or semi-solid die casting and metal-mold casting of an iron material having the above-described components, then rapidly cooling the molded material to convert the entire material to white iron, and then performing a heat treatment. Accordingly, the tensile strength of the scroll portion can be sufficiently improved. Therefore, the freedom to design the scroll portion is considerably improved and the scroll portion can be made smaller and given greater capacity. Based on experimental results obtained by the present inventor, it is apparent that when the hardness is in a range that is greater than HRB 90 but less than HRB 100, the scroll can demonstrate sufficient durability during compressor operation, "breaking-in" can occur as soon as possible, and seizing during abnormal operation does not occur. For this reason, the compressor scroll has high tensile strength, demonstrates sufficient durability during operation, can be "broken in" as early as possible, and does not undergo seizing during abnormal operation. The compressor scroll according to an eleventh aspect is the compressor scroll according to the tenth aspect, wherein a draft angle of the scroll portion in relation to a mold varies in accordance with a winding angle.

Since a wrap draft angle is not provided or is constant in a conventional scroll, there is a problem in that the wrap shape is not determined in accordance with strength and quality, and material is wasted during the manufacture of the scroll. Also, when the shape of the scroll is considered, the mold is readily affected by stress when the scroll is separated from the mold because the radius of curvature of the wrap is reduced in progression toward the center portion of the scroll wrap.

Accordingly, it is difficult to extend the service life of the mold. In view of this problem, the draft angle in relation to the mold varies in accordance with the winding angle of the scroll portion in the scroll according to the present invention. Accordingly, with this scroll, the shape of the scroll portion is determined in accordance with strength and quality, and wasted material can be eliminated.

The compressor scroll according to a twelfth aspect is the compressor scroll part according to the eleventh aspect, wherein the scroll portion presents a scroll shape in which a draft angle in relation to the mold in the portion where winding starts near a center is larger than the draft angle of an outside portion where winding ends. The scroll portion is preferably set so that the draft angle continuously and gradually changes from where winding starts to where winding ends. The stress applied to the mold in the vicinity of the center of the scroll during mold release is reduced, the service life of the mold can be extended, and wasted material can be more effectively eliminated. The scroll portion is also preferably set so that a draft angle changes in a stepwise fashion from where winding starts to where winding ends. The stress applied to the mold in the vicinity of the center of the scroll during mold release is reduced, the service life of the mold can be extended, the draft angle in each of the angle ranges of the scroll portion can be set in a simple manner, and wasted material can be more effectively eliminated. The scroll portion is preferably set so that the draft angle in a prescribed angle range between where winding starts and where winding ends is greater than the draft angle in other angle ranges. This is because the stress applied to the mold in the vicinity of the center of the scroll during mold release is reduced, the service life of the mold can be extended, adverse effect in relation to near-net shaping in the scroll portion overall can be further reduced, and wasted material can be more effectively eliminated. It is preferred that at least the scroll portion be coated with resin in this scroll. This is because a coated resin is more easily machined than when a molded member is machined directly, machining precision can be improved, leakage of compressed medium can be reduced by filling the gaps, and noise can be reduced due to the elasticity of the resin when scroll portions make contact with each other.

With this scroll, the draft angle in the portion where winding starts near the center of the scroll portion is greater than the draft angle of the portion where winding ends at the outer side. Accordingly, the stress applied to the mold in the vicinity of the center of the scroll can be reduced during mold release in which the scroll is released from the mold. As a result, the service life of the mold can be extended.

The compressor scroll part according to a thirteenth aspect is the compressor scroll part according to the eleventh aspect, wherein the scroll portion presents a scroll shape in which a draft angle in relation to the mold in the portion where winding ends at the outer side is larger than a draft angle of the portion where winding starts near the center. The scroll portion is preferably set so that the draft angle continuously and gradually changes from where winding starts to where winding ends. The stress applied to the mold in the vicinity of the center of the spiral during mold release is reduced, the service life of the mold can be extended, and wasted material can be more effectively eliminated. The scroll portion is also preferably set so that a draft angle changes in a stepwise fashion from where winding starts to where winding ends. The stress applied to the mold in the vicinity of the center of the scroll during mold release is reduced, the service life of the mold can be extended, the draft angle in each of the angle ranges of the scroll portion can be set in a simple manner, and wasted material can be more effectively eliminated. The scroll portion is preferably set so that the draft angle in a prescribed angle range between where winding starts and where winding ends is greater than the draft angle in other angle ranges. This is because the stress applied to the mold in the vicinity of the center of the scroll during mold release is reduced, the service life of the mold can be extended, any adverse effect in relation to near-net shaping in the scroll portion overall can be further reduced, and wasted material can be more effectively eliminated. It is preferred that at least the scroll portion be coated with resin in this scroll part. This is because leakage of a compressed medium can be reduced, and noise can also be reduced.

With this scroll, the draft angle in the portion where winding ends at the outer side of the scroll portion is greater than the draft angle of the portion where winding begins near the center. Accordingly, the external peripheral portion of the scroll portion is thin. Therefore, this configuration is effective for cases in which it is difficult to achieve machining precision, and the precision in the external peripheral portion of the scroll portion can be assured even when the thickness of the scroll portion is reduced.

The compressor scroll part according to a fourteenth aspect is the compressor scroll part according to the tenth aspect, wherein the scroll portion has a first surface that slopes at a first angle with respect to a line that is orthogonal to the flat surface portion, the first surface being positioned on the internal peripheral side of the portion in the vicinity of the start of winding near the center. A surface other than the first surface of the scroll portion has a slope angle in relation to the line orthogonal to the flat plate portion that is less than the first angle. The first surface of the scroll portion preferably is a surface that is not in contact with a counterpart scroll that meshes in the relative movement of the fixed scroll and the movable scroll. This is because the use of a large slope is ordinarily disadvantageous from the point of managing surface precision, but since the surface (first surface) is not a surface that makes contact with a counterpart scroll and affects the airtightness of the compression chamber, there are no demerits. A surface (the surface that makes contact with a meshing counterpart scroll and affects the level of airtightness of the compression chamber) other than the first surface of the scroll portion preferably has a slope angle in relation to the line orthogonal to the flat plate portion that is essentially 0°. This is because the surface precision of the scroll can be kept high, and malfunctions are reduced in which gas refrigerant leaks from the meshing portion of the two scrolls to an adjacent chamber during operation of the scroll compressor.

In the portion adjacent to where winding starts in the scroll portion, in which the received pressure near the center is increased, a first surface on the internal peripheral side is sloped at a first angle to reliably assure increased strength and less deformation. On the other hand, the portion set at a distance from the center of the scroll portion has a slope angle that is less than the first angle, and a considerable reduction in capacity is avoided. The external peripheral surface of the scroll portion adjacent to where the winding starts is a surface that makes contact with the counterpart scroll and performs compression work. When a large slope is used, it is difficult to control the surface precision of the sloped surface, i.e., the precision of the profile shape at each height from the flat plate portion of the scroll portion and the precision of the rounded shape along the boundary between the scroll portion and the flat plate portion; and since refrigerant gas leakage is likely to increase in the contact portions of the two scrolls, the slope angle is set to be less than the first angle.

In this manner, with a scroll compressor in which the scroll of the present invention is adopted, the slope angle is reduced with priority given to increasing the capacity rather than strength and the amount of deformation because pressure is relatively low in portions other than the portion of the scroll portion adjacent to where the winding starts. In the first surface on the internal peripheral side of the portion of the scroll portion adjacent to where the winding starts, the slope angle is increased with priority given to increasing strength and reducing the amount of deformation because pressure is relatively high. In the external peripheral surface of the portion of the scroll portion that is adjacent to where winding starts, the slope angle is reduced with consideration given to surface precision control and the airtightness of the compression chamber. Accordingly, it can be assured that the thickness of the scroll portion overall is reduced and capacity is increased. On the other hand, in the portion of the high-pressure scroll portion that is adjacent to where winding starts, a slope having a first angle is used, whereby strength can be assured and the amount of deformation can be reduced to an acceptable level.

Another advantage is that, in portions other than the portion of the scroll portion that is adjacent to where winding starts, the slope angle is reduced and surface precision control and the airtightness of the compression chamber can be assured.

In a compressor for compressing carbon dioxide or another high-pressure refrigerant, the strength must be increased in the center portion of the scroll, where stress is concentrated in the scroll. With the scroll according to the present invention, the first surface positioned on the internal peripheral side of the portion adjacent to where winding starts near the center is sloped by a first angle (θ) with respect to the line orthogonal to the flat plate portion. For this reason, strength in the center portion of the spiral is increased in this scroll part. Therefore, in a scroll compressor in which such a scroll part has been incorporated, the slider can withstand an increase in pressure due to high pressure differences when carbon dioxide or another high-pressure refrigerant is compressed. This effect allows the height of the teeth of the scroll to be increased. In other words, the capacity of the compression chamber can be increased while the diameter of the scroll portion is reduced. When the diameter of the scroll compressor is reduced by reducing the diameter of the scroll, the diameter of the trunk portion of the casing is reduced. When the diameter of the trunk portion of the casing is reduced, the casing can exhibit the same compression strength at the thinner thickness, in comparison with a conventional casing. Accordingly, the raw material costs and the like of the casing can be reduced. When the diameter of the scroll is reduced, the scroll portion is reduced in size and the sliding surface area of the thrust portion, which is subject to rigorous conditions, can be increased. When such a scroll is molded by semi-molten die casting or the like, the scroll has a surface roughness that is reduced to less than that obtained using conventional casting. For this reason, with a scroll compressor in which such a scroll part has been incorporated, cracks are not likely to occur in the surface of the scroll even when carbon dioxide or another high-pressure refrigerant is compressed. Even when the scroll is an unfinished article, such damage is less likely to occur. The volume circulation rate of carbon dioxide is low. Accordingly, with a compressor for compressing carbon dioxide or another high-pressure refrigerant, the diameter of the discharge port may be less than that of a conventional article. Therefore, the space between the discharge port and the scroll wall surface can be increased in size. Accordingly, the slope angle θ of the first surface can be increased, and the strength of the center portion of the scroll can be further enhanced. As a result, a greater effect can be obtained in a scroll compressor in which such a scroll part is incorporated.

The compressor scroll part according to a fifteenth aspect is the compressor scroll part according to the fourteenth aspect, wherein the portion of the scroll portion near where winding starts has a thickness at the boundary with the flat portion that is greater than in other portions of the scroll portion.

The compressor slider preform according to a sixteenth aspect has a carbon content of 2.0 wt % to 2.7 wt %, a silicon content of 1.0 wt % to 3.0 wt %, a balance of iron that includes unavoidable impurities, graphite that is smaller than the flake graphite of flake graphite cast iron, and a hardness that is greater than HRB 90 but less than HRB 100 in at least a portion of the slider preform. The hardness is more preferably greater than HRB 90 but less than HRB 95. As used herein, the term "slider preform" refers to a yet unmachined precursor or the like to obtain a completing slider. When the hardness of the slider preform is HRB 90 or less, a built-up edge is readily formed when the slider preform is machined, and grinding processability is likely to be degraded. On the other hand, when the hardness of the slider preform is HRB 100 or greater, machining costs tend to increase because tool abrasion, chipping, and the like readily occur in the machining of the slider preform, and machining costs also tend to increase due to higher cutting resistance and limitations in the cutting depth and machining speed. The range in which the hardness is greater than HRB 90 but less than HRB 100 substantially corresponds to the range in which a ferrite surface area ratio of the base composition is from 50% to 5%. The graphite surface area ratio of the base composition substantially corresponds to a range from 6% to 2%. The range in which the hardness is greater than HRB 90 but less than HRB 95 substantially corresponds to the range in which the ferrite surface area ratio of the base composition is less than 50% and greater than 25%. The graphite surface area ratio of the base composition substantially corresponds to a range that is less than 6% and greater than 3%.

The tensile strength can be freely adjusted by heat-treating a molded article obtained by subjecting iron having the components described above to semi-molten or semi-solid die casting and metal-mold casting, and thereafter rapidly cooling the molded material to convert the entire material to white iron. It has been made apparent that the tensile strength of a molded article manufactured via the heat treatment is in a proportional relationship with the hardness of the molded article. The range in which the hardness is greater than HRB 90 but less than HRB 100 substantially corresponds to a range in which the tensile strength is from 600 MPa to 900 MPa. In other words, control of the tensile strength of the molded article can be substituted with the hardness, which is easy to measure. Another merit is that when the slider preform is a scroll part preform, the freedom of designing the scroll portion is considerably expanded to allow a smaller diameter or greater capacity to be achieved. Therefore, the compressor slider preform demonstrates higher tensile strength than a slider preform composed of flake graphite cast iron. Based on experimental results obtained by the present inventor, it is apparent that when the hardness of the slider preform is in a range that is greater than HRB 90 but less than HRB 100, good machinability is exhibited for the case in which the slider is manufactured by a process in which iron having components such as those described above is subjected to semi-molten or semi-solid die casting and metal-mold casting, is then rapidly cooled to convert the entire material to white iron, and is thereafter heat treated. Still another merit is that good machinability reduces the likelihood of tool abrasion and tool chipping, extends tool service life, makes it less likely that a built-up edge will form, facilitates grinding, and reduces machining costs because machining time can be reduced. Yet another merit is that since the slider preform exhibits suitable hardness, the slider preform is less likely to be damaged and handling is facilitated. It should also be noted that even though the slider preform has good characteristics in terms of tool abrasion and machining time, because the slider preform has lower hardness in comparison with FCD having the same tensile strength (tensile strength is high at the same level of hardness), the preform also has higher tensile strength than a conventional preform. When the slider preform is cut, a counterpart slider (Oldham ring, seal, and the like in the case that the slider is a movable scroll) is not damaged because the surface roughness is more easily reduced in comparison with an FC material. In summary of the above, this compressor slider preform has high tensile strength and exhibits good machinability when machining is required.

The compressor according to a seventeenth aspect comprises a slider having a carbon content of 2.0 wt % to 2.7 wt %, a silicon content of 1.0 wt % to 3.0 wt %, a balance of iron that includes unavoidable impurities, graphite that is smaller than the flake graphite of flake graphite cast iron, and a hardness that is greater than HRB 90 but less than HRB 100 in at least a portion of the slider. As used herein, the phrase "compressor" refers to, e.g., a scroll compressor, a swing compressor, a rotary compressor, or the like. It is preferred that the hardness be greater than HRB 90 but less than HRB 95. A range in which the hardness is greater than HRB 90 but less than HRB 100 substantially corresponds to a range in which the ferrite surface area ratio of the base composition is from 50% to 5%. The graphite surface area ratio of the base composition substantially corresponds to a range from 6% to 2%. The range in which the hardness is greater than HRB 90 but less than HRB 95 substantially corresponds to a range in which the ferrite surface area ratio of the base composition is less than 50% and greater than 25%. The graphite surface area ratio of the base composition substantially corresponds to a range that is less than 6% and greater than 3%. The hardness can be adjusted by a heating treatment that follows molding.

The tensile strength of a molded article can be freely adjusted by heat treatment for a molded article obtained by subjecting iron having the components described above to semi-molten or semi-solid die casting and metal-mold casting, and thereafter rapidly cooling the molded material to convert the entire material to white iron. It has been made apparent that the tensile strength of a molded article manufactured via the heat treatment is in a proportional relationship with the hardness of the molded article. The range in which the hardness is greater than HRB 90 but less than HRB 100 substantially corresponds to a range in which the tensile strength is from 600 MPa to 900 MPa. In other words, control of the tensile strength of the molded article can be substituted with control of the hardness, which is easy to measure. Another merit is that when the slider is a scroll, the freedom of designing the scroll portion is considerably expanded to allow a smaller diameter or greater capacity to be achieved. Therefore, the compressor slider demonstrates higher tensile strength than a slider composed of flake graphite cast iron. Based on experimental results obtained by the present inventor, it is apparent that when the hardness is in a range that is greater than HRB 90 but less than HRB 100, the slider can demonstrate sufficient durability during compressor operation, "breaking-in" can occur as soon as possible, and seizing during abnormal operation does not occur. Accordingly, in this compressor, tensile strength is high, sufficient durability is demonstrated during compressor operation, "breaking-in" can occur as soon as possible, and seizing during abnormal operation can be prevented. In this compressor, the slider has a carbon content of 2.0 wt % to 2.7 wt %, a silicon content of 1.0 wt % to 3.0 wt %, a balance of iron that includes unavoidable impurities, and graphite that is smaller than the flake graphite of flake graphite cast iron. Therefore, merits and other advantages can be obtained in that thrust loss can be reduced due to a smaller diameter, and higher capacity obtained by reducing the thickness of the components, and damage is less likely to occur with regard to inclusion of foreign matter and a sudden increase in internal pressure because of the higher toughness in comparison with FC material. Even if damage were to occur, small scrapings are not produced and pipes do not need to be cleaned. Such a compressor can be regarded to be suitable in cases in which an upgrade is required.

The compressor according to an eighteenth aspect is the compressor according to the seventeenth aspect, and is capable of accommodating a carbon dioxide (CO2) refrigerant.

This compressor is capable of accommodating a carbon dioxide (CO2) refrigerant. Accordingly, the compressor can contribute to global environmental problems.

Effect of the Invention

The compressor slider according to the first aspect has high tensile strength, demonstrates sufficient durability during operation, can be "broken in" as early as possible, and does not undergo seizing during abnormal operation. This compressor slider has a carbon content of 2.0 wt % to 2.7 wt %, a silicon content of 1.0 wt % to 3.0 wt %, a balance of iron that includes unavoidable impurities, and graphite that is smaller than the flake graphite of flake graphite cast iron. Therefore, merits and other advantages can be obtained in that thrust loss can be reduced due to a smaller diameter, and higher capacity obtained by reducing the thickness of the components, and damage is less likely to occur with regard to inclusion of foreign matter and a sudden increase in internal pressure because of the higher toughness in comparison with FC material. Even if damage were to occur, small scrapings are not produced and pipes do not need to be cleaned. Such a compressor can be regarded to be suitable in cases in which an upgrade is required.

The compressor slider according to the second aspect is one in which a slider preform can be made into a near-net shape. Therefore, the compressor slider can reduce machining costs and can be manufactured at lower cost.

The compressor slider according to the third aspect is one in which the pressure required during the molding step is reduced. Therefore, a press apparatus or a heating apparatus in die casting is not required, and equipment costs can be reduced. As a result, the compressor slider reduces molding costs and can be manufactured at lower cost.

In the fourth aspect, when the compressor slider is a scroll part, the ratio of the tensile strength in relation to Young's modulus of the scroll part after heat processing is determined so that costs are not incurred to achieve excessive strength in heat treatment. The determination is based on research to determine the level of tensile strength that is sufficient from the viewpoint of fatigue strength. In this determination, the ratio (H/T) of the scroll portion is determined with consideration given to the required upper limit of the deformation amount of the scroll portion from the viewpoint of the machining time, performance reduction, and noise. Specifically, the increase in strength by heat treatment is limited so that the ratio of the tensile strength in relation to Young's modulus is set to be 0.0046 or less. Since the ratio of the tensile strength in relation to Young's modulus is determined in this manner, a situation is avoided in which the scroll portion in the scroll according to the present invention is subjected to an excessive increase in strength via a heat treatment that involves costs and time, and the heat treatment can be suitably performed.

In the compressor slider according to the fifth aspect, sufficient fatigue strength and abrasion resistance can be imparted to a stress concentration area, sliding portion, or the like. Since the strength of the partially heat-treated portions is increased, the partially heat-treated portions can be made thinner and more lightweight.

In the compressor slider according to the sixth aspect, in the case a bearing portion or another portion that requires hardness in particular exists, abrasion in this portion can be sufficiently reduced by setting the hardness of the portion to be greater than HRC 50 but less than HRC 65.

The compressor slider according to the seventh aspect is one in which good breaking-in characteristics are imparted to the slider area that require slidability, and sufficient fatigue strength is imparted to the stress concentration area.

In the compressor slider according to the eighth aspect, the occurrence of blowholes is reduced.

In the compressor slider according to the ninth aspect, the occurrence of blowholes is reduced. Also, blowholes inside a slider are unlikely to become exposed to the exterior when a through-hole is formed in the opening formation portion, and degradation in fatigue strength can be reduced.

The compressor scroll part according to the tenth aspect has high tensile strength, demonstrates sufficient durability during operation, can be "broken in" as early as possible, and does not undergo seizing during abnormal operation.

In the compressor scroll part according to the eleventh aspect, the shape of the scroll portion is determined in accordance with strength and quality, and wasted material can be eliminated. In accordance with the twelfth aspect, stress applied to the mold in the vicinity of the center of the scroll can be reduced during mold release in which the scroll is released from the mold. As a result, the service life of the mold can be extended.

In accordance with the thirteenth aspect, the precision in the external peripheral portion of the scroll portion can be assured even when the thickness of the scroll portion is reduced.

In the scroll and the scroll compressor provided with the scroll according to the fourteenth and fifteenth aspects, the slope angle is reduced with priority given to increasing the capacity rather than strength and the amount of deformation of the scroll portion because pressure is relatively low in portions other than the portion of the scroll portion adjacent to where the winding starts. In the first internal peripheral surface of the portion of the scroll portion adjacent to where the winding starts, the slope angle is increased with priority given to increasing strength and reducing the amount of deformation because pressure is relatively high. In the external peripheral surface of the portion of the s scroll portion that is adjacent to where winding starts, the slope angle is reduced with consideration given to surface precision control and the airtightness of the compression chamber. It can be assured that the thickness of the scroll portion overall is reduced and capacity is increased. On the other hand, in the portion of the high-pressure scroll portion that is adjacent to where winding starts, a slope having a first angle is used, whereby strength can be assured and the amount of deformation can be reduced to an acceptable level.

The compressor slider preform according to the sixteenth aspect has high tensile strength and exhibits good machinability when machining is required.

In the compressor according to the seventeenth aspect, a slider is used that has higher tensile strength than a slider composed of flake graphite cast iron. Based on experimental results obtained by the present inventor, it is apparent that when the hardness is in a range that is greater than HRB 90 but less than HRB 100, the slider can demonstrate sufficient durability during compressor operation, "breaking-in" can occur as soon as possible, and seizing during abnormal operation does not occur. Accordingly, in this compressor, tensile strength is high, sufficient durability is demonstrated during compressor operation, "breaking-in" can occur as soon as possible, and seizing during abnormal operation can be prevented. In this compressor, the slider has a carbon content of 2.0 wt % to 2.7 wt %, a silicon content of 1.0 wt % to 3.0 wt %, a balance composed of iron having unavoidable impurities, and graphite that is smaller than the flake graphite of flake graphite cast iron. Therefore, merits and other advantages can be obtained in that thrust loss can be reduced due to a smaller diameter, and higher capacity obtained by reducing the thickness of the components, and damage is less likely to occur with regard to inclusion of foreign matter and a sudden increase in internal pressure because of the higher toughness in comparison with FC material. Even if damage were to occur, small scrapings are not produced and pipes do not need to be cleaned. The compressor according to the eighteenth aspect can contribute to global environmental problems.

BRIEF DESCRIPTION OF THE DRAWINGS

FIG. 16(*b*) is a diagram showing the compression work area in a conventional fixed scroll;

FIG. 16(*c*) is a diagram showing the thrust area in a conventional fixed scroll;

FIG. 16(*d*) is a diagram showing the partition surface area in the fixed scroll of the first embodiment;

FIG. 16(*e*) is a diagram showing the compression work area in the fixed scroll of the first embodiment;

FIG. 16(*f*) is a diagram showing the thrust area in the fixed scroll of the first embodiment;

FIG. 17(*b*) is a diagram showing the compression work area in a conventional movable scroll;

FIG. 17(*c*) is a diagram showing the thrust area in a conventional movable scroll;

FIG. 17(*d*) is a diagram showing the partition surface area in the movable scroll of the first embodiment;

FIG. 17(*e*) is a diagram showing the compression work area in the movable scroll of the first embodiment;

FIG. 17(*f*) is a diagram showing the thrust area in the movable scroll of the first embodiment;

FIG. 18(*b*) is a diagram showing the intake capacity formed by the scroll of the first embodiment;

FIG. 32(*b*) is a diagram showing the intake capacity formed by the scroll of a modified example (O) of the first embodiment;

FIG. 58(*b*) is a diagram showing the range of the internal peripheral surface of the portion of the wrap of the movable scroll adjacent to where winding starts according to the fourth embodiment;

DETAILED DESCRIPTION OF THE INVENTION

First Embodiment

A compressor in which the slider according to a first embodiment is used will be described using a high-low pressure dome-type scroll compressor as an example. The high-low pressure dome-type compressor of the first embodiment is designed so as to be capable of withstanding carbon dioxide refrigerant (CO2), R410A, or another high-pressure refrigerant.

Figure 1:
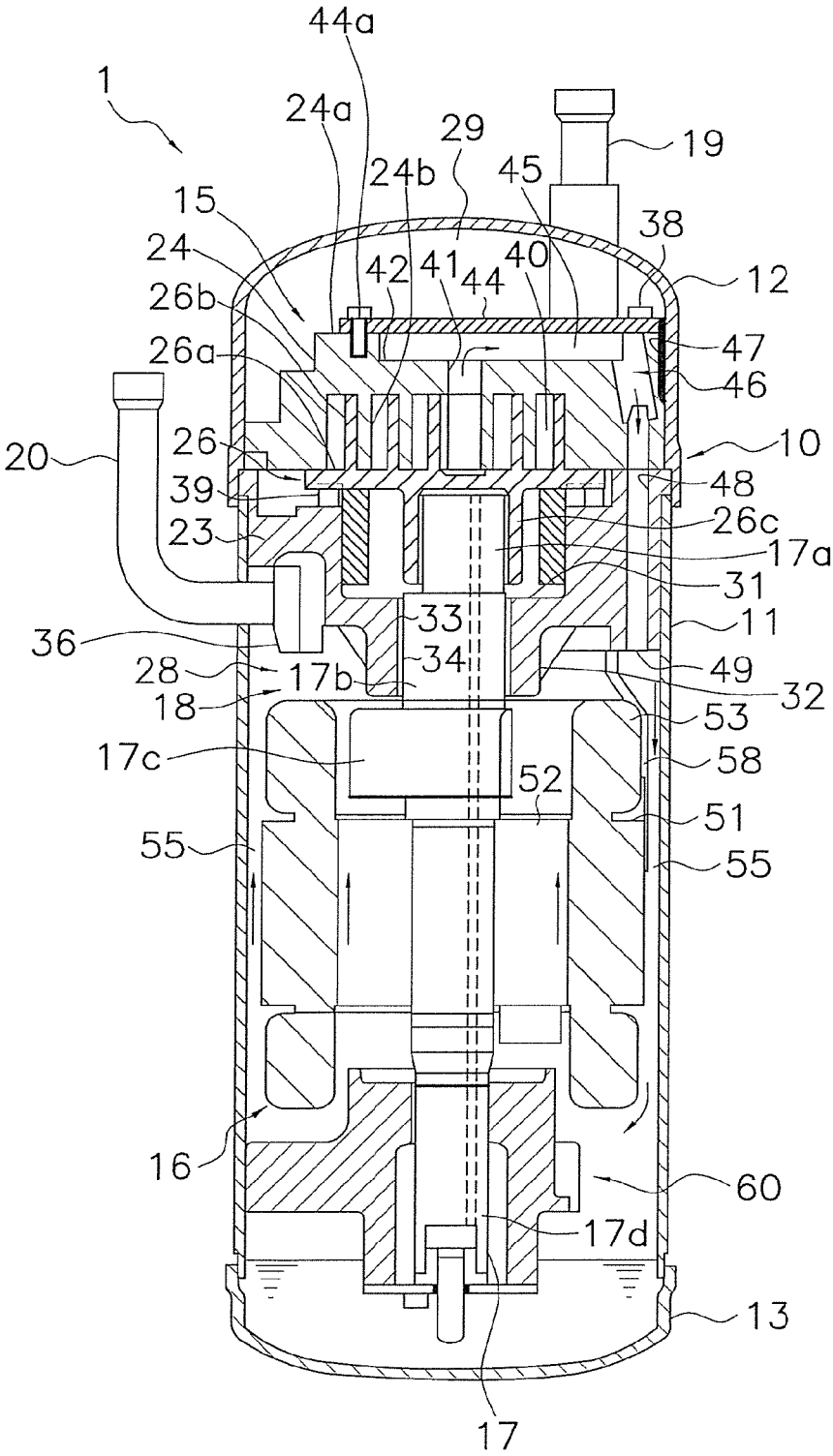
FIG. 1 is a longitudinal sectional view of a high-low pressure dome-type scroll compressor according to a first embodiment of the present invention.

The high-low pressure dome-type scroll compressor 1 according to the first embodiment constitutes a refrigerant circuit together with an evaporator, a condenser, an expansion mechanism, and the like; acts to compress a gas refrigerant in the refrigerant circuit; and is primarily composed of a hermitically sealed cylindrical dome-type casing 10, a scroll compression mechanism 15, an Oldham ring 39, a drive motor 16, a lower main bearing 60, a suction tube 19, and a discharge tube 20, as shown in FIG. 1. The constituent elements of the high-low pressure dome-type scroll compressor 1 will be described in detail below.

(Details of the Constituent Elements of a High-Low Pressure Dome-Type Scroll Compressor)

(1) Casing

The casing 10 primarily has a substantially cylindrical trunk casing 11, a saucer-shaped upper wall portion 12 welded in an airtight manner to an upper end of the trunk casing 11, and a saucer-shaped lower wall portion 13 welded in an airtight manner to a lower end of the trunk casing 11. Primarily accommodated in the casing 10 are the scroll compression mechanism 15 for compressing gas refrigerant, and the drive motor 16 disposed below the scroll compression mechanism 15. The scroll compression mechanism 15 and the drive motor 16 are connected by a crankshaft 17 disposed so as to extend in the vertical direction inside the casing 10. As a result, a clearance space 18 is formed between the scroll compression mechanism 15 and the drive motor 16.

(2) Scroll Compression Mechanism

The scroll compression mechanism 15 is primarily composed of a housing 23, a fixed scroll 24 provided in close contact above the housing 23, and a movable scroll 26 for meshing with the fixed scroll 24, as shown in FIG. 1. The constituent elements of the scroll compression mechanism 15 will be described in detail below.

a) Housing

The housing 23 is press-fitted and secured to the trunk casing 11 in peripheral direction across the entire external peripheral surface of the housing. In other words, the trunk casing 11 and the housing 23 are in kept close contact in an airtight manner across the entire periphery. For this reason, the interior of the casing 10 is partitioned into a high-pressure space 28 below the housing 23, and a low-pressure space 29 above the housing 23. Also, the fixed scroll 24 is fixedly fastened by a bolt 38 to the housing 23 so that the upper end surface of the housing 23 is in close contact with the lower end surface of the fixed scroll 24. A housing concavity 31 concavely disposed in the center of the upper surface of the housing 23, and a bearing portion 32 that extends downward from the center of the lower surface of the housing 23, are formed in the housing 23. A bearing hole 33 that passes through in the vertical direction is formed in the bearing portion 32, and a main shaft portion 17*b* of the crankshaft 17 is rotatably fitted to the bearing hole 33 via the a shaft bearing 34.

In the first embodiment, the housing 23 is manufactured using a novel and special manufacturing method. The manufacturing method is described in detail below in the section titled "Method for manufacturing a slider."

b) Fixed Scroll

Figure 2:
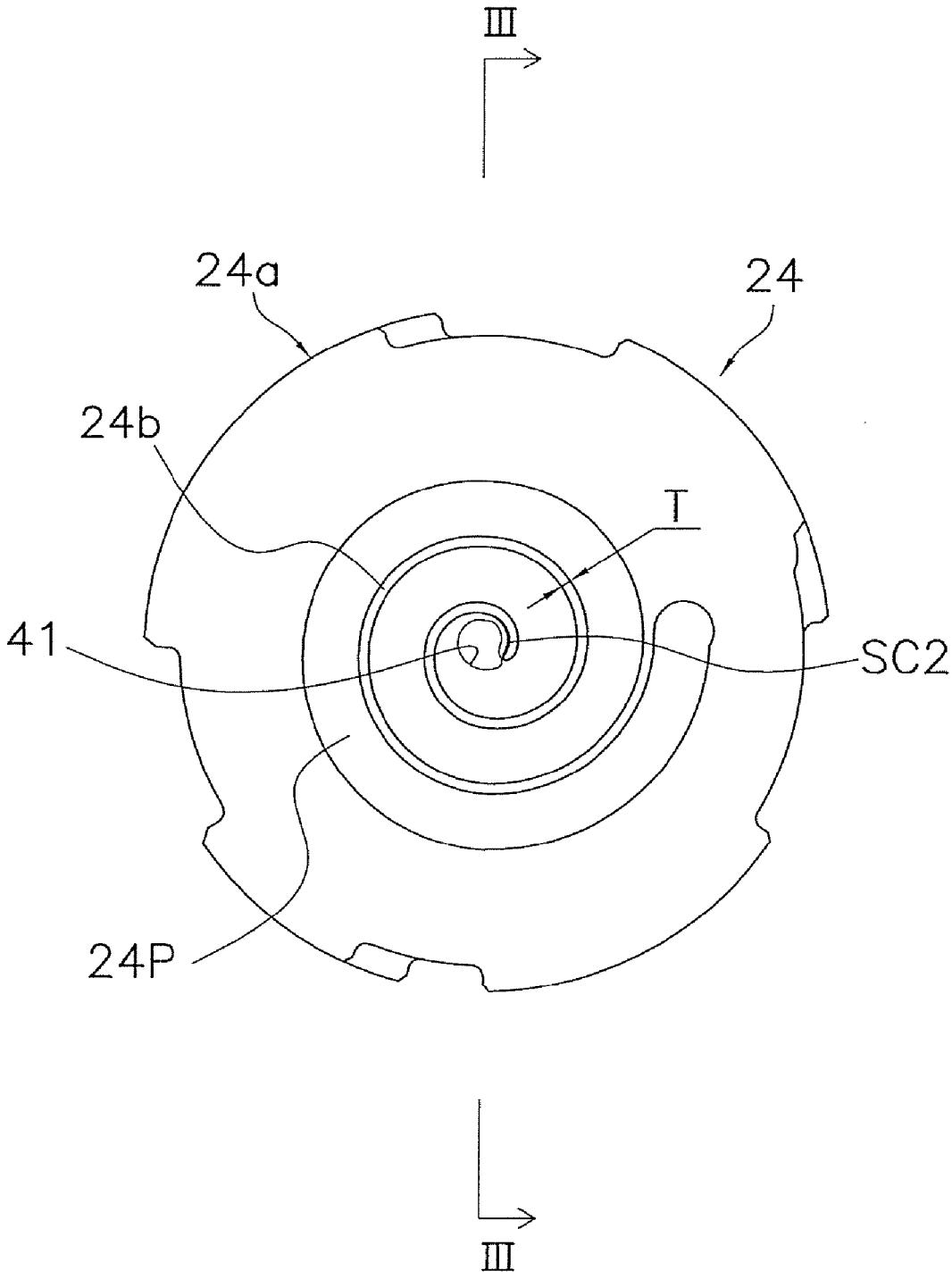
FIG. 2 is a bottom view of a fixed scroll incorporated in a high-low pressure dome-type scroll compressor according to the first embodiment of the present invention.
Figure 3:
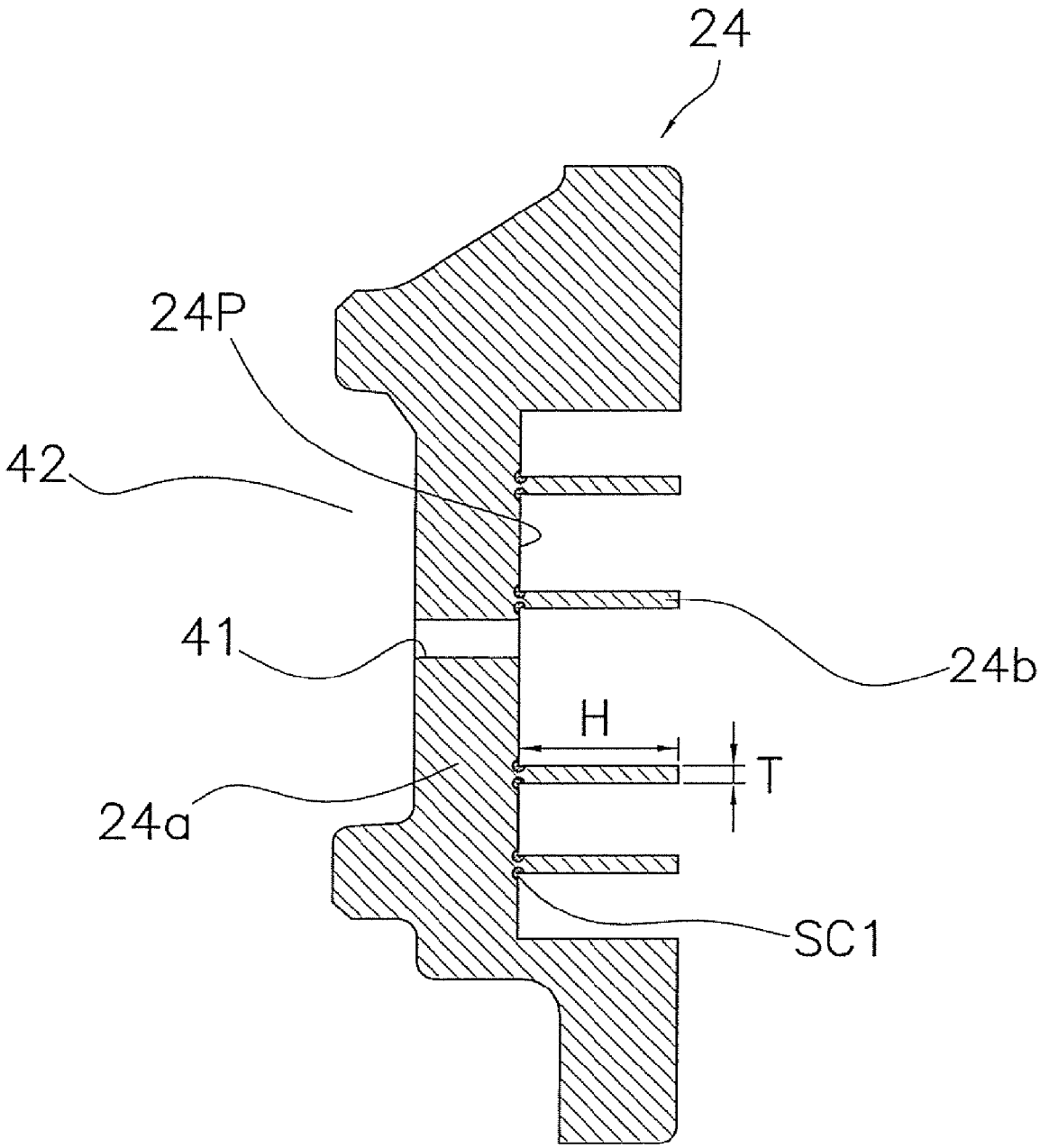
FIG. 3 is a cross-sectional view along the line of the fixed scroll incorporated in a high-low pressure dome-type scroll compressor according to the first embodiment of the present invention.

The fixed scroll 24 is primarily composed of an end plate 24*a* and a scroll (involute shape) wrap 24*b* that extends downward from the lower surface 24P of the end plate 24*a*, as shown in FIGS. 1 to 3. A discharge hole 41 that is in communication with a later-described compression chamber 40, and an enlarged concave portion 42 that is in communication with the discharge hole 41, are formed in the end plate 24*a*. The discharge hole 41 is formed so as to extend in the vertical direction in the center portion of the end plate 24*a*. The enlarged concave portion 42 is a concavity that is formed so as to widen in the horizontal direction on the upper surface of the end plate 24*a*. An opening formation area P (see FIG. 9) provided with the discharge hole 41 is thinly formed in advance in the fixed scroll 24, as shown in the manufacturing method described below, whereby the generation of blowholes CN (see FIG. 9) is reduced. The ratio of the height of the wrap 24*b* in relation to the thickness of wrap 24*b* is 15 or more. The angle portion and the corner portion of the wrap 24*b* have a rounded shape that fits into the angle portion and corner portion of the wrap 26*b* of the movable scroll.

A lid body 44 is fixedly fastened with a bolt 44*a* to the upper surface of the fixed scroll 24 so as to straddle the enlarged concave portion 42. A muffler space 45 for muffling the operating noise of the scroll compression mechanism 15 is formed by covering the enlarged concave portion 42 with a lid body 44. The fixed scroll 24 and the lid body 44 are sealed by close contact via packing, which is not depicted.

In the first embodiment, the fixed scroll 24 is manufactured using a novel and special manufacturing method. The manufacturing method is described in detail below in the section titled "Method for manufacturing a slider."

c) Movable Scroll

Figure 4:
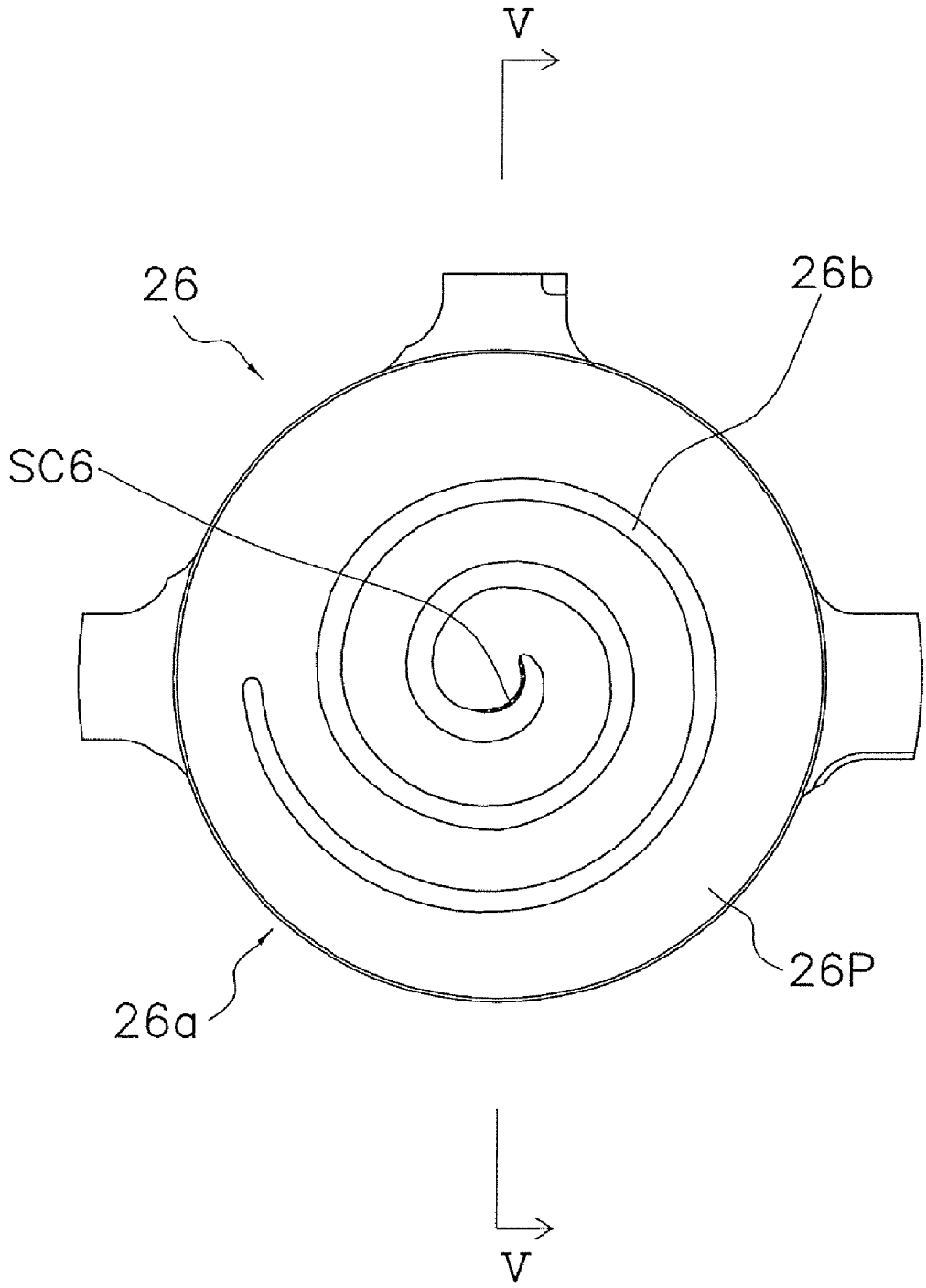
FIG. 4 is a top view of a movable scroll incorporated in a high-low pressure dome-type scroll compressor according to the first embodiment of the present invention.
Figure 5:
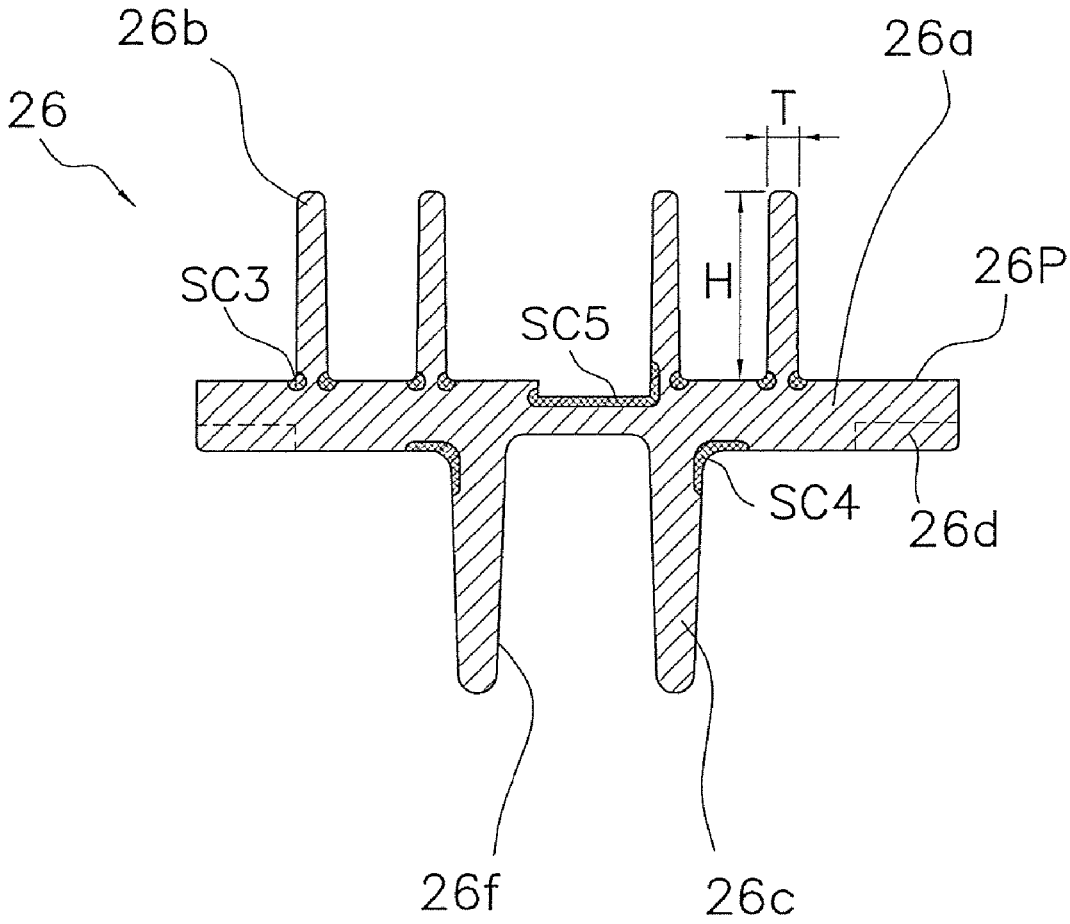
FIG. 5 is cross-sectional view along the line V-V of the movable scroll incorporated in a high-low pressure dome-type scroll compressor according to the first embodiment.

The movable scroll 26 is an outer drive-type movable scroll and is primarily composed of an end plate 26*a*, a scroll (involute shape) wrap 26*b* that extends upward from the end surface 26P of the end plate 26*a*, a bearing portion 26*c* that extends downward from the lower surface of the end plate 26*a* and is fitted to the outer side of the crankshaft 17, and a groove portion 26*d* (see FIG. 5) formed in the two ends of the end plate 26*a*, as shown in FIGS. 1, 4 and 5.

The movable scroll 26 is supported by the housing 23 via an Oldham ring 39 fitted into the groove portion 26*d* (see FIG. 1). An eccentric shaft portion 17*a* of the crankshaft 17 is fitted into the bearing portion 26*c*. The movable scroll 26, by being incorporated into the scroll compression mechanism 15 in this manner, non-rotatably orbits the interior of the housing 23 due to the rotation of the crankshaft 17. The wrap 26*b* of the movable scroll 26 meshes with the wrap 24*b* of the fixed scroll 24, and the compression chamber 40 is formed between the contact portions of the two wraps 24*b*, 26*b* (see FIG. 18(*b*)). In the compression chamber 40, the two wraps are displaced toward the center in accompaniment with the orbiting of the movable scroll 26, and the capacity of the compression chamber decreases. In the high-low pressure dome-type scroll compressor 1, gas refrigerant in the compression chamber 40 is compressed in this manner.

In the first embodiment, the movable scroll 26 is manufactured using a novel and special manufacturing method. The manufacturing method is described in detail below in the section titled "Method for manufacturing a slider."

d) Other

A communication channel 46 is formed in the scroll compression mechanism 15 across the fixed scroll 24 and the housing 23. The communication channel 46 is composed of a scroll-side channel 47 formed as a notch in the fixed scroll 24, and a housing-side channel 48 formed as a notch in the housing 23. The upper end of the communication channel 46, i.e., the upper end of the scroll-side channel 47, opens to the enlarged concave portion 42, and the lower end of the communication channel 46, i.e., the lower end of the housing-side channel 48, opens to the lower end surface of the housing 23. In other words, the lower end opening of the housing-side channel 48 is a discharge port 49 through which refrigerant in the communication channel 46 flows to the clearance space 18.

(3) Oldham Ring

Figure 6:
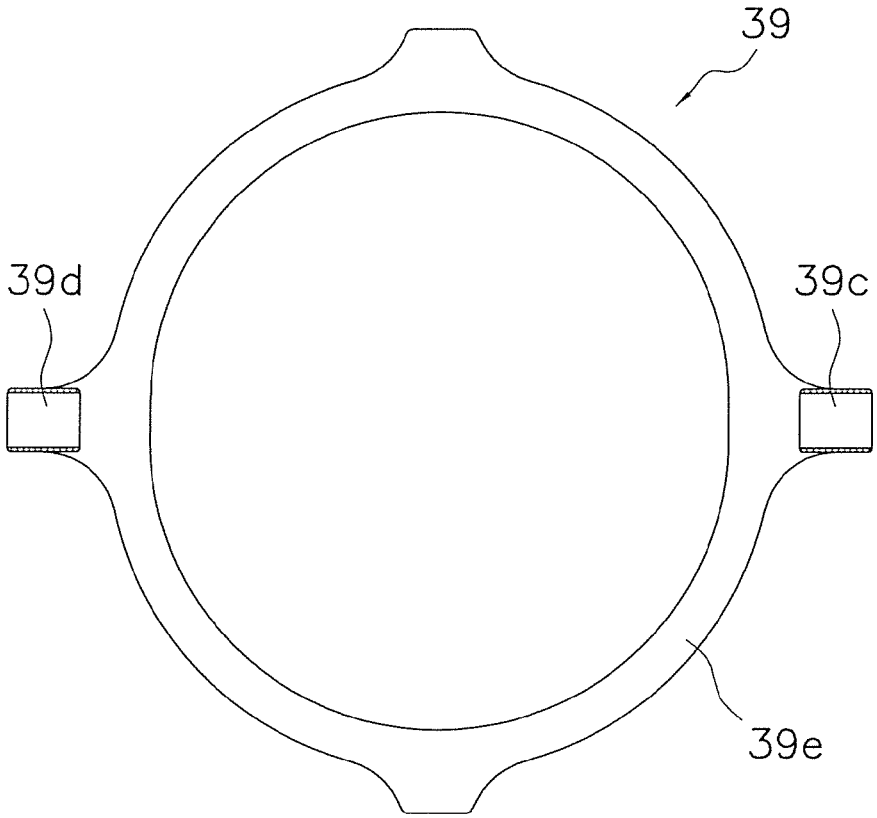
FIG. 6 is a top view of an Oldham ring incorporated in a high-low pressure dome-type scroll compressor according to the first embodiment.
Figure 7:
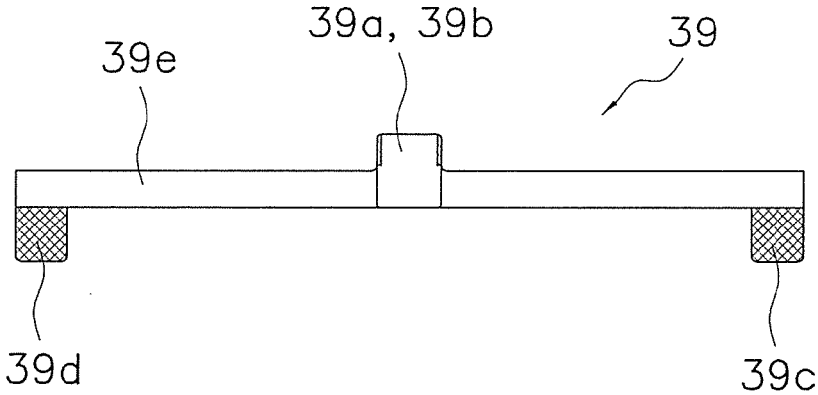
FIG. 7 is a side view of an Oldham ring incorporated in a high-low pressure dome-type scroll compressor according to the first embodiment.
Figure 8:
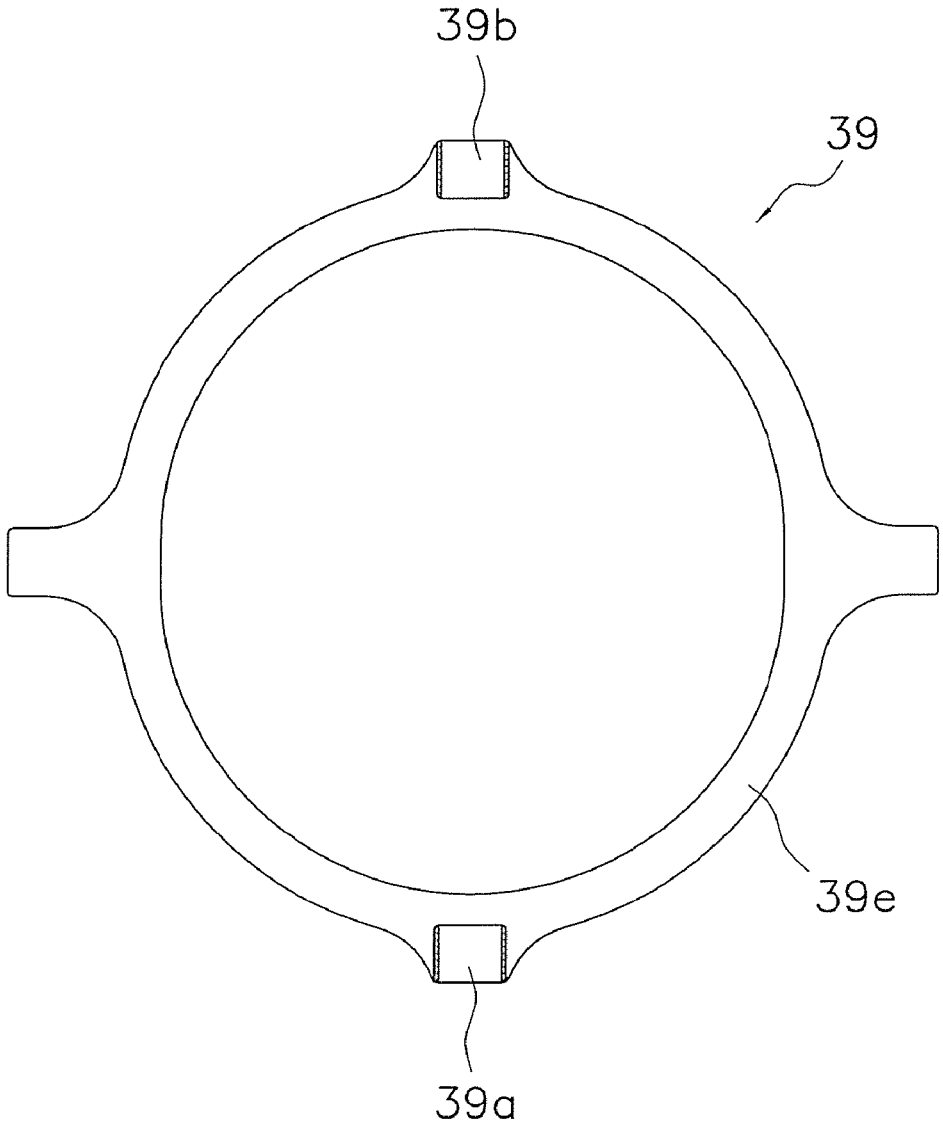
FIG. 8 is a bottom view of an Oldham ring incorporated in a high-low pressure dome-type scroll compressor according to the first embodiment.

An Oldham ring 39 is a member for preventing the movable scroll 26 from rotating, and is primarily composed of a main body 39*e*, movable scroll-side key portions 39*a*, 39*b*, and housing-side key portions 39*c*, 39*d*, as shown in FIGS. 6 to 8. The main body 39*e* is a substantially annular molded article, as shown in FIGS. 6 and 8. The movable scroll-side key portions 39*a*, 39*b* face in opposing directions, with the axis of the main body 39*e* disposed therebetween, and are a pair of projections that extend to one side along the axial direction from projection portions that extend to the external peripheral side in the radial direction of the main body 39*e*. The housing-side key portions 39*c*, 39*d* face in opposing directions, with the axis of the main body 39*e* disposed therebetween; are a pair of projections that extend to the opposite side of the movable scroll-side key portions 39*a*, 39*b* along the axial direction from projection portions that extend to the external peripheral side in the radial direction of the main body 39*e*; and are disposed in a position that is inclined substantially 90° from the movable scroll-side key portions 39*a*, 39*b* about the center of the axis. The movable scroll-side key portions 39*a*, 39*b* are fitted into a grove portion 26*d* of the movable scroll 26, and the housing-side key portions 39*c*, 39*d* are fitted into an Oldham groove (not shown) formed in the housing 23. The Oldham grooves are elliptical grooves disposed in positions so that the grooves face each other in the housing 23.

In the first embodiment, the Oldham ring 39 is manufactured using a novel and special manufacturing method. The manufacturing method is described in detail below in the section titled "Method for manufacturing a slider."

(4) Drive Motor

The drive motor 16 is a DC motor in the first embodiment, and is primarily composed of an annular stator 51 secured to the inner wall surface of the casing 10, and a rotor 52 rotatably accommodated with a small gap (air gap channel) inside the stator 51. The drive motor 16 is disposed so that the upper end of a coil end 53 formed at the upper end of the stator 51 is at substantially the same height position as the lower end of the bearing portion 32 of the housing 23.

A copper wire is wrapped around a tooth portion of the stator 51, and a coil end 53 is formed above and below the stator. The external peripheral surface of the stator 51 is provided with core cut portions that have been formed as notches in a plurality of locations from the upper end surface to the lower end surface of the stator 51 at prescribed intervals in the peripheral direction. A motor cooling channel 55 that extends in the vertical direction is formed by the core cut portions between the trunk casing 11 and the stator 51.

A rotor 52 is drivably connected to the movable scroll 26 of the scroll compression mechanism 15 via the crankshaft 17 disposed in the axial center of the trunk casing 11 so as to extend in the vertical direction. A guide plate 58 for guiding the refrigerant that has flowed out of the discharge port 49 of the communication channel 46 to the motor cooling channel 55 is disposed in the clearance space 18.

(5) Crankshaft

The crankshaft 17 is a substantially cylindrical integrally molded article, as shown in FIG. 1, and is primarily composed of an eccentric shaft portion 17*a*, a main shaft portion 17*b*, a balance weight portion 17*c*, and a secondary shaft portion 17*d*. The eccentric shaft portion 17*a* is accommodated in the bearing portion 26*c* of the movable scroll 26. The main shaft portion 17*b* is accommodated in the bearing hole 33 of the housing 23 via the shaft bearing 34. The secondary shaft portion 17*d* is accommodated in the lower main bearing 60.

In the first embodiment, the crankshaft 17 is manufactured using a novel and special manufacturing method. The manufacturing method is described in detail below in the section titled "Method for manufacturing a slider."

(6) Lower Main Bearing

The lower main bearing 60 is disposed in a lower space below the drive motor 16. The lower main bearing 60 is secured to the trunk casing 11, constitutes the lower end-side bearing of the crankshaft 17, and accommodates the secondary shaft portion 17*d* of the crankshaft 17.

In the present embodiment, the lower main bearing 60 is manufactured using a novel and special manufacturing method. The manufacturing method is described in detail below in the section titled "Method for manufacturing a slider."

(7) Suction Tube

The suction tube 19 is used for guiding the refrigerant of the refrigerant circuit to the scroll compression mechanism 15 and is fitted in an airtight manner in the upper wall portion 12 of the casing 10. The suction tube 19 passes through the low-pressure space 29 in the vertical direction, and the inside end portion is fitted into the fixed scroll 24.

(8) Discharge Tube

The discharge tube 20 is used for discharging the refrigerant inside the casing 10 to the exterior of the casing 10, and is fitted in an airtight manner into the trunk casing 11 of the casing 10. The discharge tube 20 has an inside end portion 36 formed in the shape of a cylinder extending in the vertical direction, and is secured to the lower end portion of the housing 23. The inside end opening of the discharge tube 20, i.e., the inlet, is opened downward.

(Method for Manufacturing a Slider)

In the high-low pressure dome-type scroll compressor 1 according to the first embodiment, a crankshaft 17, a housing 23, a fixed scroll 24, a movable scroll 26, an Oldham ring 39, and a lower main bearing 60 constitute sliders. These sliders are manufactured using the manufacturing method described below.

(1) (Raw Material)

The iron material as the raw material of the sliders according to the first embodiment is a billet to which the following components have been added: C: 2.3 to 2.4 wt %, Si: 1.95 to 2.05 wt %, Mn: 0.6 to 0.7 wt %, P: <0.035 wt %, S: <0.04 wt %, Cr: 0.00 to 0.50 wt %, Ni: 0.50 to 1.00 wt %. As used herein, weight ratios are ratios in relation to the entire amount. Also, the term "billet" refers to a pre-molded material in which an iron material having the above-described components has been temporarily melted in a melting furnace and thereafter molded into a cylindrical shape or the like using a continuous casting apparatus. Here, the content of C and Si is determined so as to satisfy two objects: to achieve a tensile strength and tensile modulus of elasticity that are greater than those of flake graphite cast iron, and to provide a suitable fluidity for molding a slider preform having a complex shape. The Ni content is determined so as to achieve a metal structure that improves the toughness of the metal structure and is suitable for preventing surface cracks during molding.

(2) Manufacturing Step

The sliders according to the first embodiment are manufactured via a semi-molten die casting step, a heat treatment step, a finishing step, and a partial heat treatment step. The steps will be described in detail below.

a) Semi-Molten Die Casting Step

In the semi-molten die casting step, first, a billet is brought to a semi-molten state by high-frequency heating. Next, the semi-molten billet is introduced into a prescribed metal mold, and is then molded into a desired shape while a prescribed pressure is applied using a die casting machine to obtain a slider preform. The metal structure of the slider preform becomes white iron overall when the slider preform is removed from the mold and rapidly cooled. The slider preform is slightly larger than the slider that will be ultimately obtained, and the slider preform becomes the final slider when the machining tolerance has been removed in a later final finishing step.

Figure 9:
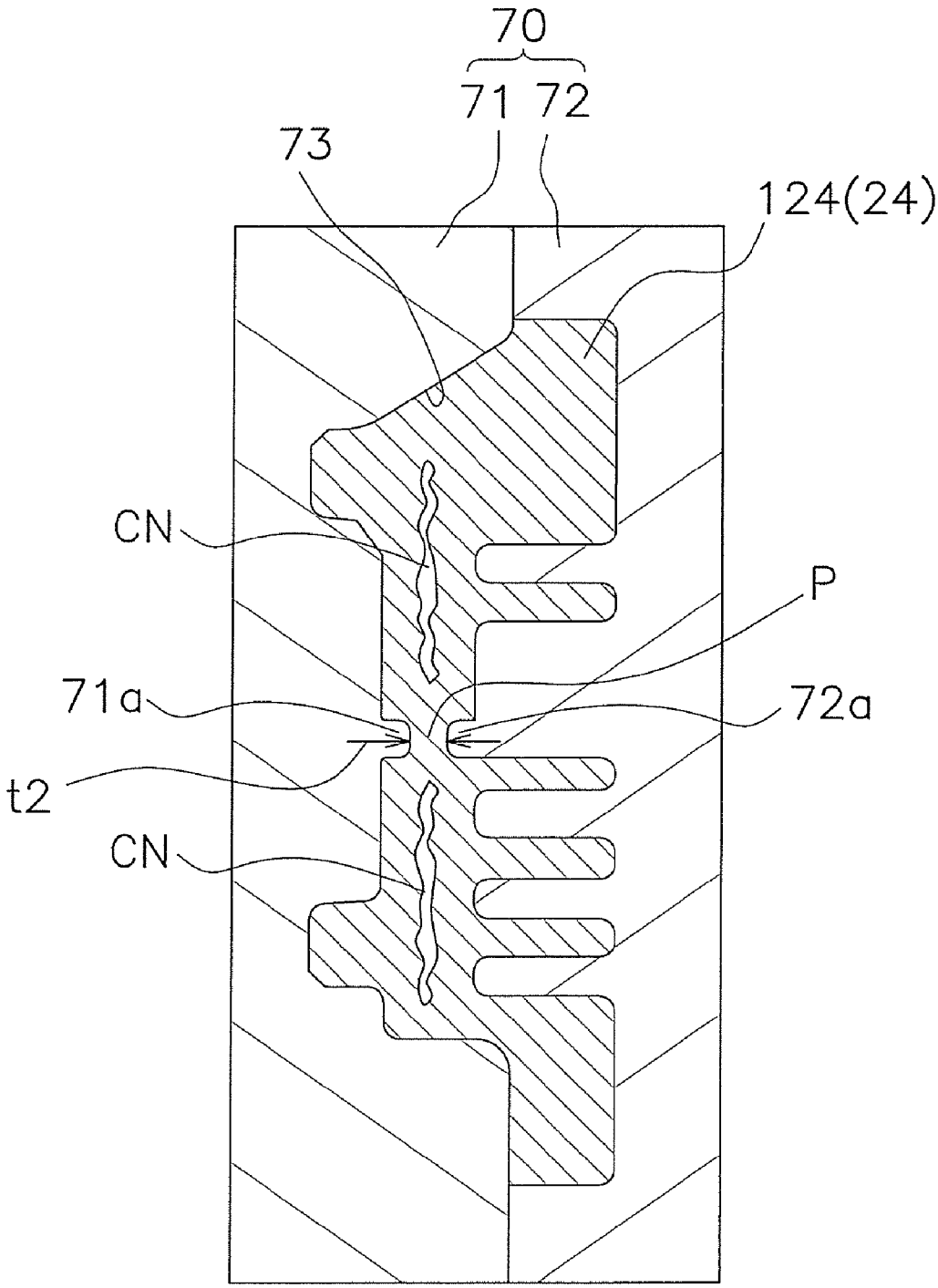
FIG. 9 is a cross-sectional view showing a metal-mold to produce a fixed scroll incorporated in a high-low pressure dome-type scroll compressor according to the first embodiment and a fixed scroll preform molded by semi-molten die casting.
Figure 11:
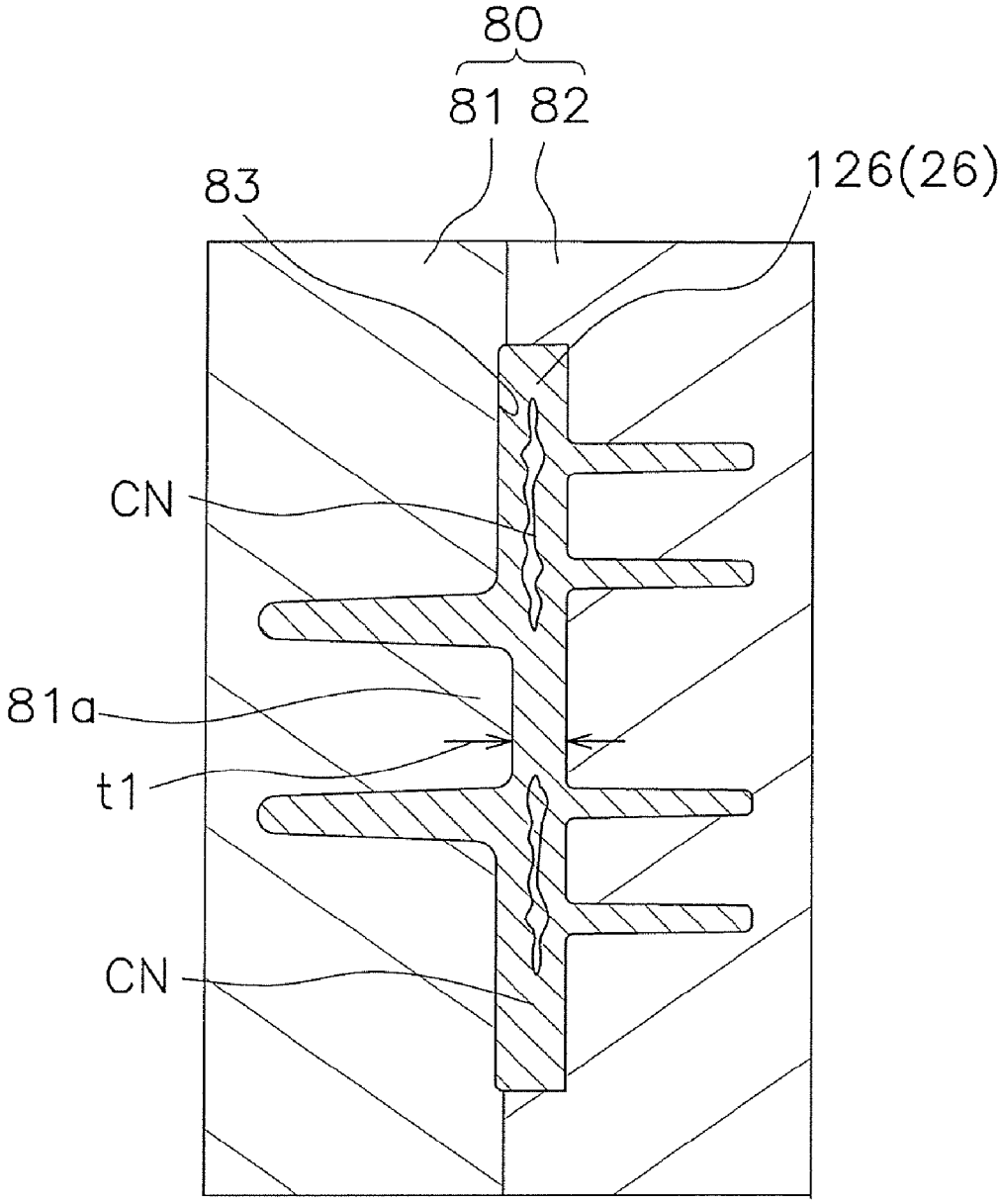
FIG. 11 is a longitudinal-sectional view showing a metal-mold to produce a movable scroll incorporated in a high-low pressure dome-type scroll compressor according to the first embodiment and a movable scroll preform molded by semi-molten die casting.

In the first embodiment, the preform 124 of the fixed scroll 24 is molded using the metal mold 70 shown in FIG. 9, and the preform 126 of the movable scroll 26 is molded using the metal mold 80 shown in FIG. 11.

(Molding of the Fixed Scroll)

The metal mold 70 for obtaining a preform 124 of the fixed scroll 24 by semi-molten die casting is composed of a first mold portion 71 and a second mold portion 72. The shape of a space portion 73 that is formed when the first mold portion 71 and the second mold portion 72 are combined corresponds to the shape of the external appearance of the fixed scroll 24 (i.e., the preform 124) prior to cutting.

A convexity 71*a* and a convexity 72*a* are formed on the first mold portion 71 and the second mold portion 72, respectively, so as to face each other in order to form an opening formation area P, which is an area in which a discharge hole 41 will be formed in the vicinity of the center of the preform 124 of the fixed scroll 24. The spacing between the convexity 71*a* and the convexity 72*a* is set to 4 mm or less. Therefore, the generation of blowholes CN can be further reduced because the thickness t2 (see FIGS. 9 and 10) of the opening formation area P is reduced to 4 mm or less.

Figure 13:
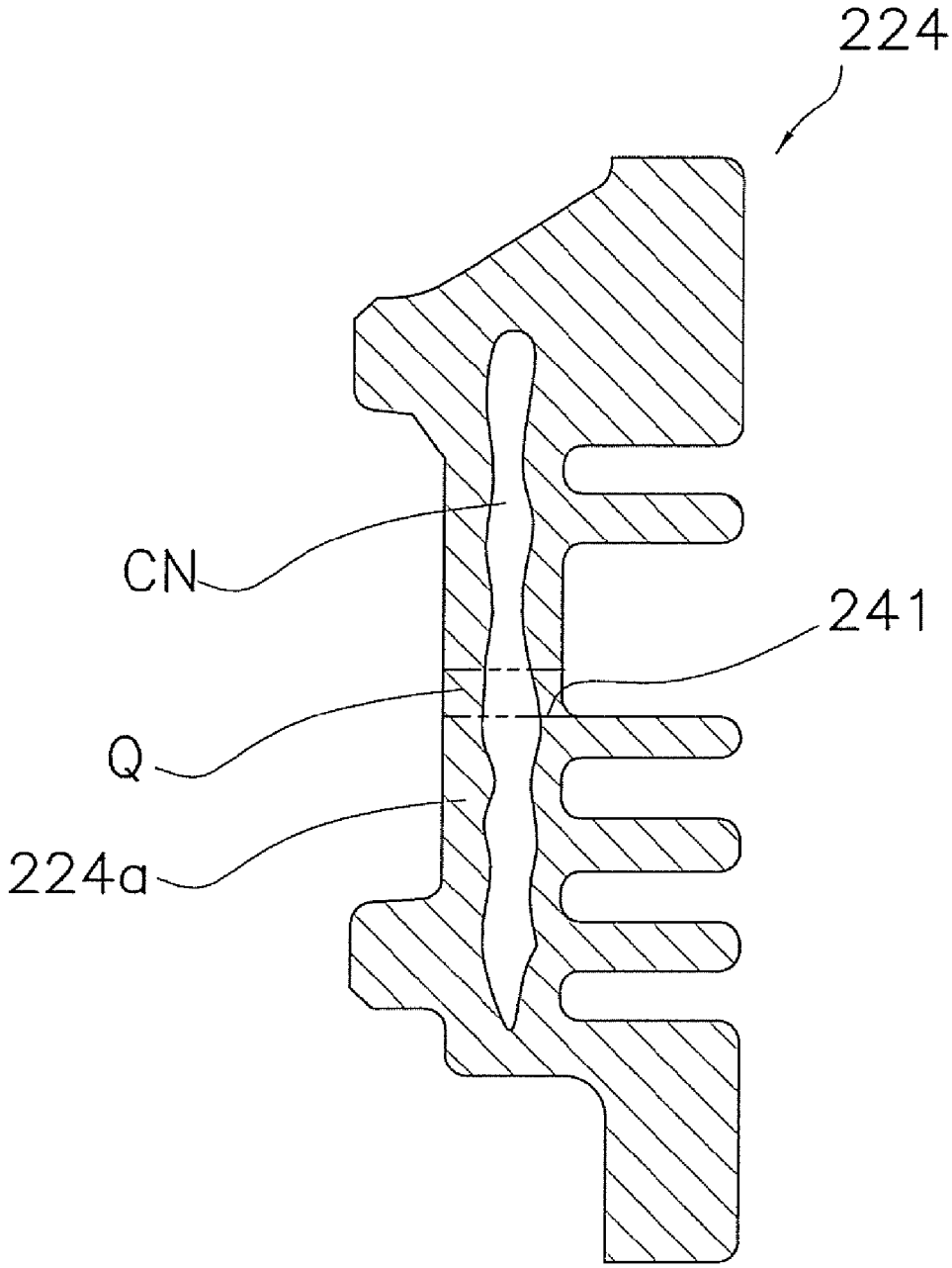
(Prior Art) FIG. 13
FIG. 13 is a longitudinal sectional view showing a conventional fixed scroll preform.

Here, as a comparative example, the thickness of an opening formation area Q in the vicinity of the center of the preform 224 is kept about the same as the thickness of the peripheral portions when the preform 224 of a conventional fixed scroll formed by semi-molten die casting shown in FIG. 13 is considered. Therefore, blowholes CN may be generated over a broad range inside a part 224*a* that corresponds to an end plate because blowholes are also generated in the vicinity of the center of the part 224*a* that corresponds to an end plate. Accordingly, the blowholes CN are exposed to the exterior from the discharge hole 241 when the discharge hole 241 (portion surrounded by two imaginary lines in FIG. 13) is formed by drilling into the opening formation area Q in the vicinity of the center of the preform 224. As a result, the fatigue strength of the fixed scroll after manufacture is considerably reduced.

(Molding of the Movable Scroll)

The metal mold 80 used in semi-molten die casting of a preform 126 of a movable scroll 26 is composed of a first mold portion 81 and a second mold portion 82, as shown in FIG. 11. The shape of the space 83 formed when the first mold portion 81 and the second mold portion 82 are combined corresponds to the shape of the external appearance of the movable scroll 26 (i.e., the preform 126) prior to cutting.

A convexity 81*a* for forming an internal space 26*f* (see FIG. 5) of the bearing portion 26*c* of the movable scroll 26 is formed in the first mold portion 81. The spacing of the convexity 81*a* and the second mold portion 82 is set to 4 mm or less. Therefore, the thickness t1 (see FIGS. 11 and 12) of the center portion of the art that corresponds to an end plate in the preform 126 of the movable scroll 26 is 4 mm or less. Accordingly, the occurrence of blowholes CN can be reduced in this portion.

The preform 126 of the movable scroll 26 has a thickness t1 in a center portion 26*e* of the part that corresponds to an end plate. This thickness is less than the thickness of the preform of a movable scroll of an inner drive; i.e., a movable scroll in which a bearing unit composed of a solid rounded rod fits inside the drive shaft. Accordingly, with this movable scroll 26, the occurrence of blowholes CN can be reduced in comparison with the movable scroll of an inner drive.

Figure 14:
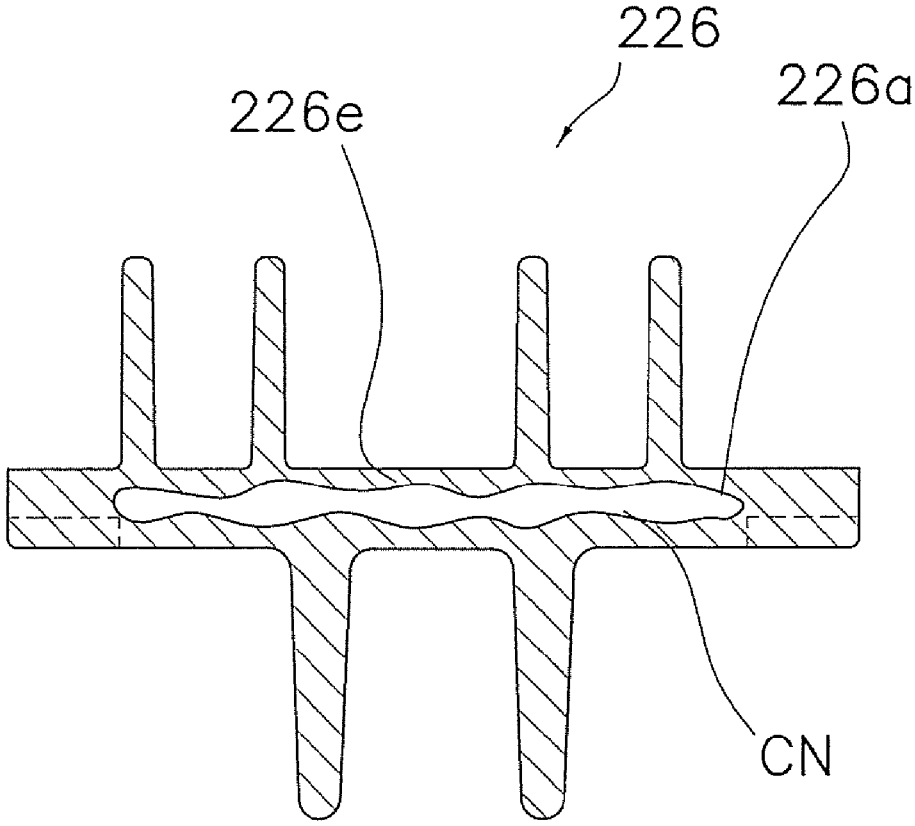
(Prior Art) FIG. 14
FIG. 14 is a longitudinal sectional view of a conventional movable scroll preform.

Here, when a conventional movable scroll preform 226 formed by semi-molten die casting shown in FIG. 14 is considered as a comparative example, the thickness of the center portion 226*e* is about the same as that of the peripheral portions. Therefore, numerous blowholes CN are generated in the vicinity of the center of the part 226*a* that corresponds to an end plate. Accordingly, the strength of the movable scroll formed in such a manner is reduced. In particular, since the largest gas load (or pressure) occurs in the center portion 226*e* during operation of the scroll compressor, the end plate is likely to deform when the strength of the center portion 226*e* is reduced. Furthermore, when the end plate deforms, the sliding state between the movable scroll and the fixed scroll is degraded, and this results in abrasion and seizing.

b) Heat Treatment Step

In the heat treatment step, the slider preform after the semi-molten die casting step is heat treated. In this heat treatment step, the metal structure of the slider preform changes from a white iron structure to a metal structure composed of a pearlite/ferrite base and granular graphite. The graphitization and pearlite transformation of the white iron structure can be adjusted by adjusting the heat treatment temperature, the holding time, the cooling rate, and the like. As described in, e.g., "Research of Semi-molten Iron Molding Techniques," Honda R&D Technical Review, Vol. 14, No. 1, a metal structure having a tensile strength of about 500 MPa to 700 MPa and a hardness of about HB 150 (HRB 81 (converted value from the SAE J 417 hardness conversion table)) to HB 200 (HRB 96 (converted value from the SAE J 417 hardness conversion table)) can be obtained by holding the metal for 60 minutes at 950° C. and thereafter gradually cooling the metal in the furnace at a cooling rate of 0.05 to 0.10° C./sec. Such a metal structure is primarily ferrite, and is therefore soft and has excellent machinability. However, a built-up edge of a blade during machining may be formed, and the service life of the blade tool may be reduced. The metal is held for 60 minutes at 1000° C., then air cooled, held for a prescribed length of time at a temperature that is slightly lower than the initial temperature, and thereafter air cooled, whereby a metal structure having a tensile strength of about 600 MPa to 900 MPa and a hardness of about HB 200 (HRB 96 (converted value from the SAE J 417 hardness conversion table)) to HB 250 (HRB 105, HRC 26 (converted value from the SAE J 417 hardness conversion table; HRB 105 is a reference value for extending beyond the effective practical range of a test type)) can be obtained. In such a metal structure, a substance whose hardness is equal to that of flake graphite cast iron has the same machinability as flake graphite cast iron, and better machinability than spheroidal graphite cast iron having the same ductility and toughness. Also possible is a method in which the metal is held for 60 minutes at 1000° C., cooled in oil, held for a prescribed length of time at a temperature that is slightly lower than the initial temperature, and thereafter air cooled, whereby a metal structure having a tensile strength of about 800 MPa to 1300 MPa and a hardness of about HB 250 (HRB 105, HRC 26 (converted value from the SAE J 417 hardness conversion table; HRB 105 is a reference value for extending beyond the effective practical range of a test type)) to HB 350 (HRB 122, HRC 41 (converted value from the SAE J 417 hardness conversion table; HRB 122 is a reference value for extending beyond the effective practical range of a test type)) can be obtained. Such a metal structure is primarily pearlite, and is therefore hard and has poor machinability but possesses excellent abrasion resistance. However, there is a possibility that the metal will damage the other member of the sliding pair due to excessive hardness.

In the heat treatment step in the first embodiment, the slider preform is heat treated under conditions that cause the hardness to be greater than HRB 90 (HB 176 (converted value from the SAE J 417 hardness conversion table) but less than HRB 100 (HB 219 (converted value from the SAE J 417 hardness conversion table). It is apparent that when the slider preform is manufactured using semi-molten die casting, the hardness of the slider preform is in a proportional relationship with the tensile strength of the slider preform, and therefore substantially corresponds to a range in which the tensile strength of the slider preform in this case is from 600 MPa to 900 MPa.

In the heat treatment step in the first embodiment, the slider preform is heat treated under conditions that cause the hardness to be greater than HRB 90 (HB 176 (converted value from the SAE J 417 hardness conversion table) but less than HRB 100 (HB 219 (converted value from the SAE J 417 hardness conversion table). It is apparent that when the slider preform is manufactured using semi-molten die casting, the hardness of the slider preform is in a proportional relationship with the tensile strength of the slider preform, and therefore substantially corresponds to a range in which the tensile strength of the slider preform in this case is from 600 MPa to 900 MPa.

In the heat treatment step of the preform 124 of the fixed scroll 24 and the preform 126 of the movable scroll 26, heat treatment is carried out so that the ratio of the tensile strength in relation to Young's modulus is 0.0046 or less. Heat treatment is carried out so that the ratio of the tensile strength in relation to Young's modulus is 0.0033 or more, so that the ferrite ratio is reduced to a level that allows abrasion resistance to be assured and so that a built-up edge is less likely to be formed during cutting. Since Young's modulus is 175 to 190 GPa regardless of the heat treatment, the heat treatment is carried out so that the tensile strength is about 600 MPa to 900 MPa.

c) Finishing Step

In the finishing step, the slider preform is machined and the slider is completed.

In the finishing step of the preform 124 of the fixed scroll 24, the discharge hole 41, which is a through-hole in the opening formation area P, is formed by conventionally known drilling or the like, and the portion corresponding to the warp is cut by end milling or the like. The height H from the end plate 24P to the distal end, as well as the thickness T, are given prescribed design values, as shown in FIG. 3.

In the finishing step of the preform 126 of the movable scroll 26, the portion corresponding to the warp is cut by end milling or the like, and a notched portion (counterbore) SC5 for dispersing the stress of a gas load is formed by end milling or the like. The height H from the end plate 26P to the distal end, as well as the thickness T, are given prescribed design values, as shown in FIG. 5. The notched portion (counterbore) SC5 acts to disperse stress of the base portion of the wrap 26*b*, which is the portion in which stress is maximally concentrated.

When the high-low pressure dome-type scroll compressor 1 according to the first embodiment is incorporated in a refrigerant circuit of a refrigerant apparatus in which R410A is used as a refrigerant, the height H and thickness T of the wraps 24*b* and 26*b* are designed so that the ratio (H/T) is 10 to 19, assuming that the ratio of tensile strength in relation to Young's modulus of the fixed scroll 24 and the movable scroll 26 is 0.0033 to 0.0046. The amount of flexing (deformation amount) at the distal end of the end portion (end portion where winding starts) at the scroll center of the wraps 24*b*, 26*b* can be kept within an acceptable range by using such a design, and there is no problem in terms of strength, even when R410A, which is a gas refrigerant used in the refrigerant apparatus, is at maximal pressure.

When the high-low pressure dome-type scroll compressor 1 according to the first embodiment is incorporated in a refrigerant circuit of a refrigerant apparatus in which carbon dioxide is used as a refrigerant, the height H and thickness T of the wraps 24*b* and 26*b* are designed so that the ratio (H/T) is 2 to 8, assuming that the ratio of tensile strength in relation to Young's modulus of the fixed scroll 24 and the movable scroll 26 is 0.0033 to 0.0046. The amount of flexing (deformation amount) at the distal end of the end portion (end portion where winding starts) at the scroll center of the wraps 24*b*, 26*b* can be kept within an acceptable range by using such a design, and there is no problem in terms of strength, even when carbon dioxide, which is a gas refrigerant used in the refrigerant apparatus, is at maximal pressure.

d) Partial Heat Treatment Step

In the partial heat treatment step, laser heating treatment or high-frequency heating treatment is carried out in specific locations of the slider, and the fatigue strength and abrasion resistance of the specific locations is improved. In laser heating treatment or high-frequency heating treatment, a laser beam or a high frequency wave is irradiated so that the surface hardness of the heated portions is HRC 50 to HRC 65.

In the partial heat treatment step of the fixed scroll 24, laser heating treatment is performed on the peripheral portion SC1 of the base of the wrap 24*b* in which stress is concentrated during operation of the high-low pressure dome-type scroll compressor 1, and high-frequency heating treatment is performed on the innermost portion SC2 of the wrap 24*b* (see FIGS. 2 and 3; in the diagrams, the laser heating treatment locations are shaded).

In the partial heat treatment step of the movable scroll 26, laser heating treatment is performed on the peripheral portion SC3 of the base of the wrap 26*b* and in the peripheral portion SC4 of the base of the bearing portion 26*c* in which stress is concentrated during operation of the high-low pressure dome-type scroll compressor 1, and high-frequency heating treatment is performed on the notched portion SC5 formed in the vicinity of the design center of the end plate 26*a* and on the innermost portion SC6 of the wrap 26*b* (see FIGS. 4 and 5; in the diagrams, the laser heating treatment locations are shaded).

Figure 15:
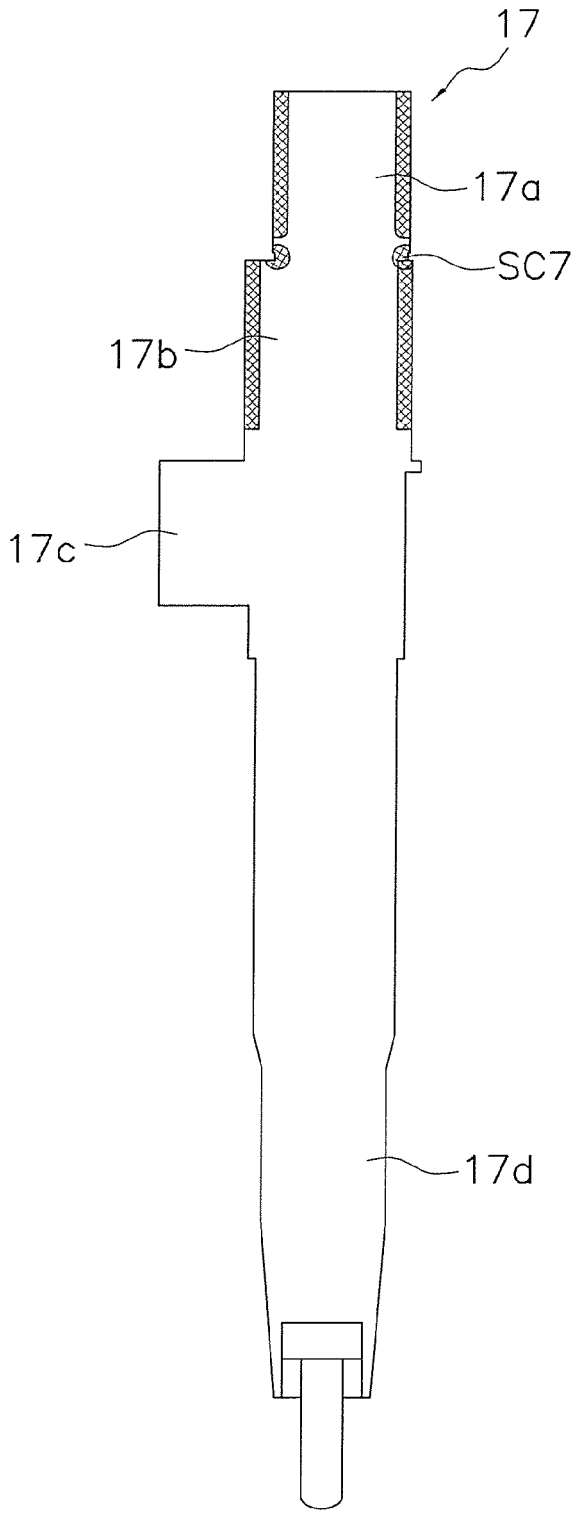
FIG. 15 is a longitudinal sectional view of a crankshaft incorporated in a high-low pressure dome-type scroll compressor according to the first embodiment.
Figure 16A:
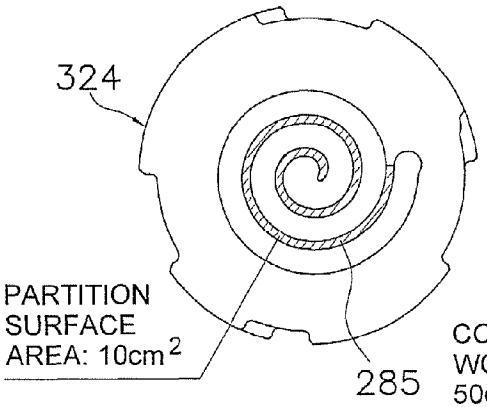
FIG. 16(a) (Prior Art)
FIG. 16(*a*) is a diagram showing the partition surface area in a conventional fixed scroll.
Figure 16B:
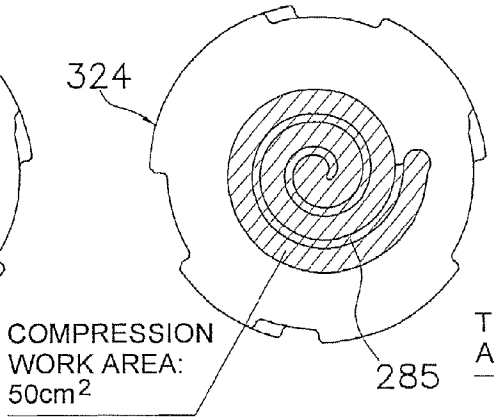
FIG. 16(b) (Prior Art)
Figure 16C:
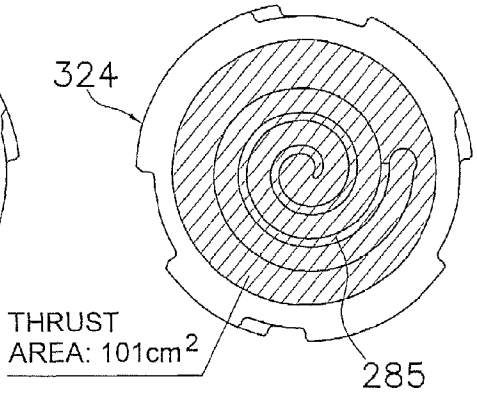
FIG. 16(c) (Prior Art)
Figure 16D:
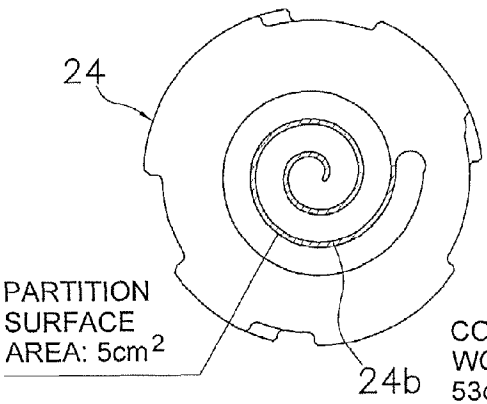
Figure 16E:
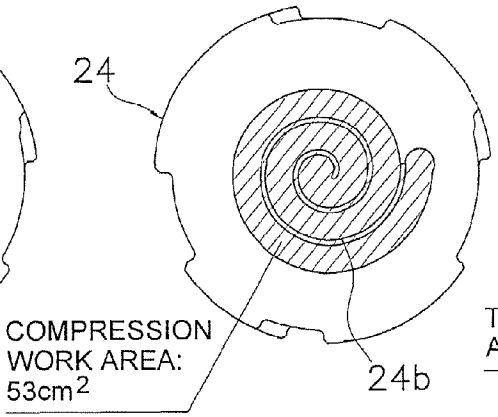
Figure 16F:
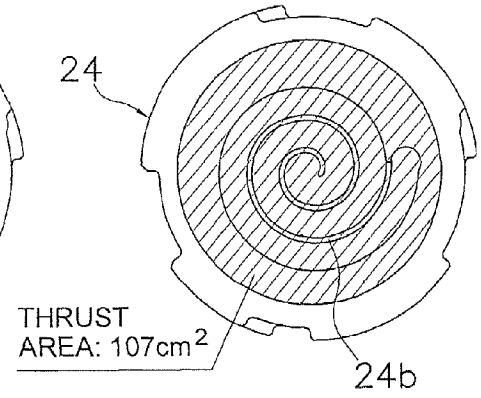
Figure 17A:
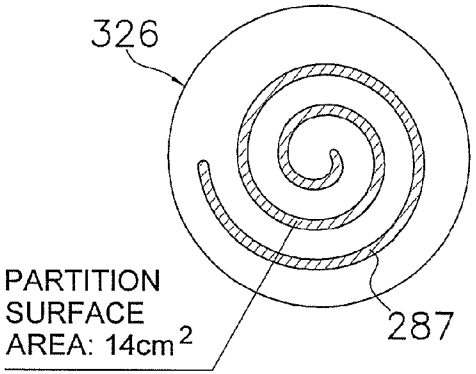
FIG. 17(a) (Prior Art)
FIG. 17(*a*) is a diagram showing the partition surface area in a conventional movable scroll.
Figure 17B:
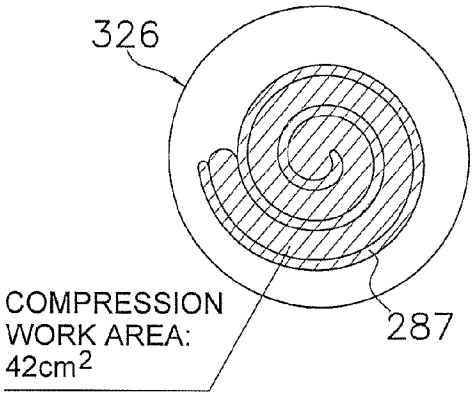
FIG. 17(b) (Prior Art)
Figure 17C:
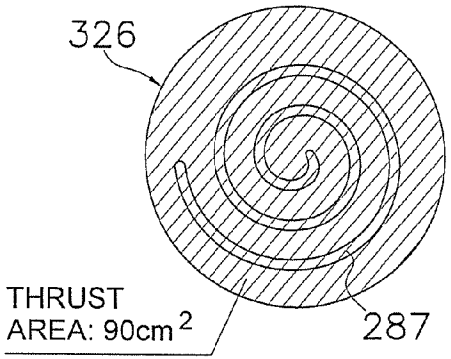
FIG. 17(c) (Prior Art)
Figure 17D:
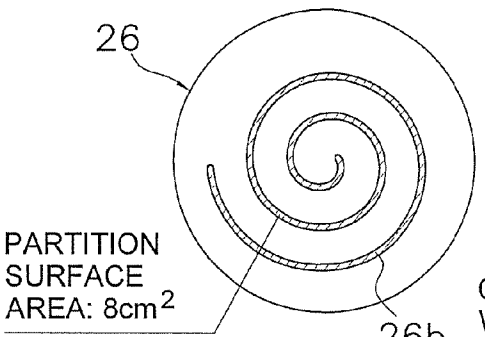
Figure 17E:
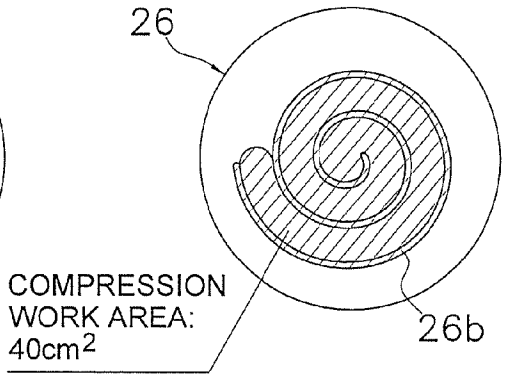
Figure 17F:
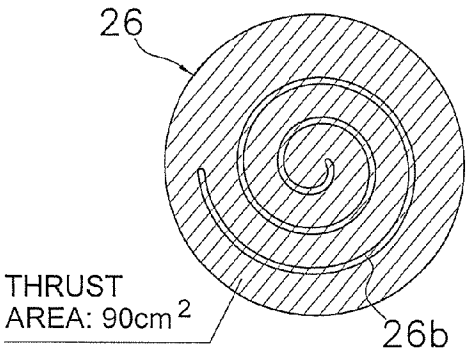

In the partial heat treatment step of the crankshaft 17, high-frequency heating treatment is performed on the eccentric shaft portion 17*a* and the main shaft portion 17*b*, which require abrasion resistance. Laser heating treatment is performed on the peripheral portion SC7 of the notched portion that is present between the eccentric shaft portion 17*a* and the main shaft portion 17*b* in which stress is concentrated during operation of the compressor (see FIG. 15; in the diagram, the laser heating treatment locations are shaded.)

In the partial heat treatment step of the Oldham ring 39, high-frequency heating treatment is performed on the movable scroll-side key portions 39*a*, 39*b* and the housing-side key portions 39*c*, 39*d*, which require abrasion resistance (see FIGS. 6, 7, and 8; in the diagrams, the high-frequency heating treatment locations are shaded).

(Operation of a High-Low Pressure Dome-Type Scroll Compressor)

Next, the operation of the high-low pressure dome-type scroll compressor 1 will be briefly described. First, when the drive motor 16 is driven, the drive shaft 17 rotates, and the movable scroll 26 orbits without rotation. At this point, low-pressure gas refrigerant passes through the suction tube 19, is suctioned from the peripheral edge of the compression chamber 40 into the compression chamber 40, is compressed as the capacity of the compression chamber 40 changes, and becomes a high-pressure gas refrigerant (see FIG. 18(*b*)). The high-pressure gas refrigerant passes from the center portion of the compression chamber 40 through the discharge channel 41; is discharged to the muffler space 45; then passes through communication channel 46, the scroll-side channel 47, the housing-side channel 48, and the discharge port 49; flows out to the clearance space 18; and flows downward between the guide plate 58 and the inner surface of the trunk casing 11. A portion of the gas refrigerant branches off and flows in the peripheral direction between the guide plate 58 and the drive motor 16 when the gas refrigerant flows downward between the guide plate 58 and the inner surface of the trunk casing 11. At this point, lubricating oil mixed with the gas refrigerant separates off. On the other hand, the other portion of the branched gas refrigerant flows downward through the motor cooling channel 55 to the space below the motor, and then reverses course and flows upward through the motor cooling channel 55 on the side (left side in FIG. 1) facing the communication channel 46 or the air gap channel between the stator 51 and the rotor 52. Thereafter, the gas refrigerant that has passed through the guide plate 58 and the gas refrigerant that has flowed from the air gap channel or the motor cooling channel 55 merge at the clearance space 18. The merged gas refrigerant flows from the inside-end portion 36 of the discharge tube 20 to the discharge tube 20, and is then discharged to the exterior of the casing 10. The gas refrigerant discharged to the exterior of the casing 10 circulates through the refrigerant circuit, then passes through the suction tube 19 again, and is suctioned and compressed in the scroll compression mechanism 15.

Figure 18B:
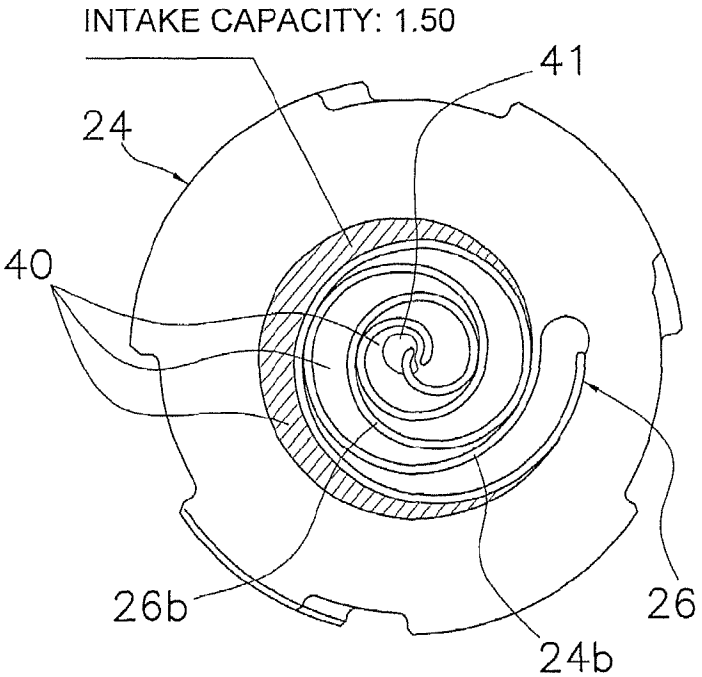
FIG. 18(*a*) is a diagram showing the intake capacity formed by a conventional scroll.
Figure 18A:
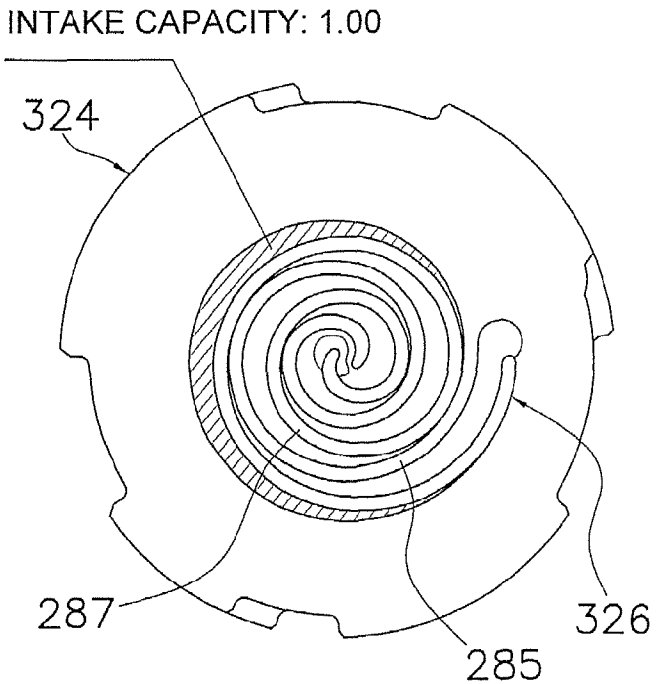
(Prior Art) FIG. 18(a)

Comparison of a Conventional Scroll in which an Fc Material is Used, and the Scroll of First Embodiment Next, a comparison is made with reference to FIGS. 16 to 18 between a conventional fixed scroll 324 and movable scroll 326 that use FC250, and the fixed scroll 24 and movable scroll 26 of the compressor 1 according to the first embodiment. In this case, the height H of the wraps 285, 287, 24*b*, 26*b* of the scrolls 324, 326, 24, 26 are all set to be the same. The thickness T of the wraps 285, 287 are set based on design guidelines for conventional strength in the conventional fixed scroll 324 and movable scroll 326, and the thickness T of the wraps 24*b*, 26*b* are set based on the design guidelines described above for the fixed scroll 24 and the movable scroll 26. A semi-molten die casting material is used for the fixed scroll 24 and the movable scroll 26, and since the strength is increased in comparison with conventional FC250, the thickness T of the wraps is reduced in comparison with the conventional fixed scroll 324 and movable scroll 326.

The shaded portions of FIGS. 16(*a*), 16(*b*), and 16(*c*) indicate the partition surface area, compression work area, and thrust area, respectively, in a conventional fixed scroll 324. The partition surface area is a lateral cross section surface area of a wrap (wrap 285, in this case). In contrast, shaded portions of FIGS. 16(*d*), 16(*e*), and 16(*f*) indicate the partition surface area, compression work area, and thrust area, respectively, in the fixed scroll 24. When FIGS. 16(*a*) and 16(*d*) are compared, the partition surface area is reduced in the fixed scroll 24 in comparison with the conventional fixed scroll 324. This is because the ratio (H/T) of the height H to the thickness T of the wrap 24*b* is increased in association with higher strength. When a comparison is made with reference to FIGS. 16(*c*) and 16(*f*) between the effective compression surface areas obtained by subtracting the partition surface area from the surface area of compression work area, the effective compression surface area is 48 $cm^2$, or about 20% greater in the fixed scroll 24, in comparison with the 40 $cm^2$ of the conventional fixed scroll 324.

The shaded portions of FIGS. 17(*a*), 17(*b*), and 17(*c*) indicate the partition surface area, compression work area, and thrust area, respectively, in a conventional movable scroll 326. The partition surface area is a lateral cross section surface area of a wrap (wrap 287, in this case). In contrast, shaded portions of FIGS. 17(*d*), 17(*e*), and 17(*f*) indicate the partition surface area, compression work area, and thrust area, respectively, in the movable scroll 26. When FIGS. 17(*a*) and 17(*d*) are compared, the partition surface area is reduced in the movable scroll 26 in comparison with the conventional movable scroll 326. This is because the ratio (H/T) of the height H to the thickness T of the wrap 26*b* is increased in association with higher strength. When a comparison is made with reference to FIGS. 17(*c*) and 17(*f*) between the effective compression surface areas obtained by subtracting the partition surface area from the surface area of compression work area, the effective compression surface area is 32 $cm^2$, or about 15% greater in the movable scroll 26, in comparison with the 28 $cm^2$ of the conventional movable scroll 326.

The shaded portion of FIG. 18(*a*) shows the suction capacity formed by the conventional fixed scroll 324 and movable scroll 326 having wraps 285, 287 in which the thickness T is relatively thick; and the shaded portion of FIG. 18(*b*) shows the suction capacity formed by the fixed scroll 24 and movable scroll 26 having wraps 24*b*, 26*b* in which the thickness T is relatively small (thin). In the compressor 1, the thickness T of the wraps 24*b*, 26*b* is reduced and the ratio (H/T) is increased. The suction capacity is thereby made about 1.5 times greater in comparison with a compressor in which the conventional scrolls 324, 326 are adopted.

(Tests)

(1) Abrasion Resistance Test and "Breaking-In" Test

Figure 19:
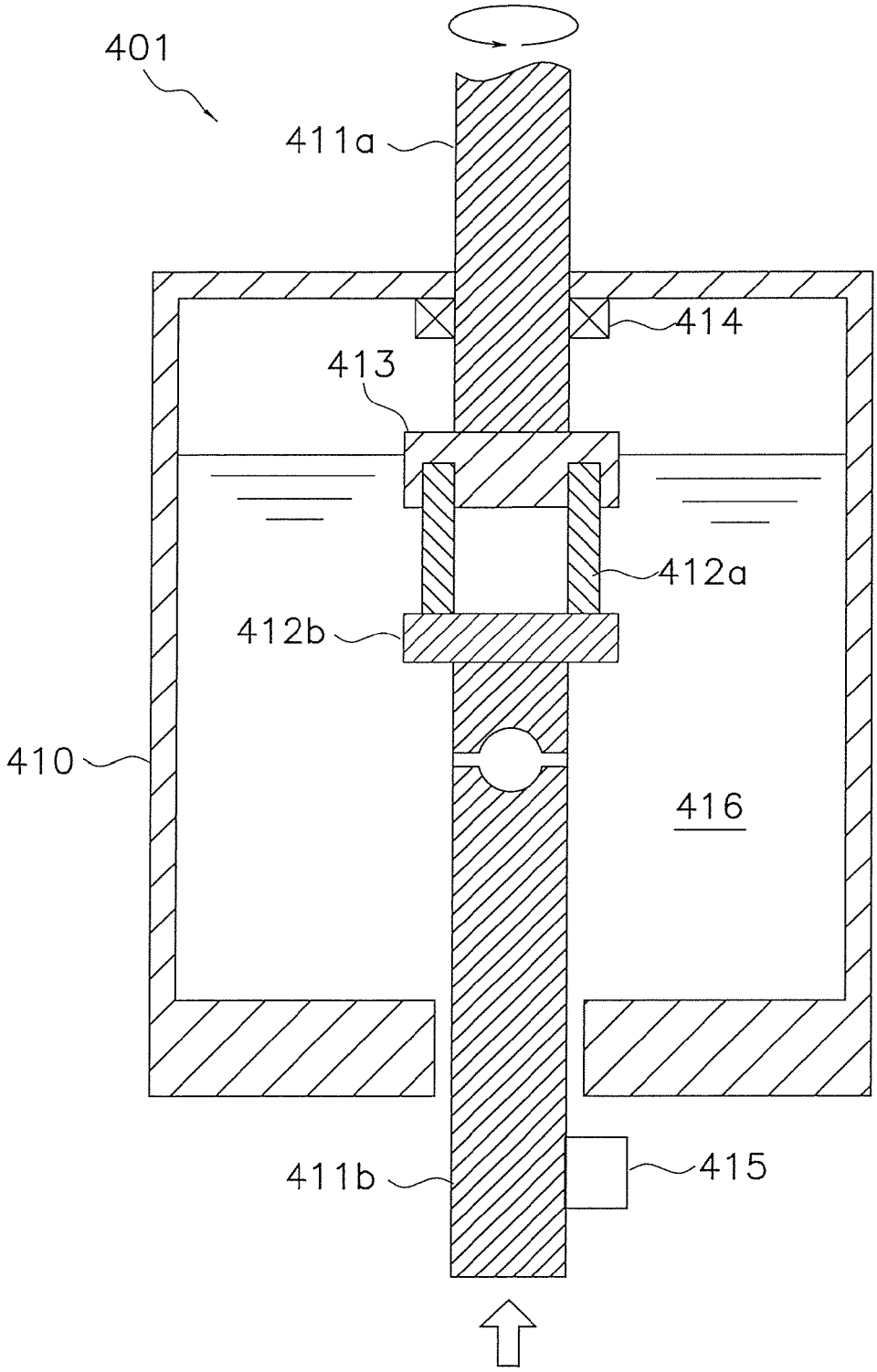
FIG. 19 is a schematic diagram of a test apparatus used for testing the abrasion resistance and seizing resistance of a molded article manufactured using semi-molten die casting.

First, a pin-shaped test piece 412*a* and a disc-shaped test piece 412*b* such as those shown in FIG. 19 were manufactured from a material fabricated by semi-molten die casting, and test pieces 412*a*, 412*b* having different levels of hardness were fabricated by varying the heat treatment conditions of the material fabricated by semi-molten die casting. The test pieces 412*a*, 412*b* were set in a pin/disc test apparatus 401 such as that shown in FIG. 19, the pin-shaped test piece 412*a* that was set in a holder 413 was made to slide for two hours against the disc-shaped test piece 412*b* under conditions of an average sliding speed of 2.0 m/s and a constant surface pressure load of 20 MPa in a liquid mixture 416 composed of ethereal oil (100° C.) and R410A refrigerant stored in a container 410, and the amount abrasion was measured. The surface pressure in this case was adjusted by using the load applied to the lower-side shaft 411*b*. A mechanical seal 414 was provided between an upper-side rotor shaft 411*a* and the container 410. The amount of abrasion in this was obtained by adding the pin abrasion amount and the disc abrasion amount.

Figure 20:
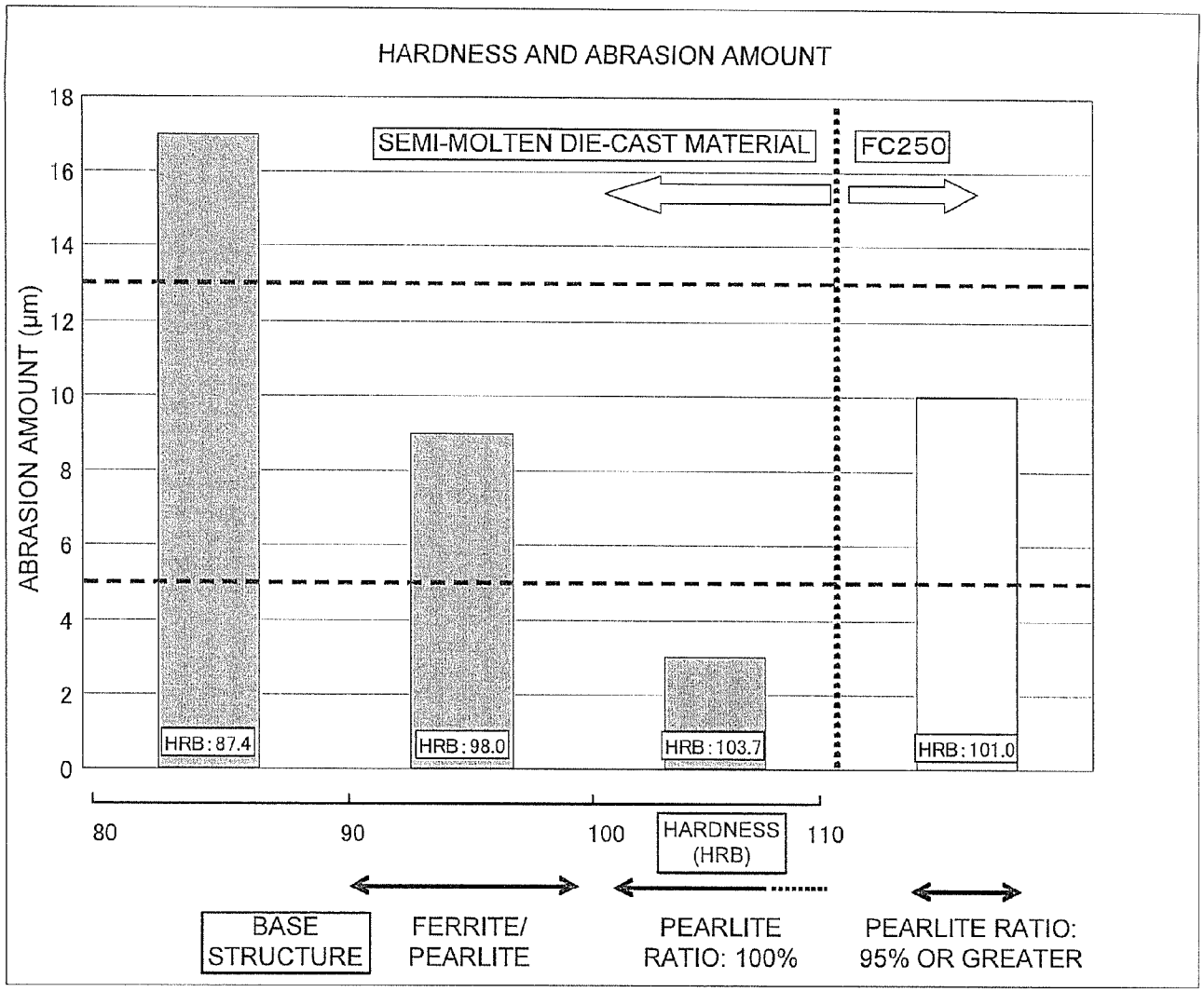
FIG. 20 is a graph showing the relationship between the hardness and the abrasion resistance of a molded article manufactured using semi-molten die casting.

The data obtained from this experiment is summarized in the bar graph shown in FIG. 20. The relationship between the abrasion amount and the hardness of the test pieces manufactured by semi-molten die casting (hereinafter referred to as semi-molten die cast test pieces) is shown in the left-side area facing the graph. For reference, the abrasion amount and the hardness of the test pieces composed of FC250 (hereinafter referred to as FC250 test pieces), which is a conventional material, are shown in the right-side area facing the graph. The test pieces composed of FC250 have a level of hardness (HRB 101.0) that indicates good "breaking-in" characteristics in a conventional compressor. Also, the base structure of FC250 test piece exhibiting such a level of hardness contains 95% or higher pearlite structure.

Figure 21:
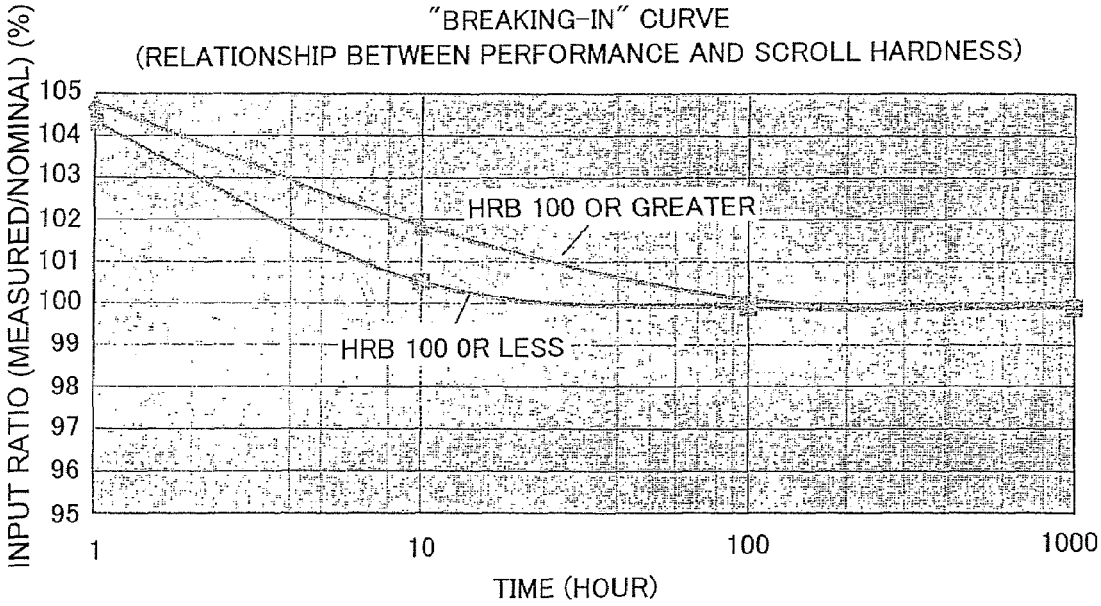
FIG. 21 is a graph showing the relationship between the hardness and the "breaking-in" of a scroll manufactured using semi-molten die casting.

Here, in view of the left-side area, it is apparent that the hardness and abrasion amount of the semi-molten die casting test pieces have a substantially proportional relationship. When the semi-molten die casting test pieces and the FC250 test piece are compared, it is apparent that the semi-molten die casting test piece having a hardness of HRB 103.7 has dramatically less abrasion amount than the FC250 test piece, the semi-molten die casting test piece having a hardness of HRB 98.0 has substantially the same abrasion amount as the FC250 test piece, and the semi-molten die casting test piece having a hardness of HRB 87.4 has dramatically more abrasion amount than the FC250 test piece. In other words, it is apparent that the semi-molten die casting test piece having a hardness of HRB 98.0 has about the same "breaking-in" characteristic as the FC250 test piece having a hardness of HRB 100 or higher. This suggests that the abrasion phenomenon depends on not only on the hardness, but also on the base structure. In other words, when the ratio of the pearlite structure constituting the base structure is high, the "breaking-in" characteristic of the molded article is poor, even when the hardness is the same. In this case, hardness that can demonstrate good "breaking-in" characteristics is a hardness that is empirically determined to have an abrasion amount of greater than 5 μm but less than 13 μm. Accordingly, a semi-molten die casting test piece that has a level of hardness greater than HRB 90 but less than HRB 100 has excellent "breaking-in characteristics." This is supported by the "breaking-in" curve of a semi-molten die cast article shown in FIG. 21. It is apparent from FIG. 21 that 100 hours is required for sufficient breaking-in when the hardness is HRB 100 or higher, but "breaking-in" is substantially completed in ten or so hours when the hardness is HRB 100 or less.

(2) Seizing Resistance Test

First, a pin-shaped test piece 412*a* and a disc-shaped test piece 412*b* such as those shown in FIG. 19 were manufactured from a material fabricated by semi-molten die casting, and test pieces 412*a*, 412*b* having different levels of hardness were fabricated by varying the heat treatment conditions of the material fabricated by semi-molten die casting. The test pieces 412*a*, 412*b* were set in a pin/disc test apparatus 401 such as that shown in FIG. 19, and a load (surface pressure) was applied in steps of 15.6 MPa under conditions of an average sliding speed of 2.0 m/s in a liquid mixture 416 composed of ethereal oil (100° C.) and R410A refrigerant stored in a container 410. The point at which the frictional torque, as detected by a torque detector 415, rapidly increased was determined to be the point at which seizing occurs, and the surface pressure at this time was used as the surface pressure at which seizing occurs. The surface pressure in this case was adjusted by using the load applied to the lower-side shaft 411*b*. A mechanical seal 414 was provided between an upper-side rotor shaft 411*a* and the container 410.

Figure 22:
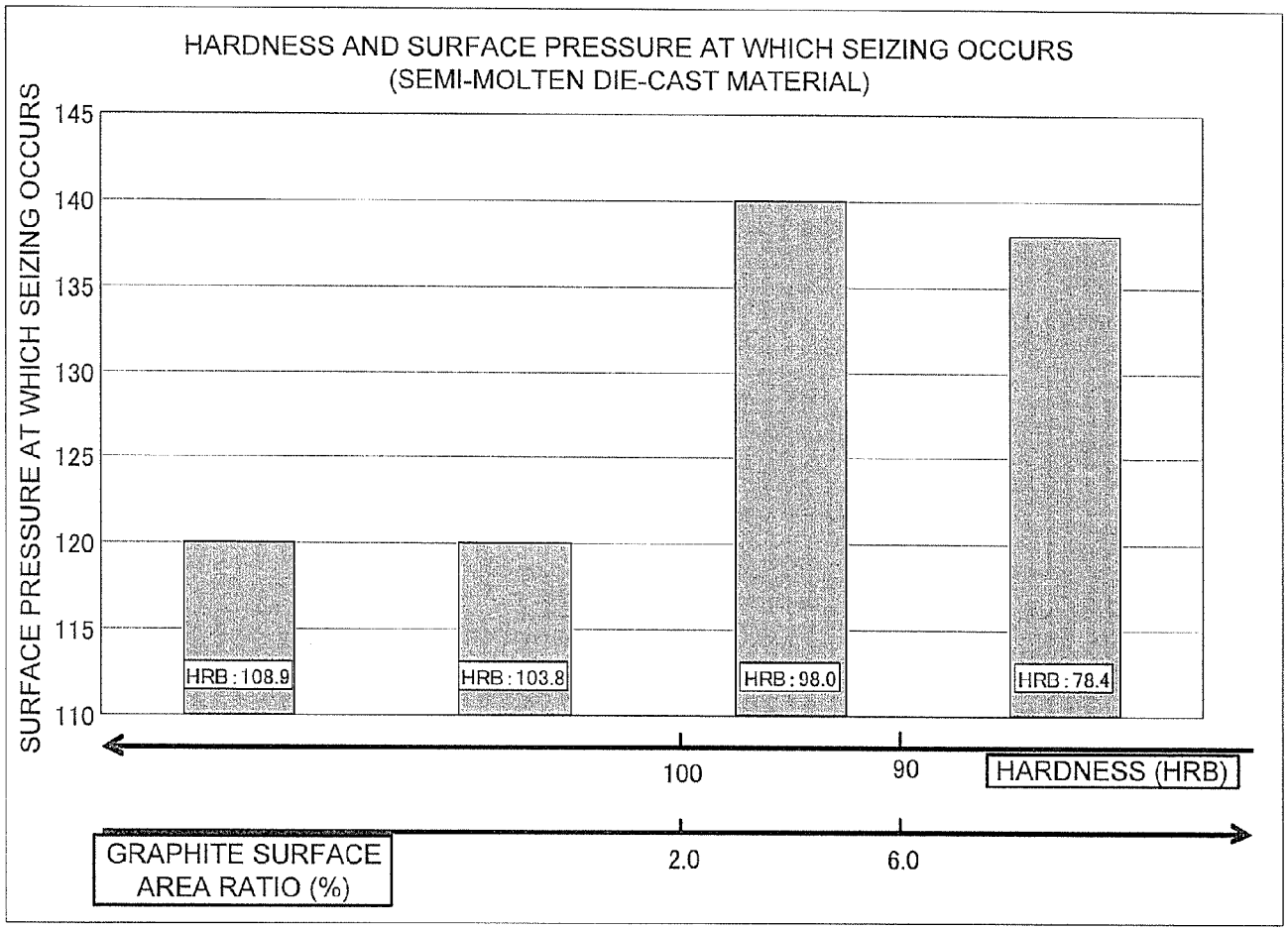
FIG. 22 is a graph showing the relationship between the hardness and the seizing resistance of a molded article manufactured using semi-molten die casting.

The data obtained from this experiment is summarized in the bar graph shown in FIG. 22. The relationship between the surface pressure at which seizing occurs and the hardness of the test pieces manufactured by semi-molten die casting (hereinafter referred to as semi-molten die cast test pieces) is shown in this graph.

It is apparent from FIG. 22 that the surface pressure at which seizing occurs is dramatically reduced when the hardness of the semi-molten die cast test piece is between HRB 98.0 and HRB 103.8. In other words, this shows that seizing more readily occurs when the hardness of the semi-molten die cast molded test piece is HRB 100 or higher. When the movable scroll and fixed scroll are manufactured using semi-molten die casting, the hardness of the movable scroll and the fixed scroll must be less than HRB 100 in order to prevent the movable scroll and the fixed scroll from seizing during abnormal operation of the compressor.

(3) Ductility Test

Figure 23:
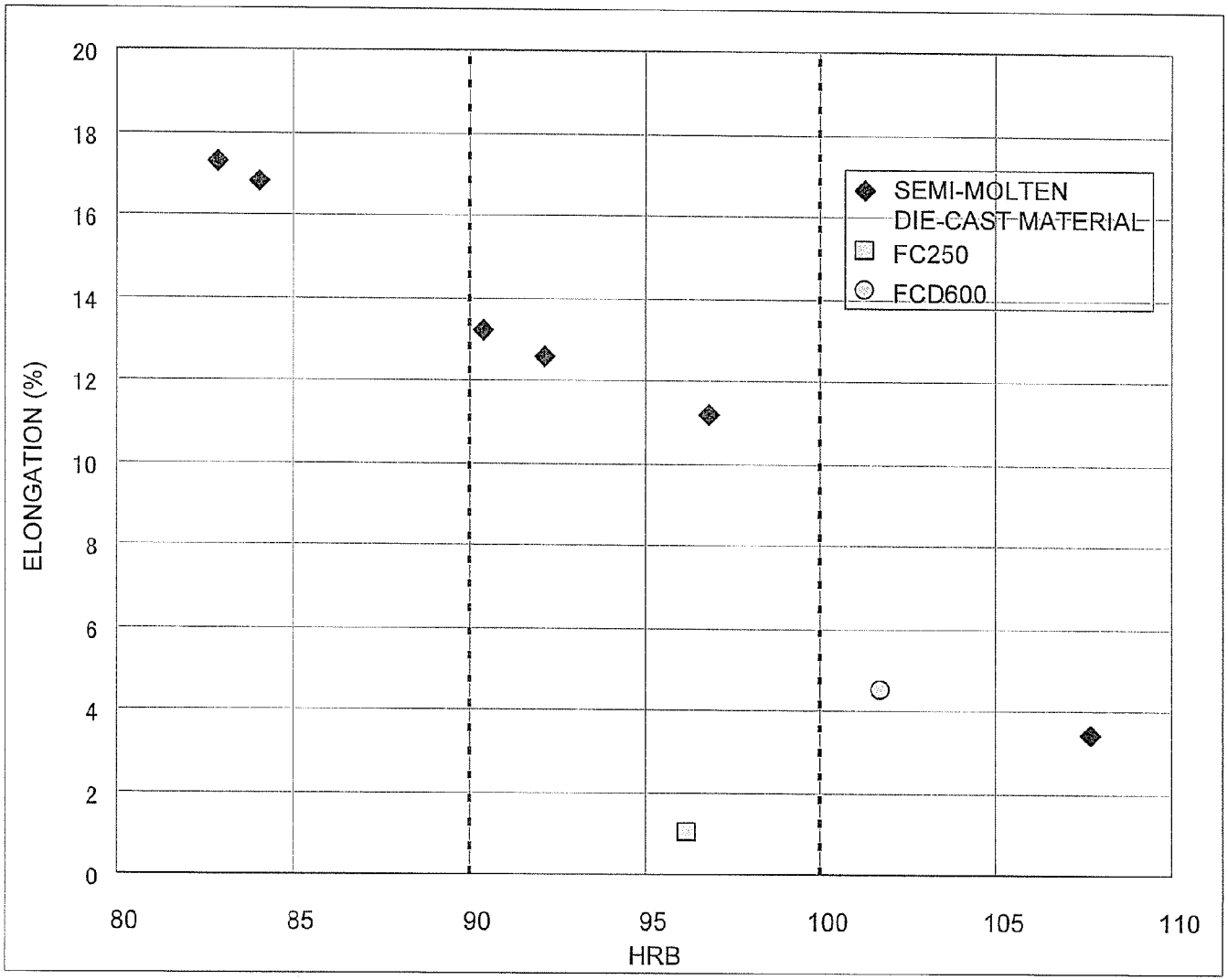
FIG. 23 is a graph showing the relationship between the hardness and the tensile strength of a molded article manufactured using semi-molten die casting.

FIG. 23 shows the relationship between the tensile elongation and the hardness of a molded article manufactured using semi-molten die casting. The tensile elongation was measured in accordance with the test method described in JIS Z2241. In this tensile test, the shape of the test piece was that of test piece #4 or #5 described in JIS Z2201.

It is apparent from FIG. 23 that the elongation and the hardness of a molded article manufactured by semi-molten die casting (hereinafter referred to as a semi-molten die cast article) are in an inverse proportional relationship. When compared with a conventional FC250 or FCD600 molded article (hereinafter referred to as a conventional molded article), it is apparent that the semi-molten die cast article exhibits dramatically higher ductility than a conventional molded article. In the case of a semi-molten die cast article, the fact is that a built-up edge is readily formed during machining, and grinding processability is degraded, when the tensile elongation is 14% or higher; fine scrapings are readily produced in the case that cracking has occurred when the tensile elongation is 8% or lower (possibly due to fluid back-flow (hydraulic compression), which may occur when the semi-molten die cast article is a movable scroll or a fixed scroll); and the effect of preventing such situations cannot be sufficiently provided by improving the ductility. For this reason, the semi-molten die cast article preferably ideally has a tensile elongation that is greater than 8% but less than 14%. Therefore, the hardness of the semi-molten die cast article is ideally greater than HRB 90 but less than HRB 100.

(4) Cutting Test

Figure 24:
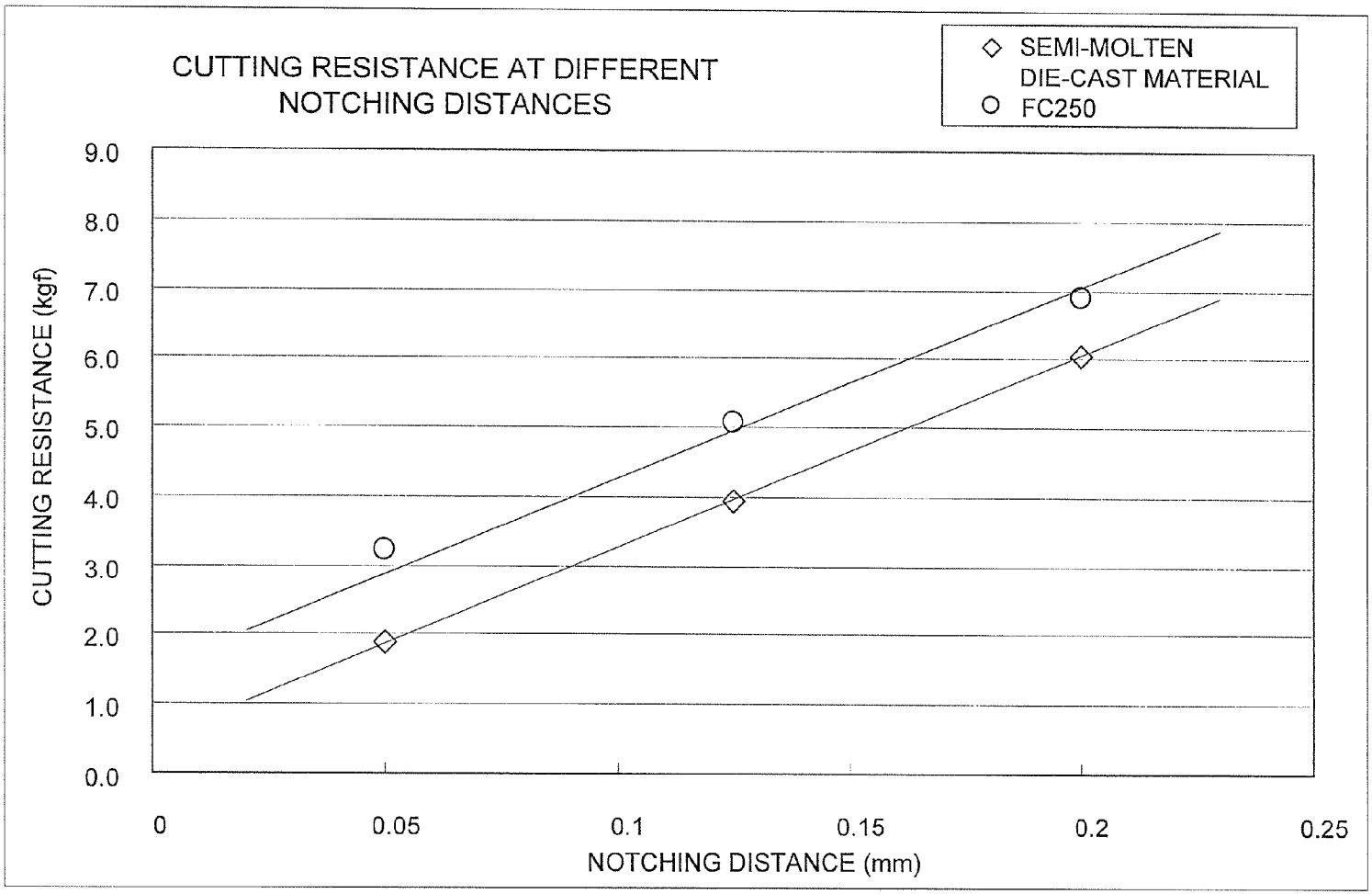
FIG. 24 is a graph showing the relationship between the notching distance and the cutting resistance of a molded article manufactured using semi-molten die casting.

FIG. 24 shows the relationship between the notching distance and the cutting resistance of a molded article manufactured using semi-molten die casting. The cutting test was carried out using a down cut method with the aid of an end mill as a cutting blade under dry conditions at an end mill rotational speed of 6000 rpm and a feed rate of 1800 mm/min-0.05/blade. The hardness of the semi-molten die cast article at this time was HRB 98, and the hardness of the reference FC250 molded article was HRB 101.

It is apparent from FIG. 24 that with a semi-molten die cast article, cutting resistance increases in a proportional fashion as the notching distance increases in the same manner as for an FC250 molded article, but the absolute value is less than that of an FC250 molded article.

(5) Tool Abrasion Test

Figure 25:
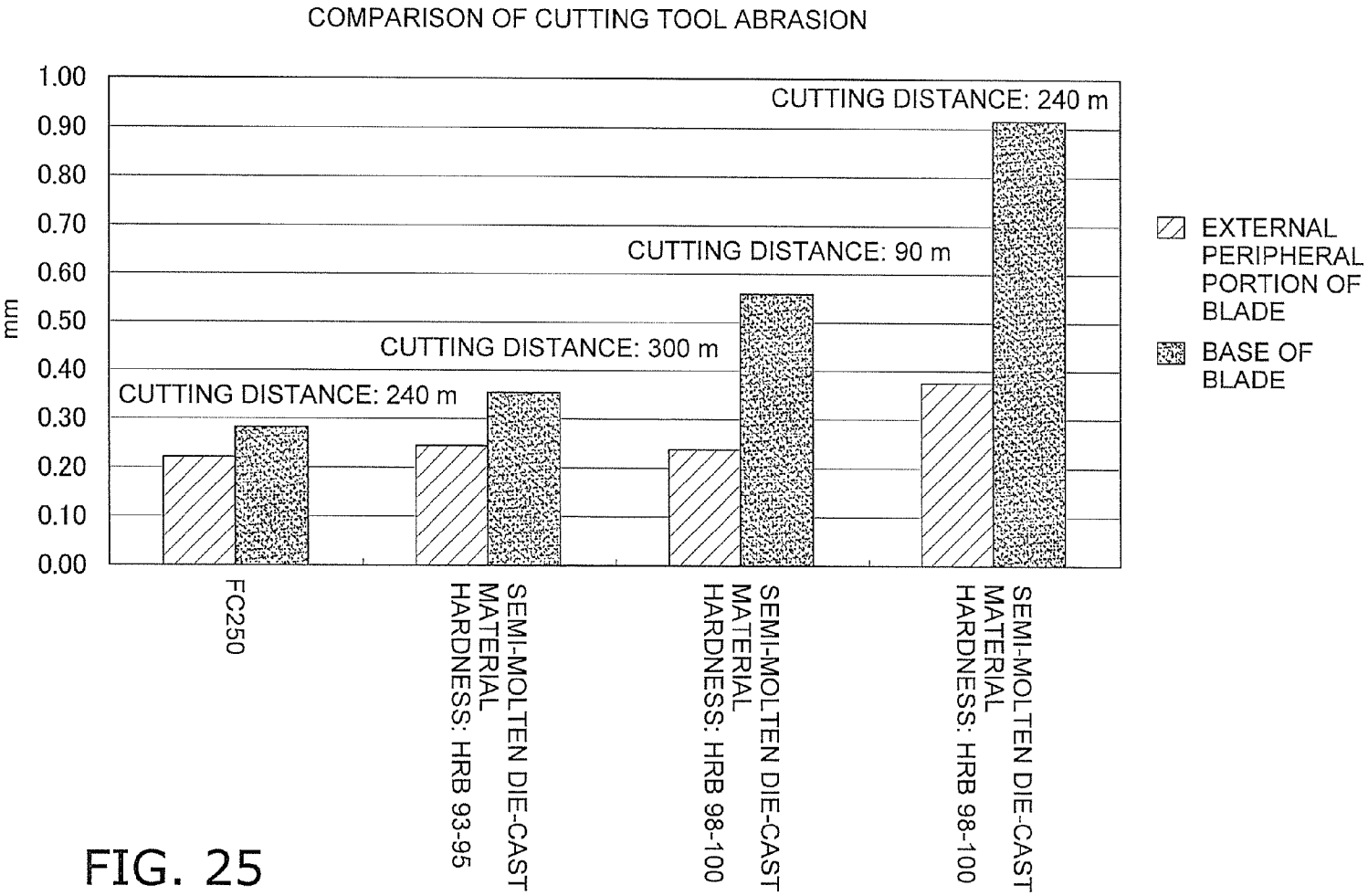
FIG. 25 is a graph showing a comparison of the cutting tool abrasion in relation to a molded article manufactured using semi-molten die casting.

FIG. 25 shows a comparison of the cutting tool abrasion for a molded article manufactured using semi-molten die casting. The tool abrasion test was carried out in the same manner as the cutting test by using a down cut method with the aid of an end mill as a cutting blade under dry conditions at an end mill rotational speed of 8000 rpm and a feed rate of 1920 mm/min-0.04/blade. The data in FIG. 25 is composed of values obtained by rotating a tool to the cutting distance noted above the bars. The hardness of the semi-molten die cast articles at this time was HRB 93 to 95 and HRB 98 to 100, and the hardness of the reference FC250 molded article was HRB 101.

It is apparent from FIG. 25 that when the FC250 molded article and the semi-molten die cast article having a hardness of 93 to 95 are compared, the tool abrasion amount for the two molded articles is substantially the same at the external peripheral portion of the blade and the base of the blade regardless of the fact that the semi-molten die cast article having a hardness of 93 to 95 has a longer cutting distance than the FC250 molded article. Therefore, the semi-molten die cast article having a hardness of 93 to 95 has about the same or better machinability than the FC250 molded article. When a comparison is made between the semi-molten die cast article having a hardness of 93 to 95 and the semi-molten die cast article having a hardness of 98 to 100, the semi-molten die cast article having a hardness of 93 to 95 has a lower abrasion amount at the base of the blade than the semi-molten die cast article having a hardness of 98 to 100 regardless of the fact that the semi-molten die cast article having a hardness of 93 to 95 has a longer cutting distance than the semi-molten die cast article having a hardness of 98 to 100. In other words, the semi-molten die cast article having a hardness of 93 to 95 has dramatically better machinability than the semi-molten die cast article having a hardness of 98 to 100.

Characteristics of the High-Low Pressure Dome-Type Scroll Compressor According to First Embodiment (1)

In the first embodiment, the movable scroll 26 and fixed scroll 24 are manufactured via a semi-molten die casting step and a heat treatment step. Accordingly, a movable scroll and fixed scroll can be readily provided by this manufacturing method with higher tensile strength and hardness than a movable scroll and fixed scroll composed of flake graphite cast iron manufactured using conventional sand casting.

(2)

In the first embodiment, the movable scroll preform and the fixed scroll preform are manufactured via a semi-molten die casting step and a heat treatment step, and the hardness is adjusted to be greater than HRB 90 but less than HRB 100. The tensile strength of the movable scroll preform and the fixed scroll preform substantially corresponds to the range from 600 MPa to 900 Mpa. Accordingly, when this method for manufacturing a compressor slider is adopted, the end plates 24*a*, 26*a* of the movable scroll 26 and the fixed scroll 24, as well as the wraps 24*b*, 26*b*, can be made thinner. Therefore, the scroll compressor 1 can be given a smaller diameter, and, consequently, thrust loss can be reduced and capacity can be increased. Also, the stress generated in the scroll is greater than during normal operation (during full load) when the capacity is controlled during an operation characterized by a high compression ratio, even in a capacity controller based on an unloader piston, but since strength is improved and toughness is enhanced, the possibility that the scroll will be damaged or the like can be reduced. Such a movable scroll 26 and fixed scroll 24 have excellent toughness in comparison with an FC material, and damage is not likely to occur from a sudden increase in internal pressure or the inclusion of foreign matter. Even if damage were to occur, fine scrapings are not likely to be produced and the pipes do not need to be washed. When a movable scroll preform and fixed scroll preform composed of flake graphite cast iron manufactured by sand casting are machined and the final movable scroll and fixed scroll are formed, the movable scroll preform and fixed scroll preform are ordinarily re-gripped a number of times in order to remove distortions produced by machining. However, there in no concern for distortions caused by machining when a movable scroll preform and fixed scroll preform having such a high tensile strength are machined. Therefore, adopting the present manufacturing method allows the cost of re-gripping to be reduced.

(3)

It is apparent that when a slider manufactured by semi-molten die casting is heat treated, the tensile strength of the slider is in a proportional relationship with the hardness of the slider. Therefore, tensile strength can be assured in the slider according to the first embodiment by merely measuring the hardness.

(4)

In the heat treatment step of the first embodiment, the heat treatment is carried out so that the hardness of the movable scroll preform and the fixed scroll preform is greater than HRB 90 but less than HRB 100. For this reason, a movable scroll 26 and fixed scroll 24 that can demonstrate sufficient durability during compressor operation, that readily undergo "breaking-in" as early as possible, and that do not seize during abnormal operation can be manufactured when the method for manufacturing the compressor slider is adopted. When the hardness is in this range, machining of the movable scroll preform and the fixed scroll preform is improved, the movable scroll preform and fixed scroll preform are less likely to be damaged, and handling is facilitated. For this reason, tool abrasion and tool chipping are less likely to occur, tool service life is extended, a built-up edge is less likely to form, the grinding processability is good, machining time can be reduced, and machining costs can therefore be reduced. Regardless the scrolls have superior tool abrasion and machining time because of lower hardness in relation to FCD having the same tensile strength (tensile strength is high at the same level of hardness), it can be said that higher tensile strength can be achieved. Also, the movable scroll 26, the Oldham ring 39, the seal (not shown), and the like are unlikely to be damaged because surface roughness of them is readily reduced in comparison with an FC material.

(5)

In the first embodiment, the fixed scroll 24 is manufactured by molding a metal material by semi-molten die casting using a metal mold 70 having convexities 71*a*, 72*a* in which an opening formation area P can be thinly formed in the vicinity of the center of the preform 124, and thereafter forming a discharge hole 41 in the thin opening formation area P. An opening formation area P of the discharge hole 41 can be formed with the aid of the convexities 71*a*, 72*a* to a thickness of 4 mm or less in the vicinity of the center of the portion that corresponds to the end plate in the preform 124 of the fixed scroll 24. Accordingly, the occurrence of blowholes CN can be reduced in the preform 124 of the fixed scroll 24. Therefore, only small divided blowholes CN are present in the periphery away from the vicinity of the center inside the end plate 24*a* in the fixed scroll 24. As a result, the likelihood that a blowhole CN inside the preform 124 will be exposed to the exterior is eliminated even if a discharge hole 41 is formed in the opening formation area P of the preform 124, and a reduction in fatigue strength can be inhibited.

(6)

In the first embodiment, the movable scroll 26 is manufactured by molding a metal material by semi-molten die casting using a metal mold 80 having a convexity 81*a* in which a prescribed portion can be formed to a thickness of 4 mm or less in the vicinity of the center of the preform 126. Accordingly, the occurrence of blowholes CN in the preform 126 of the movable scroll 26 can be reduced. Therefore, only small divided blowholes CN are present in the periphery away from the vicinity of the center inside the end plate 26*a* in the movable scroll 26.

(7)

Constituent elements having very few defects are adopted in the high-low pressure dome-type scroll compressor 1 of the first embodiment. For this reason, the high-low pressure dome-type compressor 1 can also compress carbon dioxide and other high-pressure refrigerants.

(8)

There are problems in that near-net shaping is difficult and machinability is poor with high-carbon steel and ductile iron as high-strength materials. Therefore, a scroll is often manufactured using FC250 or another ordinary cast iron in a conventional scroll compressor. In contrast, in the high-low pressure dome-type scroll compressor 1 according to the first embodiment, the fixed scroll 24 and movable scroll 26 can endowed with high strength by molding with the aid of semi-molten die casting.

For this reason, capacity can be increased considerably without substantially changing the outside diameter in the compressor 1, as shown in FIG. 18 and other diagrams.

(9)

In comparison with a conventional material such as FC250, an article produced by die casting (referred to herein as semi-molten die casting), in which an iron material in a semi-molten (semi-solid) state is pressed into a mold to manufacture a casting, has high strength even without performing special heat treatment, but tensile strength can be further improved by performing heat treatment that involves holding the article at a prescribed temperature for a prescribed length of time and adjusting the cooling speed.

However, when the tensile strength is increased to a level that is not conventionally used, other problems occur when the ratio (H/T), i.e., ratio of the height (H) to thickness (T) of the wrap, is determined solely from the conventional viewpoint of strength based on whether fatigue damage will occur or not. In other words, when the ratio (H/T) is made excessively high because of the strength, drawbacks occur even if there is no problem in terms of strength. That is, because the deformation of the wraps 24*b*, 26*b* is too great when cutting is performed, the result is that the machining allowance and cutting feeding of end milling or the like cannot be increased and machining time is extended, that the deformation amount (flexing amount) of the wraps 24*b*, 26*b* is increased and performance is reduced during operation of the compressor 1, and that noise is increased by contact with a counterpart scroll. Furthermore, in the case wraps 24*b*, 26*b*, which are shaped in the same manner as the scrolls 24, 26, are existed, distortions tend to appear when strength is considerably increased by heat treatment. When the strength is excessively high, machining speed during cutting is reduced and costs are increased.

In view of the above, in the compressor 1, the ratio of the tensile strength in relation to Young's modulus of the scrolls 24, 26 after heat treatment is determined so that added costs are not incurred due to excessively increasing the strength by heat treatment. This is the result of research to determine the sufficient level of tensile strength from the viewpoint of fatigue strength when the ratio (H/T) of the wrap is determined with consideration given to the upper limit of the deformation amount of the wraps 24*b*, 26*b* that is required from the viewpoint of machining time, lost performance, and noise. Specifically, the ratio of tensile strength to Young's modulus is set to 0.0046 or less, as described above, so as to limit the amount of increased strength by heat treatment.

As described above, in the design of the scrolls 24, 26 in this case, problems during operation, such as a higher level of noise and reduced performance due to flexing of the wraps 24*b*, 26*b*, can be reduced while satisfying strength requirements because a balance has been achieved with the Young's modulus (toughness) without excessive strengthening. Since flexing of the wraps 24*b*, 26*b* during cutting is reduced, manufacturing costs can be reduced by shortening machining time and obtaining other benefits.

As described above, the tensile strength of the scrolls 24, 26 can be set to 1000 MPa or higher depending on the heat treatment, but in this case, the increase in strength by heat treatment is limited.

On the other hand, the tensile strength of the scrolls 24, 26 can be set to about 500 MPa by reducing the cooling speed. Conversely, it is illogical to spend time in heat treatment in order to limit the level of strength, and since drawbacks arise in that abrasion resistance is reduced when the ferrite ratio of the metal structure is increased, heat treatment is carried out so that the ratio of the tensile strength to Young's modulus is 0.0033 or higher in the compressor 1.

(10)

In the first embodiment, the crankshaft 17, the movable scroll 26, the fixed scroll 24, and the Oldham ring 39 are manufactured via a semi-molten die casting step and a heat treatment step. Accordingly, raw material costs, machining costs, and tool abrasion expenses can be kept low in comparison with conventional sand casting, and grinding waste, liquid machining waste, and other types of waste can be reduced. Also, the crankshaft 17, fixed scroll 24, movable scroll 26, and Oldham ring 39 can easily be provided with higher tensile strength and higher hardness than a crankshaft, movable scroll, fixed scroll, and Oldham ring composed of flake graphite cast iron and manufactured by conventional sand casting.

(11)

In the first embodiment, the crankshaft preform, the movable scroll preform, the fixed scroll preform, and the Oldham ring preform were manufacture via a semi-molten die casting step and a heat treatment step, and the hardness of these preforms was adjusted so as to be greater than HRB 90 but less than HRB 100. In this case, the tensile strength of the crankshaft preform, the movable scroll preform, the fixed scroll preform, and the Oldham ring preform substantially corresponds to a range from 600 MPa to 900 MPa. Accordingly, adoption of this method for manufacturing a compressor slider allows the end plates 24*a*, 26*a* of the movable scroll 26 and the fixed scroll 24, as well as the wraps 24*b*, 26*b* (*9), to be made thinner, and the Oldham ring 39 to be made thinner as well. Also, the diameter of the crankshaft 17 can be reduced. Therefore, the diameter of the scroll compressor 1 can be reduced, and the thrust loss can consequently be reduced and capacity increased. Also, the stress generated in the scroll is greater than during normal operation (during full load) when the capacity is controlled during high-compression ratio operation, even in a capacity controller based on an unloader piston, but since strength is improved and toughness is enhanced, the possibility that the scroll will be damaged or the like can be reduced. Such a crankshaft 17, movable scroll 26, fixed scroll 24, and Oldham ring 39 have excellent toughness in comparison with an FC material, and damage is not likely to occur from a sudden pressure increase due to the inclusion of foreign matter. Even if damage were to occur, fine scrapings are not likely to be produced and the pipes do not need to be washed. When a crankshaft preform, a movable scroll preform, a fixed scroll preform, and an Oldham ring preform composed of flake graphite cast iron and manufactured by sand casting are machined and the final crankshaft 17, movable scroll 26, fixed scroll 24, and the Oldham ring 39 are formed, the crankshaft preform, the movable scroll preform, the fixed scroll preform, and the Oldham ring preform are ordinarily re-gripped a number of times in order to remove distortions produced by machining. However, there in no concern for distortions caused by machining when a crankshaft preform, a movable scroll preform, a fixed scroll preform, and an Oldham ring preform having such a high tensile strength are machined. Therefore, adopting the present manufacturing method allows the cost of re-gripping to be reduced.

(12)

It is apparent that when a slider manufactured by semi-molten die casting is heat treated, the tensile strength of the slider is in a proportional relationship with the hardness of the slider. Therefore, tensile strength can be assured in the slider according to the first embodiment by merely measuring the hardness.

(13)

In the heat treatment step of the first embodiment, heat treatment is carried out so that the hardness of the crankshaft preform, the movable scroll preform, the fixed scroll preform, and the Oldham ring preform is greater than HRB 90 but less than HRB 100. For this reason, a crankshaft 17, a movable scroll 26, a fixed scroll 24, and an Oldham ring 39 that can demonstrate sufficient durability during compressor operation, that readily undergo "breaking-in" as early as possible, and that do not seize during abnormal operation can be manufactured when this method for manufacturing the compressor slider is adopted. When the hardness is in this range, machining of the crankshaft preform, the movable scroll preform, the fixed scroll preform, and the Oldham ring preform is improved; the crankshaft preform, the movable scroll preform, the fixed scroll preform, and the Oldham ring preform are less likely to be damaged; and handling is facilitated. For this reason, tool abrasion and tool chipping are less likely to occur, tool service life is extended, a built-up edge is less likely to form, the grinding processability is good, machining time can be reduced, and machining costs can therefore be reduced. It should also be noted that Regardless the scrolls have superior tool abrasion and machining time because of lower hardness in relation to FCD having the same tensile strength (tensile strength is high at the same level of hardness), it can be said that higher tensile strength can be achieved. Also, the movable scroll 26 is unlikely to damage the Oldham ring 39, the seal (not shown), and the like because surface roughness of them can be more readily obtained in comparison with an FC material.

(14)

In the partial heat treatment step of the first embodiment, a stress concentration area (peripheral portion SC1 of the base of the wrap 24*b* and the innermost portion SC2 of the wrap 24*b*) of the fixed scroll 24 is subjected to partial heat treatment. Accordingly, sufficient fatigue strength can be imparted to the stress concentration area in the fixed scroll 24 while the slider, which requires slidability, retains good "breaking-in" characteristics.

(15)

In the partial heat treatment step of the first embodiment, the stress concentration area (peripheral portion SC3 of the base of the wrap 26*b*, the notched portion SC5 formed in the vicinity of the design center of the end plate 26*a*, the peripheral portion SC4 of the base of the bearing portion 26*c*, and the innermost portion SC6 of the wrap 26*b*) of the movable scroll 26 is subjected to partial heat treatment. Accordingly, sufficient fatigue strength can be imparted to the stress concentration area in the movable scroll 26 while the slider, which requires slidability, retains good "breaking-in" characteristics.

(16)

In the partial heat treatment step of the first embodiment, the eccentric shaft portion 17*a* and the main shaft portion 17*b* of the crankshaft 17 are subjected to high-frequency heating treatment. Accordingly, the eccentric shaft portion 17*a* and the main shaft portion 17*b* can be endowed with sufficient abrasion resistance. Therefore, the service life of the crankshaft 17 can be extended.

(17)

In the partial heat treatment step of the first embodiment, the peripheral portion SC7 of the notched portion that is present between the eccentric shaft portion 17*a* and the main shaft portion 17*b* of the crankshaft 17 is subjected to laser heating treatment. Accordingly, the stress concentration portion of the crankshaft 17 can be endowed with sufficient fatigue strength.

(18)

In the semi-molten die casting of the first embodiment, the balance weight portion 17*c* is integrally formed with the crankshaft 17. Accordingly, a separate ring portion or the like as a balance weight is not required. Therefore, material costs associated with a balance weight can be reduced. Also, in the manufacture of a balance weight, the balance weight is cored to a rough shape and then a machining step was required to adjust or otherwise modify the balance, but the crankshaft 17 according to the present invention is manufactured by semi-molten die casting. Therefore, material can be molded to a shape that is very approximate to the final shape, and the number of steps for manufacturing a compressor can be reduced. Therefore, the compressor crankshaft 17 can contribute to a reduction in the costs to manufacture a compressor.

(19)

In the partial heat treatment step of the first embodiment, the movable scroll-side key portions 39*a*, 39*b* and the housing-side key portions 39*c*, 39*d* of the Oldham ring 39 are subjected to high-frequency heating treatment. Accordingly, the movable scroll-side key portions 39*a*, 39*b* and the housing-side key portions 39*c*, 39*d* can be endowed with sufficient abrasion resistance. Therefore, the service life of the Oldham ring 39 can be extended.

Modified Example of First Embodiment (A)

An airtight high-low pressure dome-type scroll compressor 1 was adopted in the first embodiment, but the compressor may be a high-pressure dome-type compressor or a low-pressure dome-type compressor. The compressor may also be a semi-airtight or open compressor.

(B)

A scroll compression mechanism 15 was used in the scroll compressor 1 according to the first embodiment, but the compression mechanism may be a rotary compression mechanism, a reciprocating compression mechanism, a screw compression mechanism, or the like. The scroll compression mechanism 15 may be a double-toothed or co-rotation-type scroll.

(C)

In the first embodiment, a billet was used in which the following components were added: C: 2.3 to 2.4 wt %, Si: 1.95 to 2.05 wt %, Mn: 0.6 to 0.7 wt %, P: <0.035 wt %, S: <0.04 wt %, Cr: 0.00 to 0.50 wt %, Ni: 0.50 to 1.00 wt %. The elemental ratio of the iron material may be arbitrarily determined as long as the ratio does not depart from the spirit of the present invention.

(D)

In the first embodiment, an Oldham ring 39 was used as the rotation-preventing mechanism, but a pin, a ball coupling, a crank, or any other mechanism may be used as the rotation-preventing mechanism.

(E)

In the first embodiment, an example was given of the case in which the scroll compressor 1 was used in a refrigerant circuit, but the application is not limited to air conditioning, and can also be made to a compressor used alone or incorporated into a system, or to a blower, a supercharger, a pump, or the like.

(F)

A lubricating oil is present in the compressor 1 according to the first embodiment, but an oilless or oil-free (which may or may not contain oil) compressor, blower, supercharger, or pump may also be used.

(G)

The high-low pressure dome-type scroll compressor 1 according to the first embodiment was an outer drive-type scroll compressor, but the scroll compressor according to the present embodiment may be an inner drive-type scroll compressor. Also, in such a case, the pin shaft portion for the inner drive of the movable scroll may be selectively heated by high-frequency heating or another method after the heat treatment step, and the surface hardness of the pin shaft portion may be set to be greater than HRC 50 but less than HRC 65. In this manner, the abrasion resistance of the pin shaft portion of the inner drive can be considerably improved.

(H)

In the first embodiment, the slider preform was formed into a final slider via a final finishing step, but the finishing step may be omitted in the case that near-net shaping to a substantially completed article is possible in the semi-molten die casting step.

(I)

In the heat treatment step of the first embodiment, the entire slider preform was heat treated, but when the slider preform is the movable scroll 26 or the fixed scroll 24, the hardness may be set to be greater than HRB 90 but less than HRB 100 for only the distal ends of the wraps 24*b*, 26*b* and the surface (thrust surface) portion of the end plate side, which are important locations in terms of seizing resistance, abrasion resistance, and "breaking-in" characteristics. The ferrite surface area ratio may be set to be greater than 5% but less than 50%, and the graphite surface area ratio may be set to be greater than 2% but less than 6%.

(J)

Figure 26:
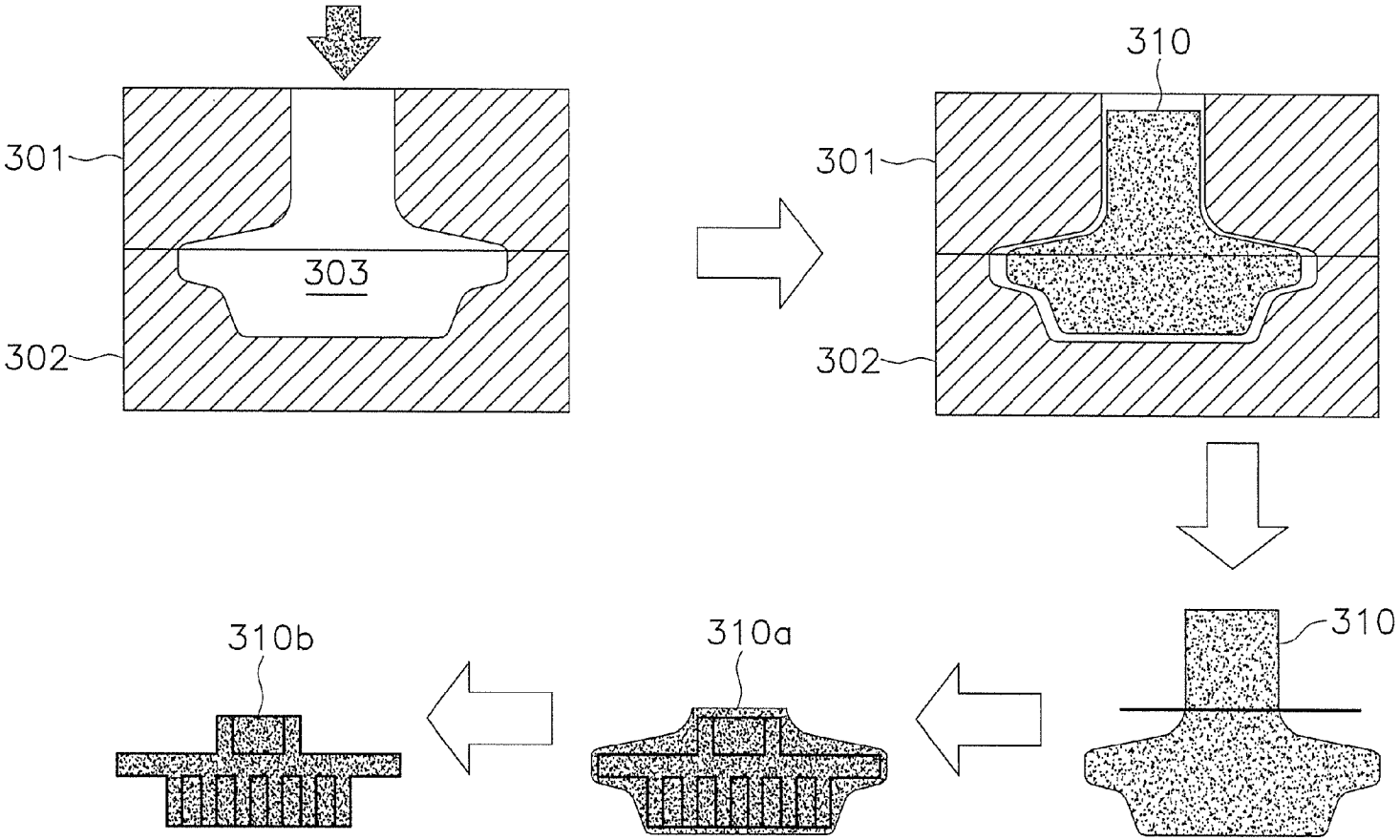
FIG. 26 is a simple process chart of the metal-mold casting step according to a modified example (J) of the first embodiment.

The slider according to the first embodiment was manufactured via a semi-molten die casting step, a heat treatment step, a finishing step, and a partial heat treatment step, but such a slider may be manufactured via a metal-mold casting molding step, a heat treatment step, a finishing step, and a partial heat treatment step. The raw materials may be the same. In the metal-mold casting step, a raw material liquefied by high-temperature heating is poured into a cast mold space 303 formed by a fixed mold 302 and a movable mold 301, as shown in FIG. 26. Thereafter, the liquid raw material inside the cast mold space 303 is rapidly cooled via the fixed mold 302 and the movable mold 301. At this point, the liquid raw material inside the cast mold space 303 solidifies to become a solid molded material 310. In this case, die molded material 310 undergoes heat contraction. For this reason, the molded material 310 can be readily released from the mold. The unnecessary portions of the solid molded material 310 are thereafter cut away (hereinbelow, the cut molded material 310 is referred to as a preform material 310*a*. Next, the preform material 310*a* is heat treated in the heat treatment step, and the hardness of the material is adjusted to be greater than HRB 90 but less than HRB 100. At this point, the target hardness may be set to a range of HRB 90 to HRB 95. In the final finishing step, the preform material 310*a* that has undergone the heat treatment step is finely machined to form a final product 310*b*. In the present modified example, the heat treatment step and the final finishing step are carried out in the same manner as the heat treatment step and the final finishing step according to the first embodiment.

(K)

Figure 10:
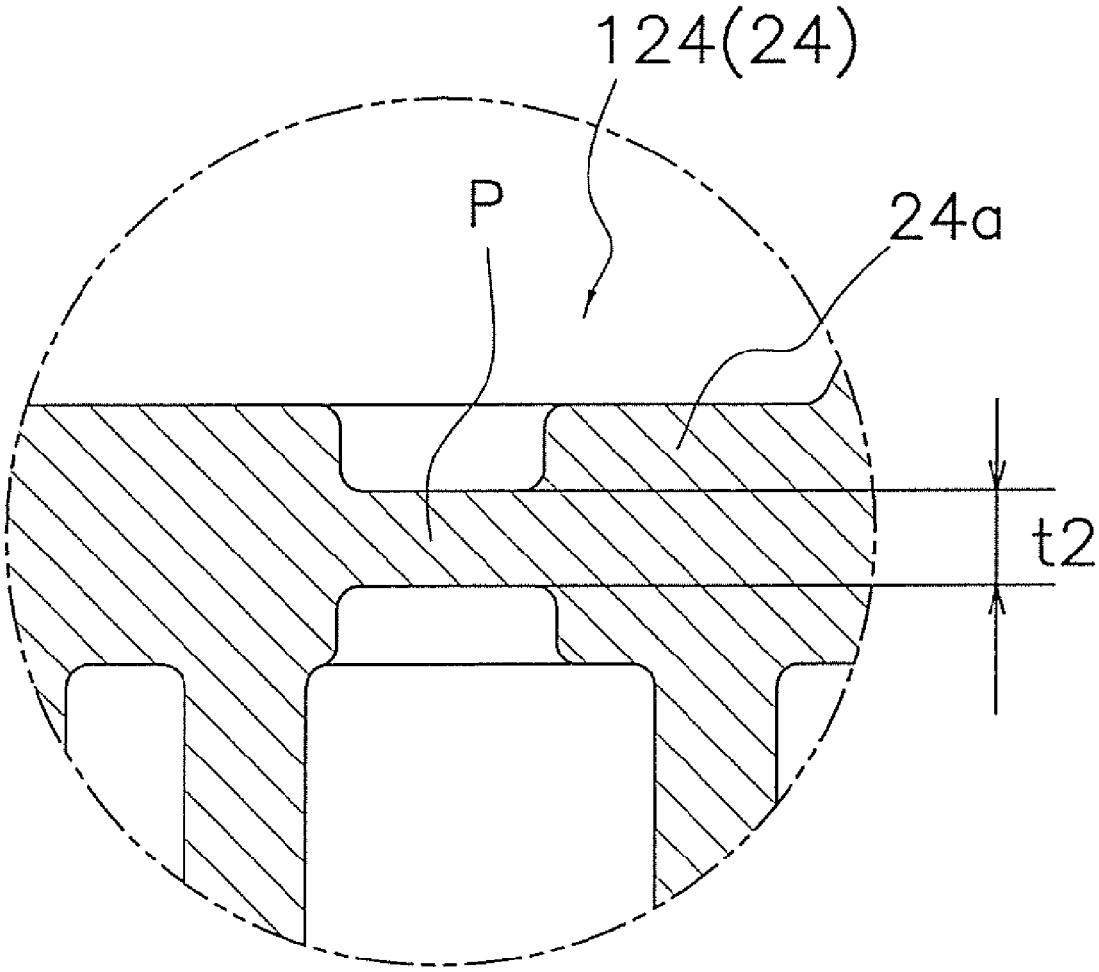
FIG. 10 is an enlarged view of the opening formation area of the preform of the fixed scroll incorporated in a high-low pressure dome-type scroll compressor according to the first embodiment.

In the first embodiment, mutually facing convexities 71*a* and 72*a* form concavities from the two sides, above and below, in the end plate 24*a* to reduce the thickness of the end plate 24*a*, as shown in FIGS. 9 and 10, when the preform 124 of the fixed scroll 24 is molded. However, the present invention is not limited thereby.

Figure 27:
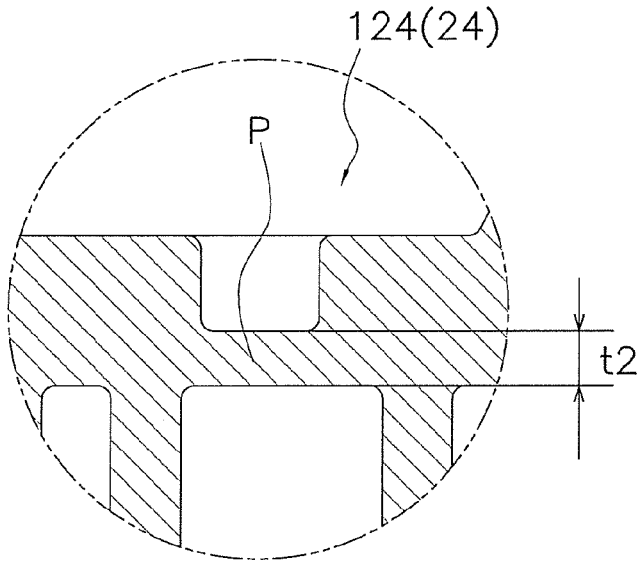
FIG. 27 is an enlarged view of the opening formation area of the fixed scroll preform according to a modified example (K) of the first embodiment.
Figure 28:
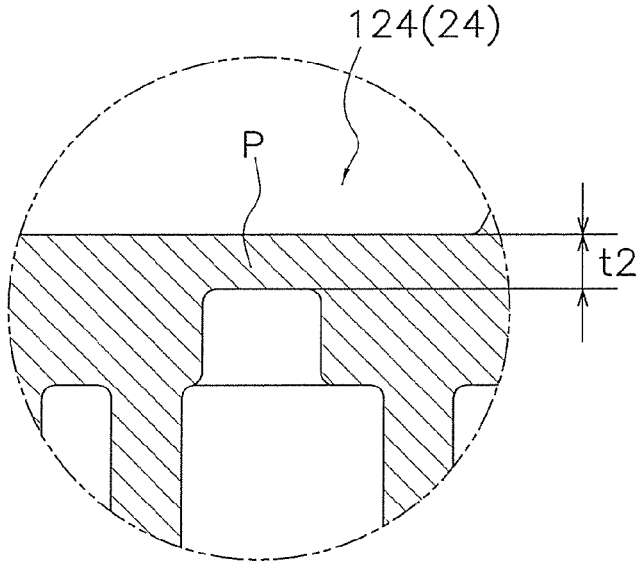
FIG. 28 is an enlarged view of the opening formation area of the fixed scroll preform according to a modified example (K) of the first embodiment.

As a modified example of the first embodiment, the portion corresponding to the end plate may be depressed only from the top side, as shown in FIG. 27, for example. The portion corresponding to the end plate portion may be depressed only from the bottom side, as shown in FIG. 28, whereby the portion corresponding to the end plate may be molded so as be have a prescribed thickness t2 (e.g., 4 mm or less). Either of these cases reduces the occurrence of blowholes CN in the same manner as in the first embodiment.

(L)

Figure 12:
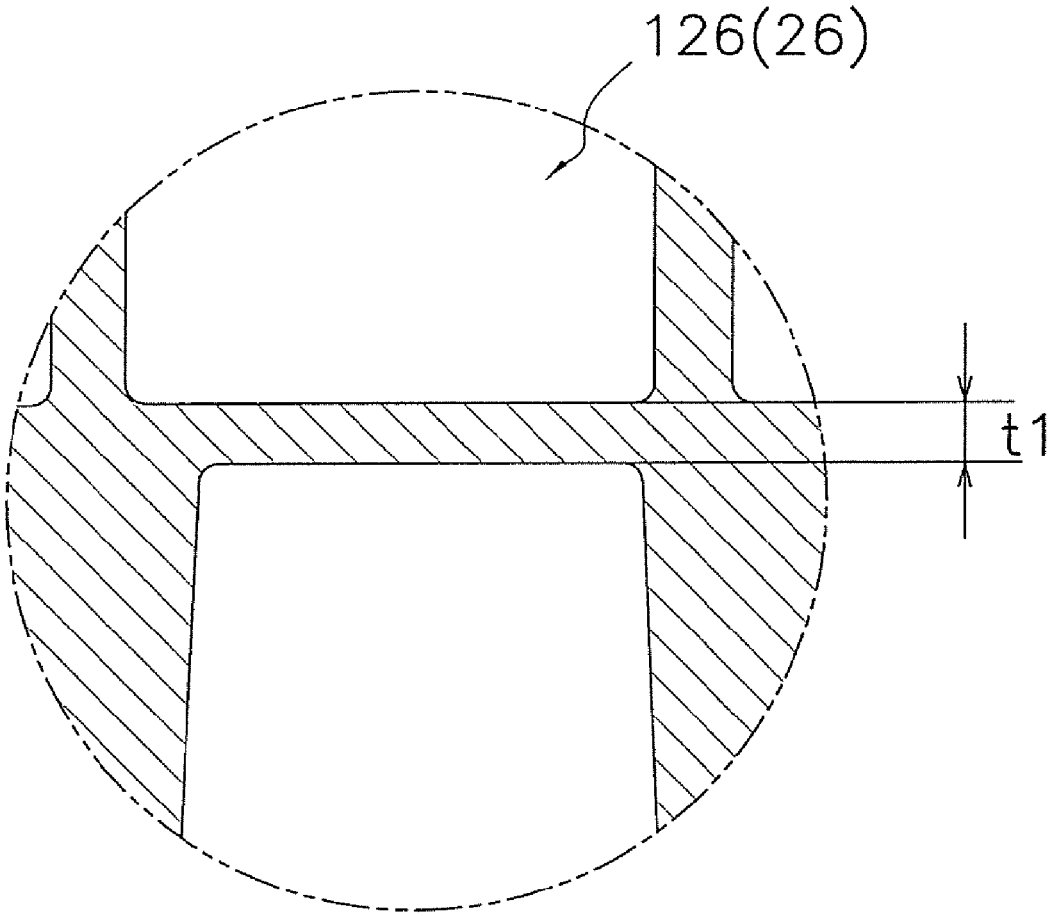
FIG. 12 is an enlarged view of the center portion of a preform of a movable scroll incorporated in a high-low pressure dome-type scroll compressor according to the first embodiment.

In the first embodiment, a space between a second mold portion 82 and a convexity 81*a* in which an internal space 26*f* of the bearing portion 26*c* is formed is set to a prescribed distance (e.g., 4 mm or less) when the preform 126 of the movable scroll 26 is molded, as shown in FIGS. 11 and 12, whereby the thickness t1 in the center portion of the portion corresponding to the end plate is brought via the molding process to a prescribed level (e.g., 4 mm or less). However, the present invention is not limited thereby.

Figure 29:
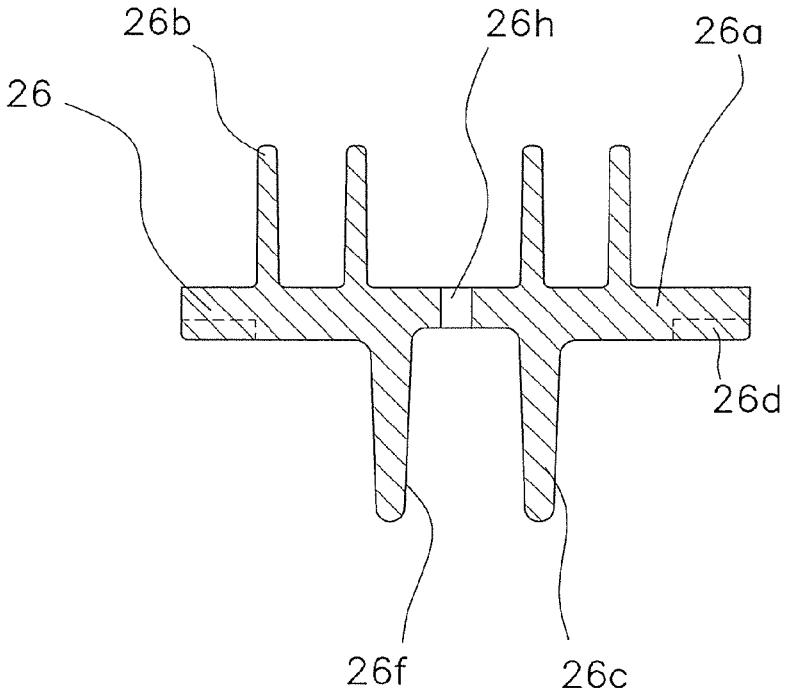
FIG. 29 is a cross-sectional view of the movable scroll according to a modified example (L) of the first embodiment.

As a modified example of the first embodiment, it is also possible to consider a case in which, e.g., a discharge hole 26*h* is formed in the end plate 26*a* of the movable scroll 26, as shown in FIG. 29, instead of a discharge hole 41 being in the fixed scroll 24. When the movable scroll 26 having such a discharge hole 26*h* is manufactured, convexities that face each other are provided to the first mold portion 81 and the second mold portion 82 of the metal mold 80 (see FIG. 11) for manufacturing the preform 126 of the movable scroll 26, in the same manner as the metal mold 70 for manufacturing the preform 124 of the fixed scroll 24. Semi-molten die casting can be carried out using a metal mold 80 having such opposing convexities. By molding in such a manner, the preform 126 of the movable scroll 26 having a thin opening formation area R is formed in the vicinity of the center of the portion corresponding to the end plate such as those shown in FIGS. 30 and 31. In this case, the occurrence of blowholes CN is reduced and the likelihood that a blowhole CN inside the preform 126 will be exposed to the exterior is eliminated when a discharge hole is formed in the opening formation area R by drilling.

Figure 30:
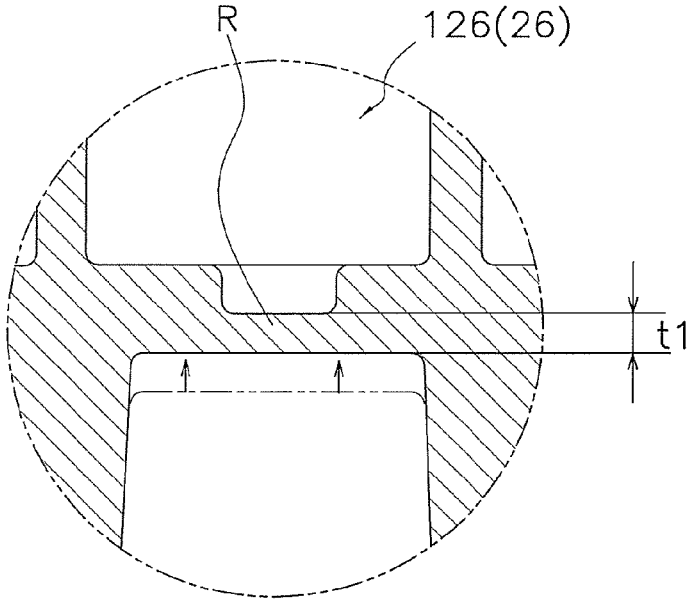
FIG. 30 is an enlarged view of the opening formation area of the movable scroll according to a modified example (L) of the first embodiment.

Here, in the case of the preform 126 of the movable scroll 26 in FIG. 30, the opening formation area R is made thinner by depressing the portion corresponding to the end plate from above and setting the height of the bottom of the internal space 26*f* of the bearing portion 26*c* to be slightly higher than that of the existing movable scroll in the lower side of the portion that corresponds to the end plate. The occurrence of blowholes CN can thereby be reduced.

Figure 31:
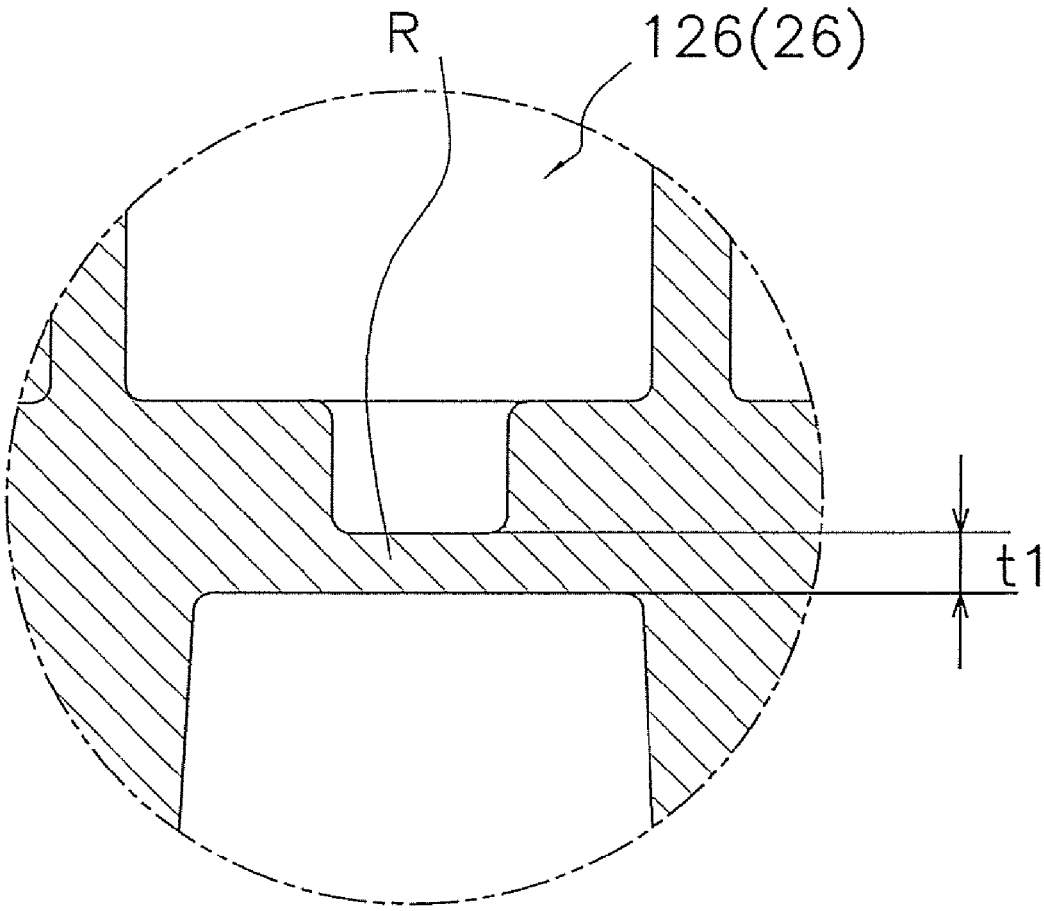
FIG. 31 is an enlarged view of the opening formation area of the movable scroll according to a modified example (L) of the first embodiment.

In the case of the preform 126 of the movable scroll 26 of FIG. 31, the height of the bottom of the internal space 26*f* is set to be about the same as that of the existing movable scroll, and the opening formation area R is made thinner by enlarging the concavity of the portion corresponding to the end plate from above. The occurrence of blowholes CN can thereby be reduced.

(M)

A notched portion SC5 was formed by an end mill or the like in the movable scroll 26 according to the first embodiment, but a notched portion (counterbore) SC5 may be also formed in advance in the semi-molten die casting step in the upper surface of the center portion of the end plate 26*a* of the movable scroll 26 shown in FIGS. 4 and 5.

In such a case, the notched portion (counterbore) SC5 and the internal space 26*f* of the bearing portion 26*c* are formed at the same time, the thickness of the center portion of the portion corresponding to the end plate is made thinner, and the occurrence of blowholes CN is further reduced.

Also, labor can be reduced and shavings are not produced because the notched portion (counterbore) SC5 is not required to be formed by cutting with an end mill or the like after semi-molten die casting, in the same manner as in the method for manufacturing the movable scroll 26 according to the first embodiment.

(N)

In the first embodiment, an iron material was used as the raw material of the slider, but a metal material other than iron may be used as long as the material does not depart from the spirit of the present invention.

(O)

Figure 32B:
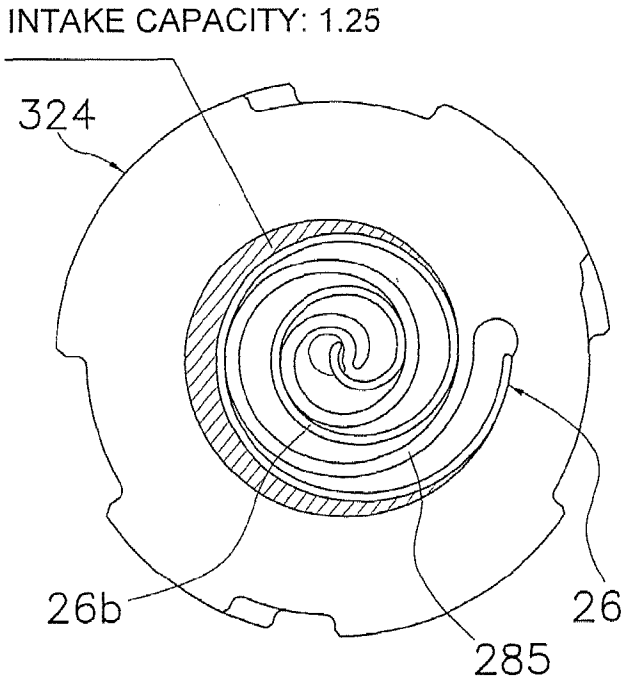
FIG. 32(*a*) is a diagram showing the intake capacity formed by a conventional scroll.
Figure 32A:
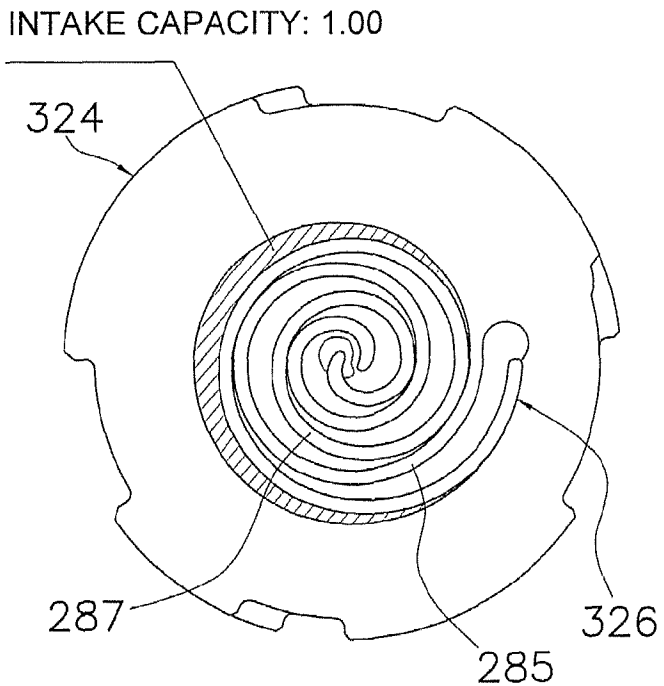
(Prior Art) FIG. 32(a)

In the first embodiment, the suction capacity is increased by a factor of about 1.5 using the fixed scroll 24 and movable scroll 26 in which the wraps 24*b*, 26*b* having a thickness T that is less than a conventional fixed scroll 324 and movable scroll 326 are adopted, as shown in FIG. 18(*b*). However, it is also possible to reduce the thickness of the wrap of only one of the scrolls. For example, in the case that the movable scroll 26 of the first embodiment and the conventional fixed scroll 324 are combined, the suction capacity can be increased by about 1.25 times higher than conventionally possible, as shown in FIG. 32(*b*).

Second Embodiment

A compressor in which the slider according to a second embodiment is used will be described using a high-low pressure dome-type scroll compressor as an example. The high-low pressure dome-type scroll compressor of the second embodiment is one in which the outer drive-type movable scroll 26 of the high-low pressure dome-type scroll compressor 1 of the first embodiment is substituted with an inner drive-type movable scroll. Therefore, only the movable scroll will be described below.

(Configuration of the Movable Scroll)

Figure 33:
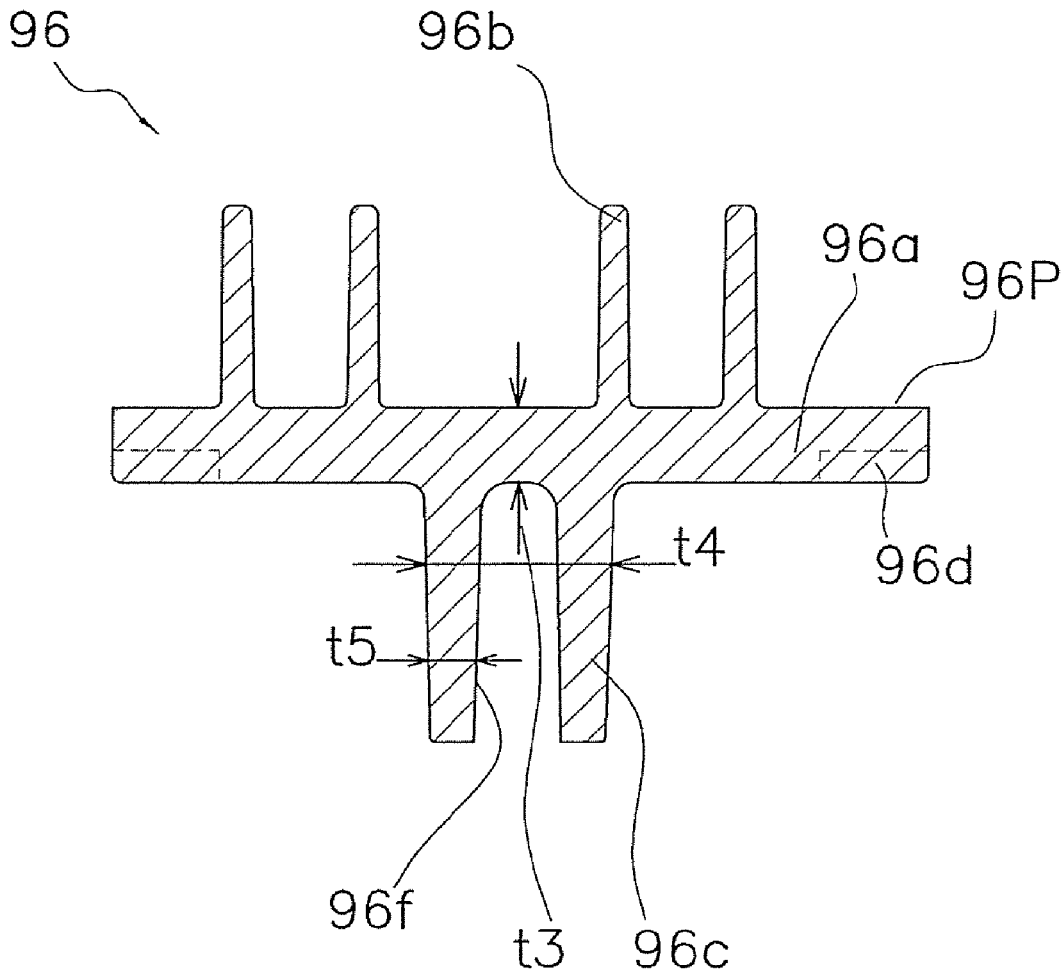
FIG. 33 is a cross-sectional view of an inner drive-type movable scroll according to the second embodiment.

The movable scroll 96 is primarily composed of an end plate 96*a*, a scroll (involute shape) wrap 96*b* that extends upward from the end surface 96P of the end plate 96*a*, a bearing portion 96*c* that extends downward from the lower surface of the end plate 96*a*, and a groove portion 96*d* formed in the two ends of the end plate 96*a*, as shown in FIG. 33.

The movable scroll 96 is an inner drive-type movable scroll. In other words, the movable scroll 96 has a bearing portion 96*c* that fits inside a concave portion formed in the distal end of the crankshaft 17.

The vicinity of the center of the end plate 96*a* is formed to a thickness t3 that is less than the thickness of the other portions (e.g., the portion near the periphery of the end plate 96*a*), as shown in FIG. 33. In other words, a cored concave portion 96*f* cored during semi-molten die casting is formed inside the bearing portion 96*c*. Therefore, the occurrence of blowholes CN (see FIG. 34) in the portion corresponding to the end plate in the preform 196 is reduced. The thickness t3 in the vicinity of the center of the portion corresponding to the bearing unit is set to 4 mm or less in the preform 196.

The thickness of the bearing portion 96*c* is such that the thickness t4 would increase considerably without the cored concave portion 96*f*, and blowholes CN would more readily occur inside the bearing portion 96*c*. The thickness t5 of the bearing portion 96*c* is reduced because of the presence of the cored concave portion 96*f*. Therefore, the occurrence of blowholes CN inside the bearing portion 96*c* is reduced and a reduction in the strength of the bearing portion 96*c* limited. The thickness t5 of the bearing portion 96*c* is set to 4 mm or less.

(Molding of the Movable Scroll)

Figure 34:
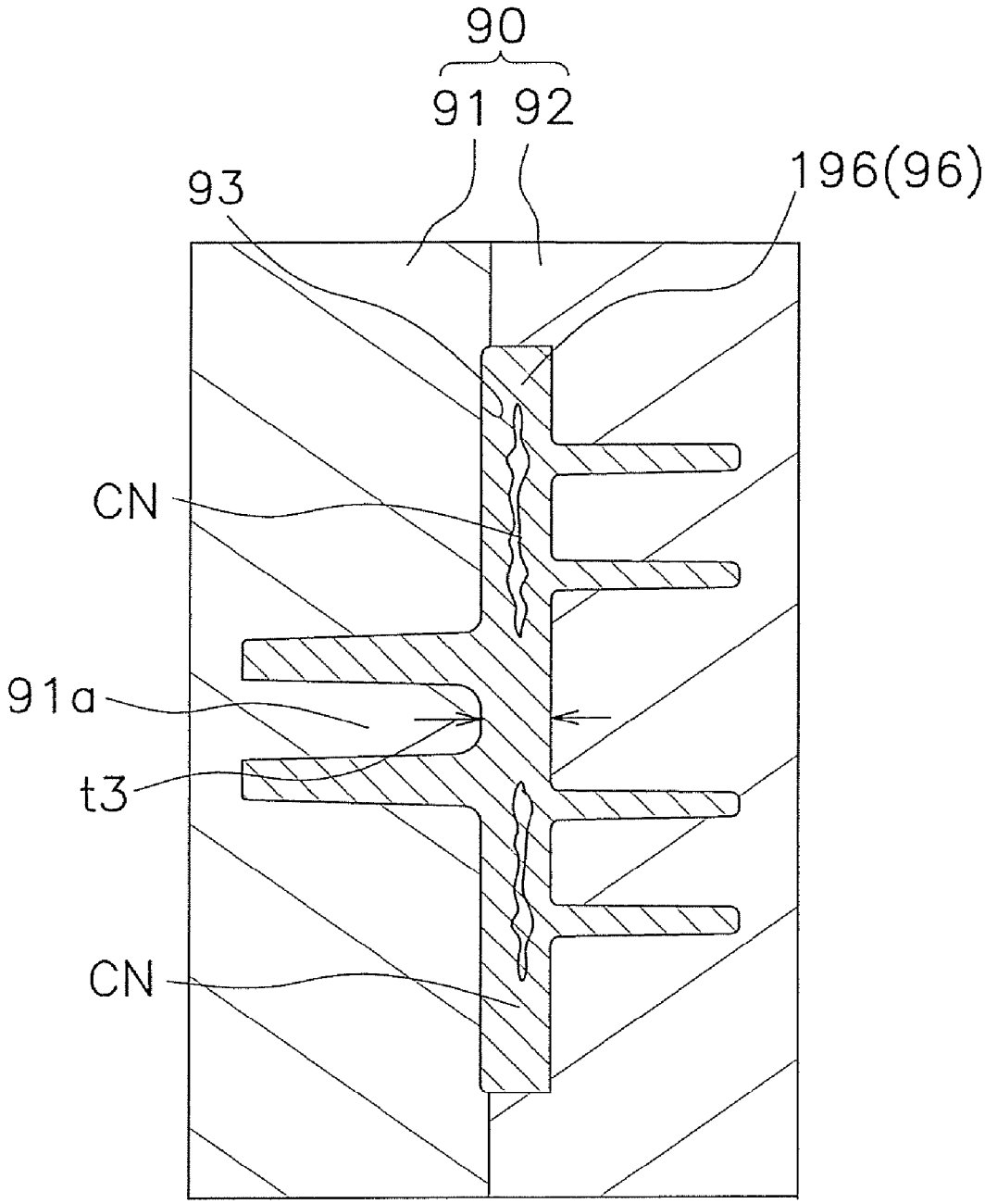
FIG. 34 is a cross-sectional view showing the metal-mold for manufacturing the movable scroll according to the second embodiment, and the movable scroll preform molded by semi-molten die casting.

A mold 90 for the semi-molten die casting of the preform 196 of the movable scroll 96 is composed of a first mold portion 91 and a second mold portion 92, as shown in FIG. 34. The shape of a space portion 93 that is formed when the first mold portion 91 and the second mold portion 92 are combined corresponds to the shape of the external appearance of the preform 196 of the movable scroll 96 to be molded.

A convexity 91*a* for forming a cored concave portion 96*f* of the bearing portion 96*c* of the movable scroll 96 is formed in the first mold portion 91. The spacing between the convexity 91*a* and the second mold portion 92 is set to 4 mm or less. Therefore, the thickness t3 in the center portion 96*e* of the end plate 96*a* is reduced to 4 mm or less.

A preform 196 of the movable scroll 96 having a thickness t3 in the center portion of the portion that corresponds to the end plate of 4 mm or less can be manufactured by the semi-molten die casting of iron or another metal material using the mold 90 configured in the manner described above.

Characteristics of the High-Low Pressure Dome-Type Scroll Compressor According to Second Embodiment (1)

In the second embodiment, a cored concave portion 96*f* is formed in at least a portion of the interior of a bearing portion 96*c* with the aid of a concave portion 91*a* of a mold 90 when a preform 196 of a movable scroll 96 is formed by semi-molten die casting, and a center portion of the portion that corresponds to the end plate of the preform 196 of the movable scroll 96 is thereby formed to be 4 mm or less. As a result, the occurrence of blowholes CN in the movable scroll 96 is reduced.

The cored concave portion 96*f* is formed in the bearing portion 96*c* of the movable scroll 96, whereby the weight of the movable scroll 96 can be considerably reduced and the movable scroll 96 can be made more lightweight.

(2)

In the second embodiment, the cored concave portion 96*f* is formed in the portion corresponding to the bearing portion of the preform 196 of the movable scroll 96, whereby the portion that corresponds to the bearing portion is formed to be 4 mm or less. As a result, the occurrence of blowholes CN in the bearing portion 96*c* is reduced, and degradation in strength of the bearing portion 96*c* is also reduced.

Third Embodiment

A compressor in which the slider according to a third embodiment is used will be described below using a high-low pressure dome-type scroll compressor as an example. The difference between the high-low pressure dome-type compressor of the third embodiment and the high-low pressure dome-type scroll compressor of the first embodiment is the shape of the wrap of the fixed scroll and the movable scroll. Therefore, only the fixed scroll and the movable scroll will be described below.

Figure 35:
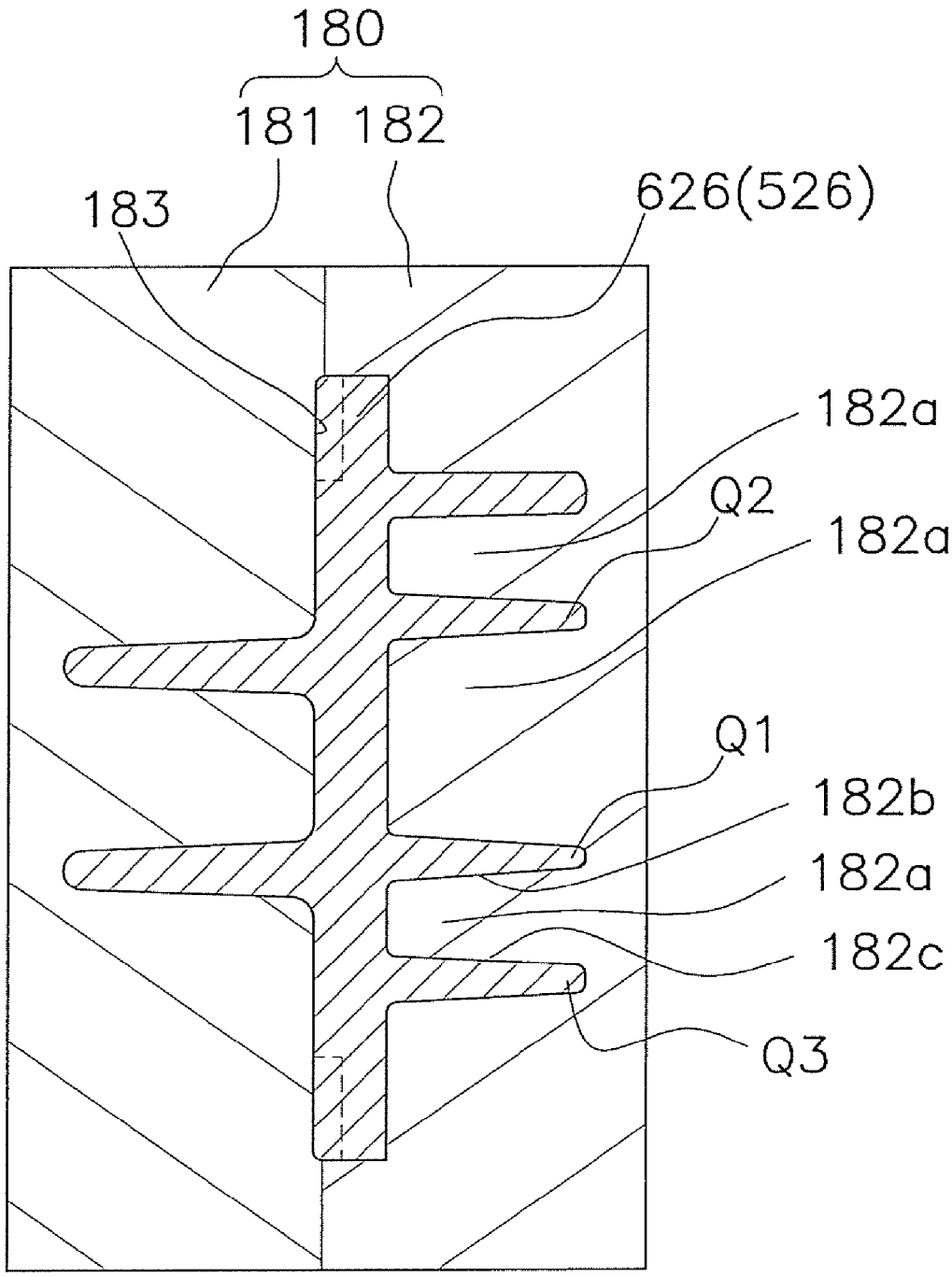
FIG. 35 is a cross-sectional view of the metal-mold for manufacturing the movable scroll incorporated in a high-low pressure dome-type scroll compressor according to the third embodiment, and the movable scroll molded by semi-molten die casting.

A preform 626 of the movable scroll 526 according to the third embodiment is formed by semi-molten die casting using a mold 180 shown in FIG. 35, for example.

A specific description is provided below.

The mold 180 for semi-molten die casting the preform 626 of the movable scroll 526 is composed of a first mold portion 181 and a second mold portion 182, as shown in FIG. 35. The shape of a space portion 183 that is formed when the first mold portion 181 and the second mold portion 182 are combined together corresponds to the shape of the external appearance of the preform 626 of the movable scroll 526 to be molded.

The mold 180 is provided with a wrap mold portion 182*a*. The wrap mold portion 182*a* has an external shape that is set so that the draft angle of the portion Q0 where winding starts near the center of the wrap-corresponding portion of the preform 626 of the movable scroll 526 is greater than the draft angle of the portion Q4 where winding ends at the outer side (see draft angles θ1, θ2 of the movable scroll 26 of the FIG. 36).

Figure 36:
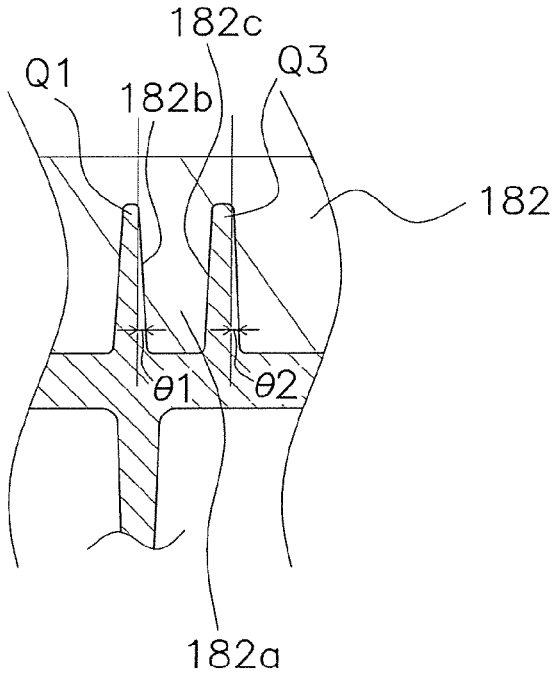
FIG. 36 is an enlarged view of the wrap mold portion of a metal-mold for manufacturing the movable scroll incorporated in a high-low pressure dome-type scroll compressor according to the third embodiment.

The side surface 182*b* and the side surface 182*c* of the wrap mold portion 182*a* have a portion Q1 that is nearer to the center than the portion Q3 between the portion Q1 and portion Q3 of the wrap-corresponding portion, as shown in FIGS. 35 and 36, for example. Therefore, the draft angle θ1 of the portion Q1 is set so as to be greater than the draft angle θ3 of the portion Q3 on the outer side.

The preform 626 is made into the movable scroll 526 via a finishing step. The shape of the wrap of the movable scroll 526 is described below.

Figure 37:
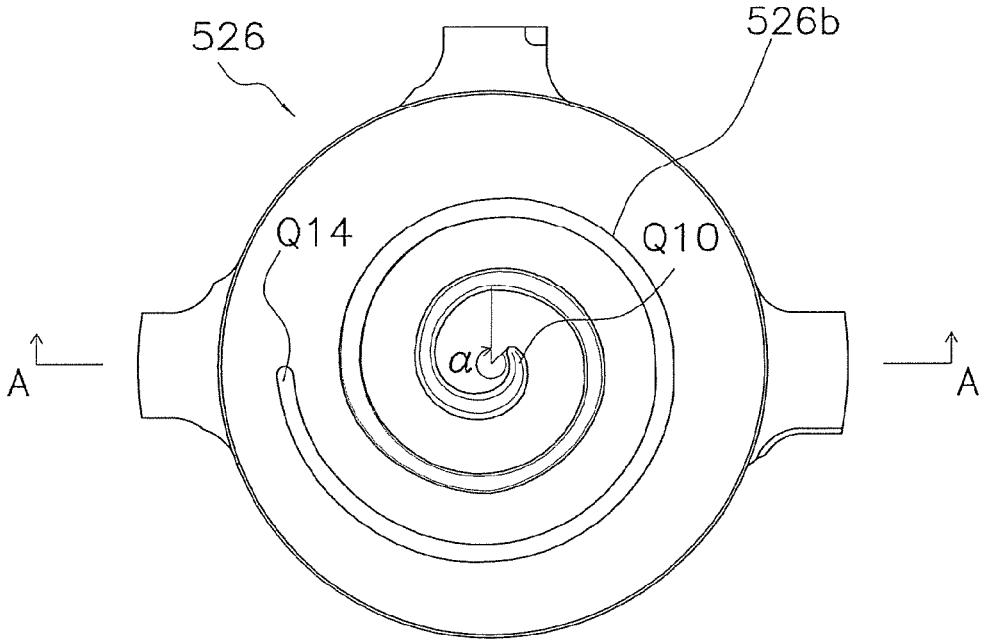
FIG. 37 is a top view of the movable scroll incorporated in a high-low pressure dome-type scroll compressor according to the third embodiment.
Figure 38:
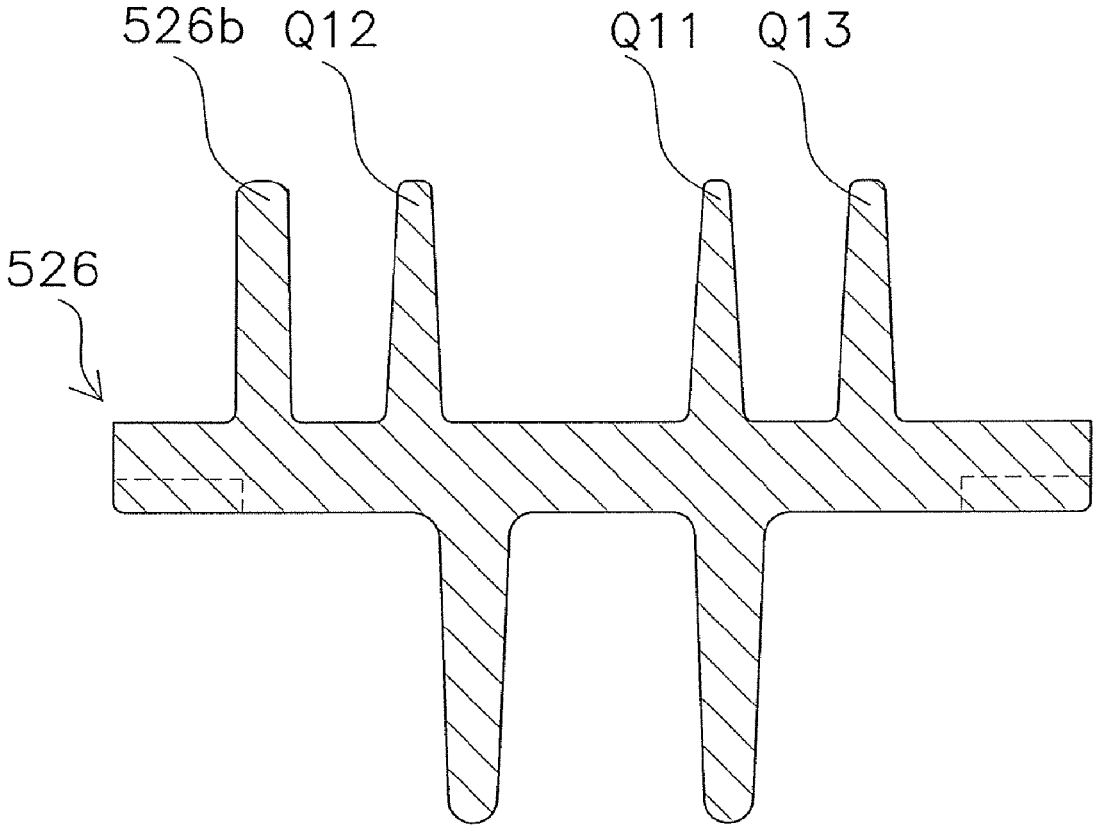
FIG. 38 is a cross-sectional view along the line A-A of the movable scroll incorporated in a high-low pressure dome-type scroll compressor according to the third embodiment.
Figure 39:
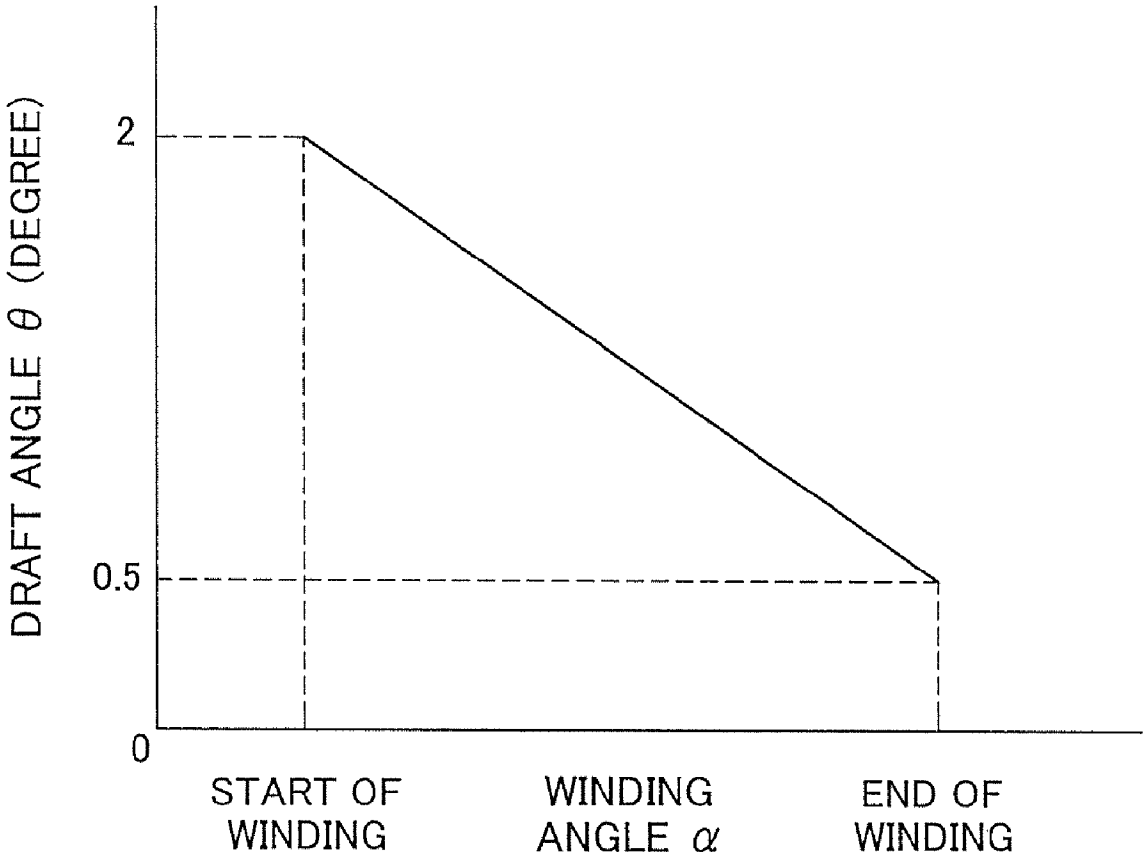
FIG. 39 is a graph showing the relationship between the winding angle $\alpha$ and the draft angle $\theta$ of the movable scroll incorporated in a high-low pressure dome-type scroll compressor according to the third embodiment.

In the movable scroll 526, the shape of the scroll of the wrap 526*b* has a draft angle in the portion Q10 where winding starts near the center. This angle is greater than the draft angle of the portion Q14 where winding ends at the outer side, as shown in FIGS. 37 and 38, and the draft angle from where winding starts to where winding ends is set so as to gradually and continuously change. Specifically, the portion Q10 of the wrap 526*b* where winding starts is set to be a maximum draft angle (e.g., 2 degrees), the draft angle in the intermediate portions (Q11 to Q13) is set so as to continuously decrease as the winding angle α changes, and the draft angle of the portion Q14 where winding ends is set to the minimum angle (e.g., 0.5 degree). In other words, the relationship between the winding angle α and the draft angle θ of the wrap is set so that the draft angle θ has the maximum value of 2 degrees when the winding angle α is the angle where winding starts, the draft angle θ decreases in proportion to the increase the winding angle α, and the draft angle θ has the minimum value of 0.5 degree when the winding angle α is the angle where winding ends, as shown in the graph of FIG. 39. The fixed scroll 524 is manufactured in the same manner as the movable scroll 526. The shape of the wrap of the movable scroll after the finishing step is described below.

Figure 40:
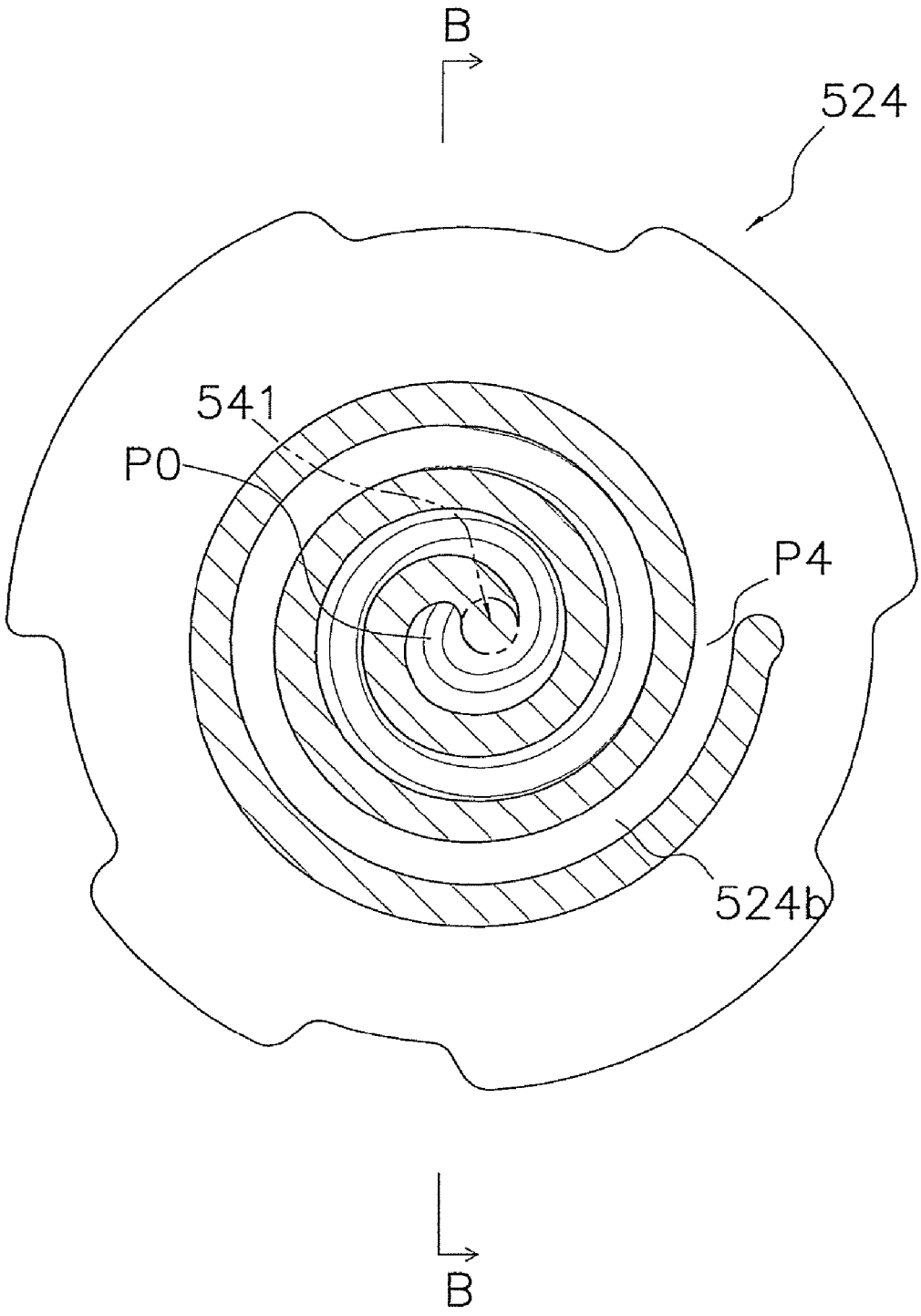
FIG. 40 is a bottom view of the fixed scroll incorporated in a high-low pressure dome-type scroll compressor of the third embodiment.
Figure 41:
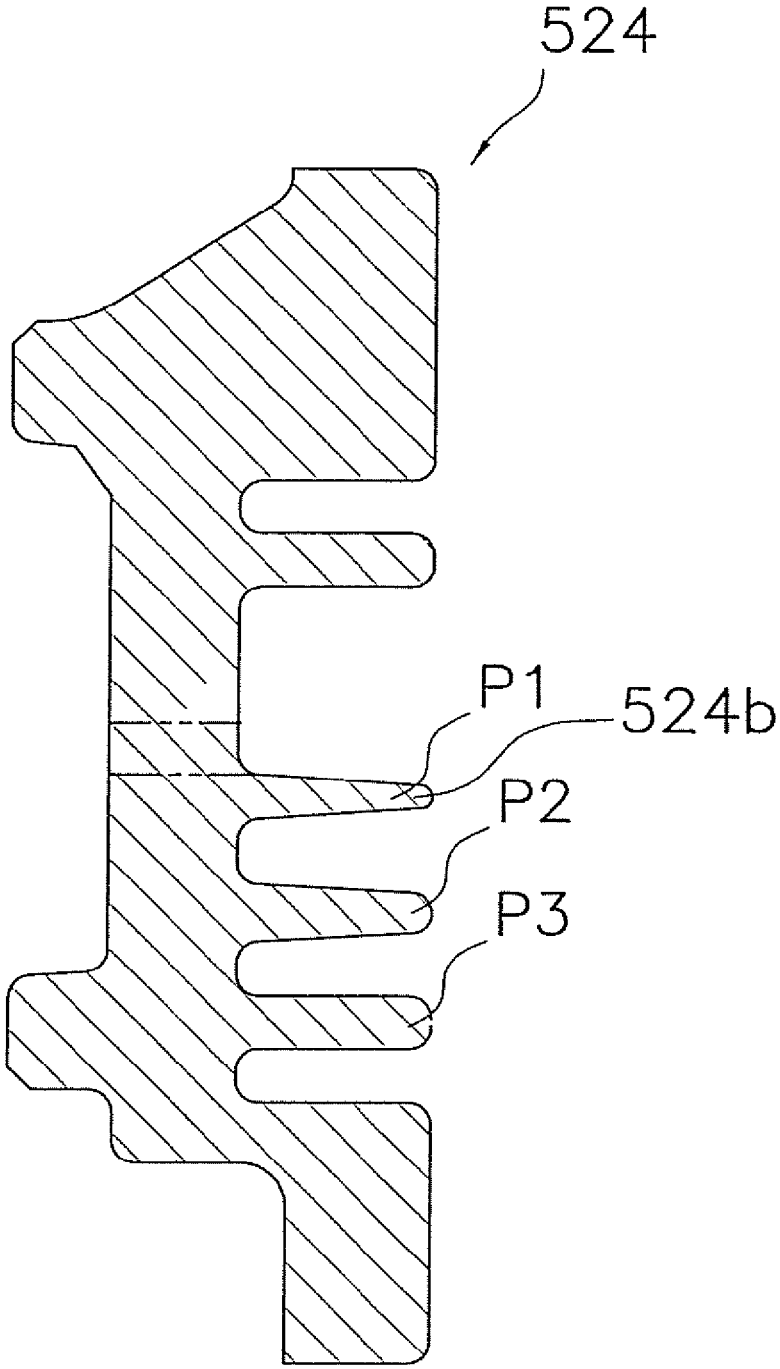
FIG. 41 is a cross-sectional view along the line B-B of the fixed scroll incorporated in a high-low pressure dome-type scroll compressor according to the third embodiment.

In the fixed scroll 524, the shape of the scroll of the wrap 524*b* has a draft angle in the portion P0 where winding starts near the center. The draft angle is greater than the draft angle of the portion P4 where winding ends at the outer side, as shown in FIGS. 40 and 41, and the draft angle from where winding starts to where winding ends is set so as to gradually and continuously change. Specifically, the portion P0 of the wrap 524*b* where winding starts is set to be a maximum draft angle (e.g., 2 degrees), the draft angle in the intermediate portions (P1 to P3) is set so as to continuously decrease as the winding angle α changes, and the draft angle of the portion P4 where winding ends is set to the minimum angle (e.g., 0.5 degree). In other words, the relationship between the winding angle α and the draft angle θ of the wrap is set so that the draft angle θ has the maximum value of 2 degrees when the winding angle α is the angle where winding starts, the draft angle θ decreases in proportion to the increase the winding angle α, and the draft angle θ has the minimum value of 0.5 degree when the winding angle α is the angle where winding ends, as shown in the graph of FIG. 39.

Characteristics of the High-Low Pressure Dome-Type Scroll Compressor According to Third Embodiment (1)

In the preform 626 of the movable scroll 526 according to the third embodiment, the draft angle in relation to the mold in the wrap-corresponding portion varies in accordance with the winding angle of the wrap-corresponding portion according to the present invention. Therefore, the shape of the wrap is determined in accordance with strength and quality, and wasted material can be eliminated.

(2)

In the preform 626 of the movable scroll 526 in the third embodiment, the scroll shape of the wrap-corresponding portion is set so that the draft angle in the portion Q0 where winding starts near the center of the wrap-corresponding portion is greater than the draft angle of the portion Q4 where winding ends at the outer side, and so that the draft angle gradually and continuously changes from where winding starts in the center of the wrap-corresponding portion to the location where winding ends. Therefore, the stress applied to the mold in the vicinity of the center of the scroll during mold release is reduced when the preform 626 of the movable scroll 526 is molded by semi-molten die casting. As a result, normal cracking can be reduced and the service life of the mold can be extended. Therefore, the mold costs can be reduced and manufacturing costs of the fixed scroll 24 and movable scroll 26 can be curtailed in association therewith.

(3)

In the third embodiment, the draft angle in the portion Q0 where winding starts near the center of the wrap-corresponding portion of the preform 626 of the movable scroll 526 is greater than the draft angle of the portion Q4 where winding ends at the outer side. For this reason, the adverse effect on the near-net shaping of the wrap overall (i.e., molding approximate to the final shape) can be reduced even if the draft angle in the center portion of the wrap-corresponding portion is increased.

In other words, when the draft angle for the entire wrap-corresponding portion is increased, the stress applied to the mold in the wrap-corresponding portion overall is reduced during mold release, but the adverse effect on near-net shaping is increased. However, in the third embodiment, the adverse effect on the near-net shaping is reduced by increasing the draft angle in the vicinity of the center of the wrap-corresponding portion to be greater than the draft angle of the portion where winding ends at the outer side.

Modified Example of Third Embodiment (A)

Figure 42:
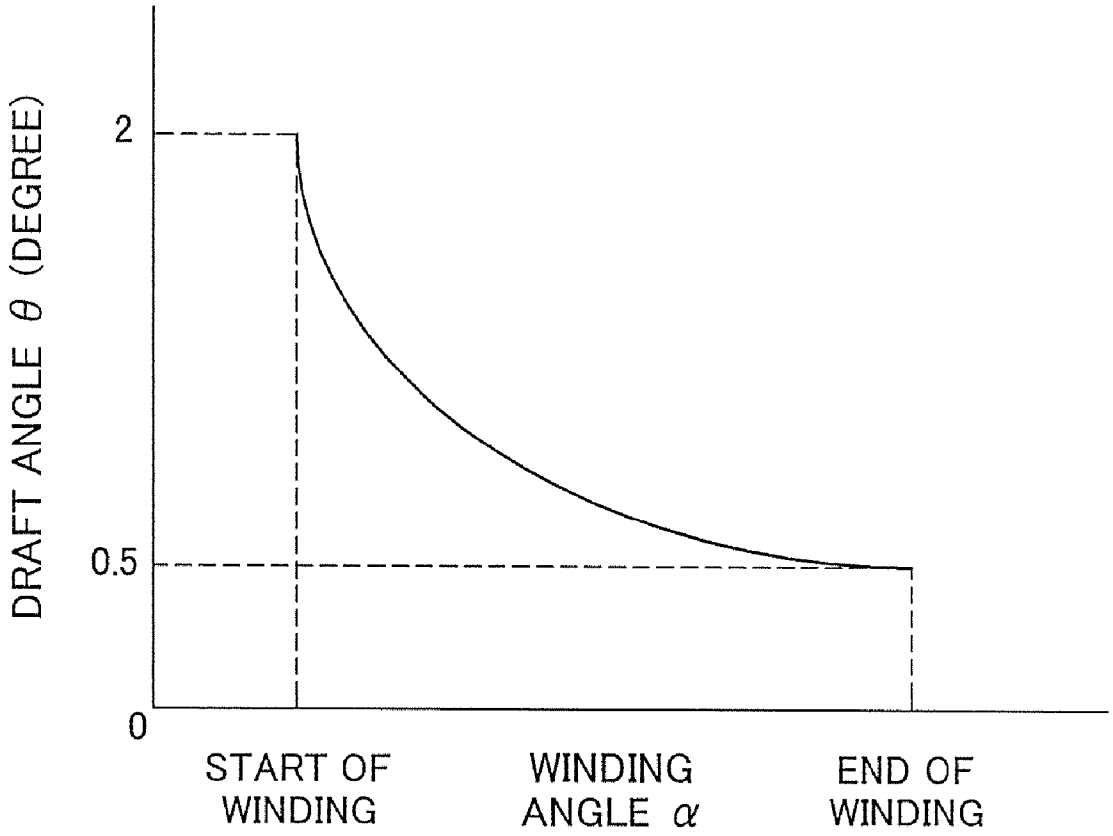
FIG. 42 is a graph showing the relationship between the winding angle $\alpha$ and the draft angle $\theta$ of the movable scroll according to a modified example (A) of the third embodiment.

In the preform 626 of the movable scroll 526 according to the third embodiment, the draft angle is set so as to gradually and continuously change from where winding starts in the center of the wrap-corresponding portion to the location where winding ends, but the present invention is not limited to this configuration. The change in the draft angle θ in relation to the winding angle α of the wrap-corresponding portion may be set so that the rate of decrease in the draft angle θ is greater in a range near where winding starts, as shown in the graph of FIG. 42, and so that the rate of decrease of the draft angle θ is reduced in a range near where winding ends (the maximum value of the draft angle θ is 2 degrees, and the minimum value is 0.5 degree). In this case as well, stress applied to the mold in the vicinity of the center of the scroll is reduced during mold release, and the service life of the mold is extended when the preform 626 of the movable scroll 526 is molded by semi-molten die casting.

In the case of the change in the draft angle θ in relation to the winding angle α of the wrap-corresponding portion shown in the graph of FIG. 42, the draft angle θ is set to be a low angle in portions other than the portions where winding starts and winding ends, in comparison with the case of the graph of FIG. 39 (change in which the draft angle θ decreases in linear fashion in proportion to an increase in winding angle α). Therefore, any adverse effect on near-net shaping of the wrap-corresponding portion overall can be further reduced.

(B)

Figure 43:
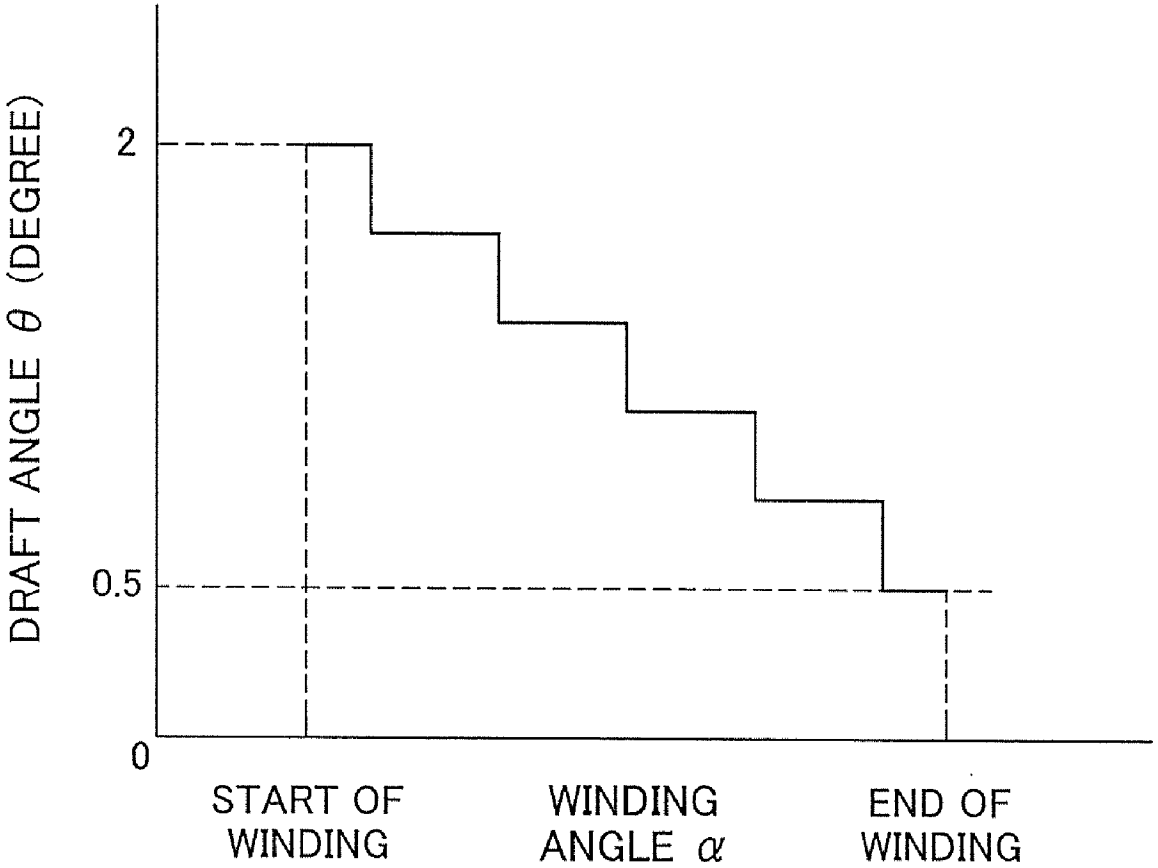
FIG. 43 is a graph showing the relationship between the winding angle $\alpha$ and the draft angle $\theta$ of the movable scroll according to a modified example (B) of the third embodiment.

In the preform 626 of the movable scroll 526 according to the third embodiment, the shape of the wrap-corresponding portion is set so that the draft angle gradually and continuously changes from where winding starts to where winding ends, but the present invention is not limited to this configuration. The change in the draft angle θ in relation to the winding angle α of the wrap-corresponding portion may be set so that the draft angle θ decreases in a stepwise fashion from where winding starts to where winding ends, as shown in the graph of FIG. 43 (the maximum value of the draft angle θ is 2 degrees, and the minimum value is 0.5 degrees). In this case as well, stress applied to the mold in the vicinity of the center of the scroll is reduced during mold release, and the service life of the mold is extended when the preform 626 of the movable scroll 526 is molded by semi-molten die casting. Also, the setting of the draft angle θ in a range of individual winding angles α of the wrap-corresponding portion is facilitated.

(C)

Figure 44:
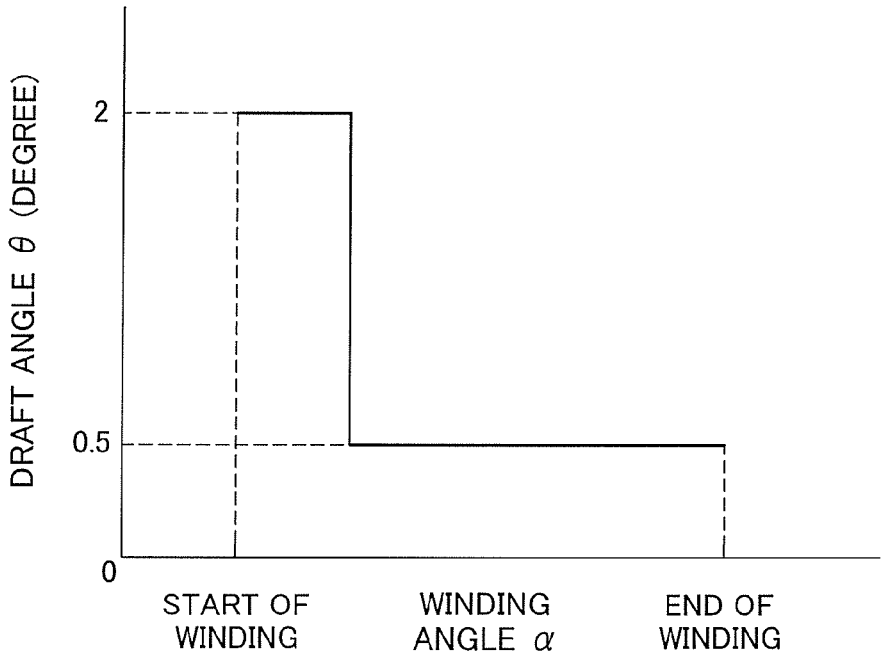
FIG. 44 is a graph showing the relationship between the winding angle $\alpha$ and the draft angle $\theta$ of the movable scroll according to a modified example (C) of the third embodiment.

In the preform 626 of the movable scroll 526 according to the third embodiment, the shape of the wrap-corresponding portion is set so that the draft angle from where winding starts to where winding ends gradually and continuously changes, but the present invention is not limited to this configuration. The change in the draft angle θ in relation to the winding angle α of the wrap-corresponding portion is set so that the draft angle θ in a prescribed range of winding angles α near where winding starts has the maximum value (2 degrees), and so that the draft angle θ in other angle ranges is set to the minimum value (0.5 degree), as shown in the graph of FIG. 44. In this case as well, stress applied to the mold in the vicinity of the center of the scroll is reduced during mold release, and the service life of the mold is extended when the preform 626 of the movable scroll 526 is molded by semi-molten die casting. Also, any adverse effect on near-net shaping of the wrap-corresponding portion overall can be further reduced.

(D)

Figure 45:
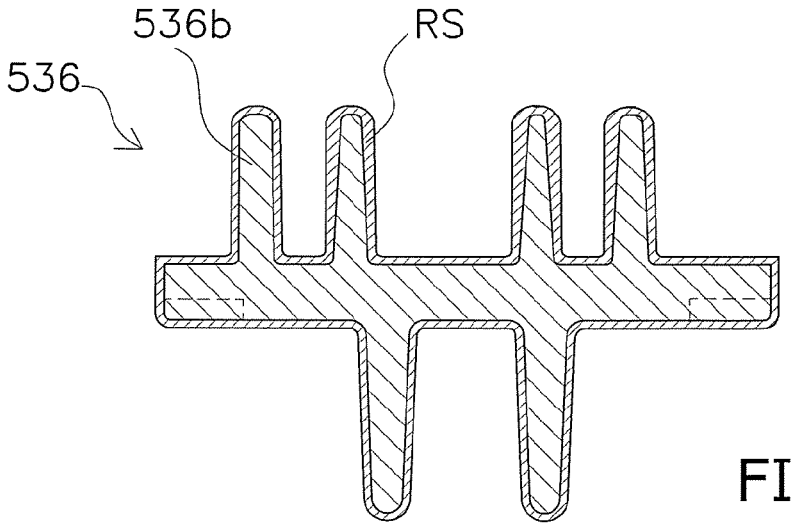
FIG. 45 is a cross-sectional view of a movable scroll manufactured by coating a resin onto the movable scroll according to a modified example (D) of the third embodiment.

Although not particularly mentioned in the third embodiment, the surface of the scroll may be coated with a resin. For example, leakage of refrigerant gas compressed by a compressor can be reduced and noise suppressed when the entire surface of the movable scroll 536 is coated with a resin RS in the manner shown in FIG. 45. Noise and leakage of the refrigerant gas can be reduced when at least the wrap 536*b* of the movable scroll 536 is coated with a resin RS.

When the scroll is coated with a resin in this manner, the strength of the scroll inside the resin coating can be improved only in required locations by increasing the draft angle of the portion where winding starts near the center of the wrap 536*b*.

Furthermore, when the surface of the resin RS is machined by cutting after the wrap 536*b* of the movable scroll 536 has been coated with resin RS, the movable scroll 536 can be machined with good precision to a prescribed external shape.

The fixed scroll may be coated with the resin RS in the same manner as the movable scroll 536. In this case as well, noise and leakage of the refrigerant gas can be reduced when at least the wrap of the fixed scroll is coated with a resin RS.

(E)

In the third embodiment, a compressor scroll is manufactured by semi-molten die casting or another semi-molten molding method, but the present invention is not limited thereto, and the service life of a mold can be extended in the present invention when the compressor scroll is one in which the material is injected into the mold and then molded. For example, the service life of a mold can be extended by making the draft angle in the portion where winding starts near the center of the wrap of the scroll to be greater than the draft angle of the portion where winding ends at the outer side, even when the scroll is one in which high-temperature molten metal material is injected into the mold and then cast.

(F)

In the preform 626 of the movable scroll 526 according to the third embodiment, the draft angle of the portion Q0 where winding starts near the center of the wrap-corresponding portion is greater than the draft angle of the portion Q4 where winding ends at the outer side, but the present invention is not limited thereto, and the draft angle on the outer side may be greater.

Figure 46:
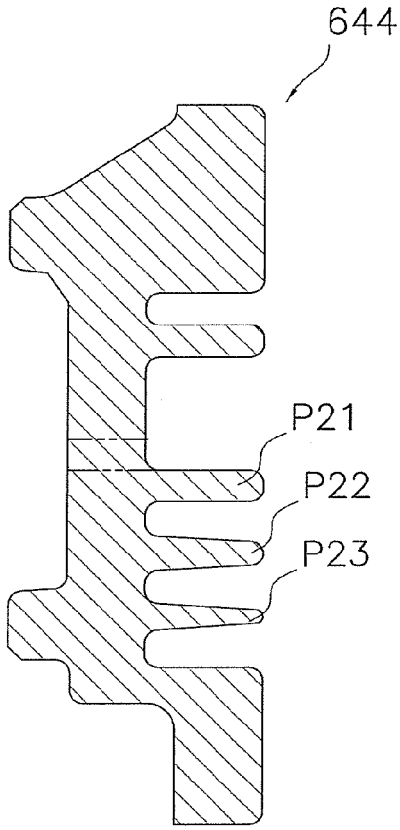
FIG. 46 is a longitudinal sectional view of the fixed scroll according to a modified example (F) of the third embodiment.
Figure 47:
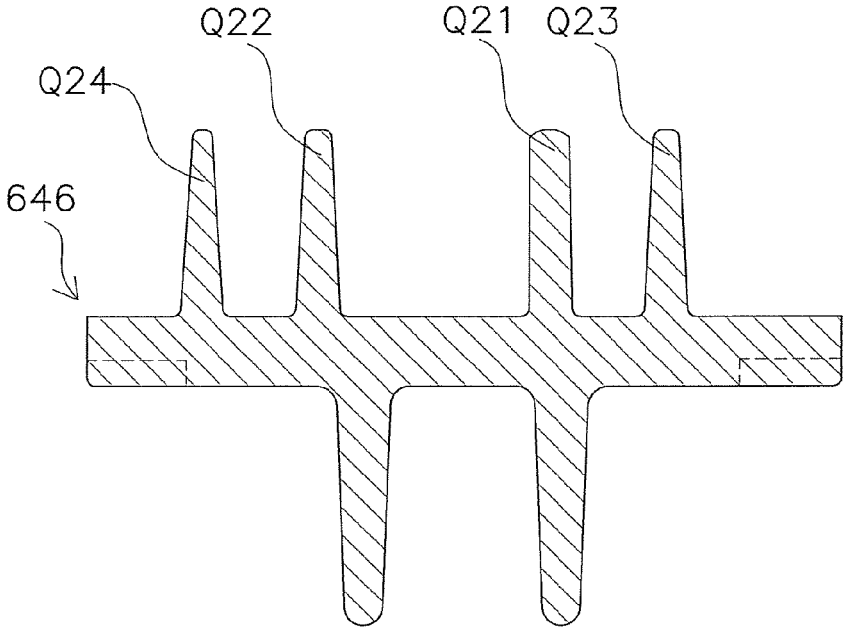
FIG. 47 is a longitudinal sectional view of the movable scroll according to a modified example (F) of the third embodiment.

In other words, in the fixed scroll preform 644 and the movable scroll preform 646, the draft angle in the portions P23, Q24 where winding ends at the outer side of the wrap-corresponding portion may be greater than the draft angle of the portions P21, Q21 where winding starts near the center, as shown in FIGS. 46 and 47.

This configuration is effective for the case in which the thickness of the external peripheral portion of the wrap-corresponding portion is thin and precision is difficult to achieve during machining. For example, since the external peripheral edge of the wrap-corresponding portion is a cantilever shape, the strength of the external peripheral portion of the wrap-corresponding portion is reduced when the thickness of the entire wrap-corresponding portion is reduced. For this reason, the external peripheral portion of the wrap-corresponding portion readily deforms during machining. In view of this situation, precision can be assured by making the draft angle of the external peripheral portion of the wrap-corresponding portion to be greater than that of the center portion.

The wrap-corresponding portion may be set so that the draft angle from where winding starts to where winding ends gradually and continuously changes (i.e., continuously increases from where winding starts near the center to where winding ends at the outer side) in the same manner as in the third embodiment. In this case, the waste of material can be more effectively eliminated.

The wrap-corresponding portion may also be set so that the draft angle from where winding starts to where winding ends changes in a stepwise fashion (i.e., increases in a stepwise fashion from where winding starts near the center to where winding ends at the outer side) in the same manner as in the modified example (B) of the third embodiment. In this case, the waste of material can be more effectively eliminated.

In a prescribed angle range between where winding starts to where winding ends (i.e., a prescribed range near the portion where winding ends), the wrap-corresponding portion may be set so that the draft angle is greater than the draft angle in other angle ranges in the same manner as in the modified example (C) of the third embodiment. In this case, the waste of material can be more effectively eliminated.

At least the wrap-corresponding portion may be coated with a resin in the same manner as in the modified example (D) of the third embodiment. In this case, noise and leakage of the gas refrigerant can be reduced.

Fourth Embodiment

A compressor in which the slider according to a fourth embodiment is used will be described below using a high-low pressure dome-type scroll compressor as an example. The difference between the high-low pressure dome-type scroll compressor of the fourth embodiment and the high-low pressure dome-type scroll compressor of the first embodiment is the shape of the wrap of the fixed scroll and the movable scroll. Therefore, only the fixed scroll and the movable scroll will be described below.

Figure 48:
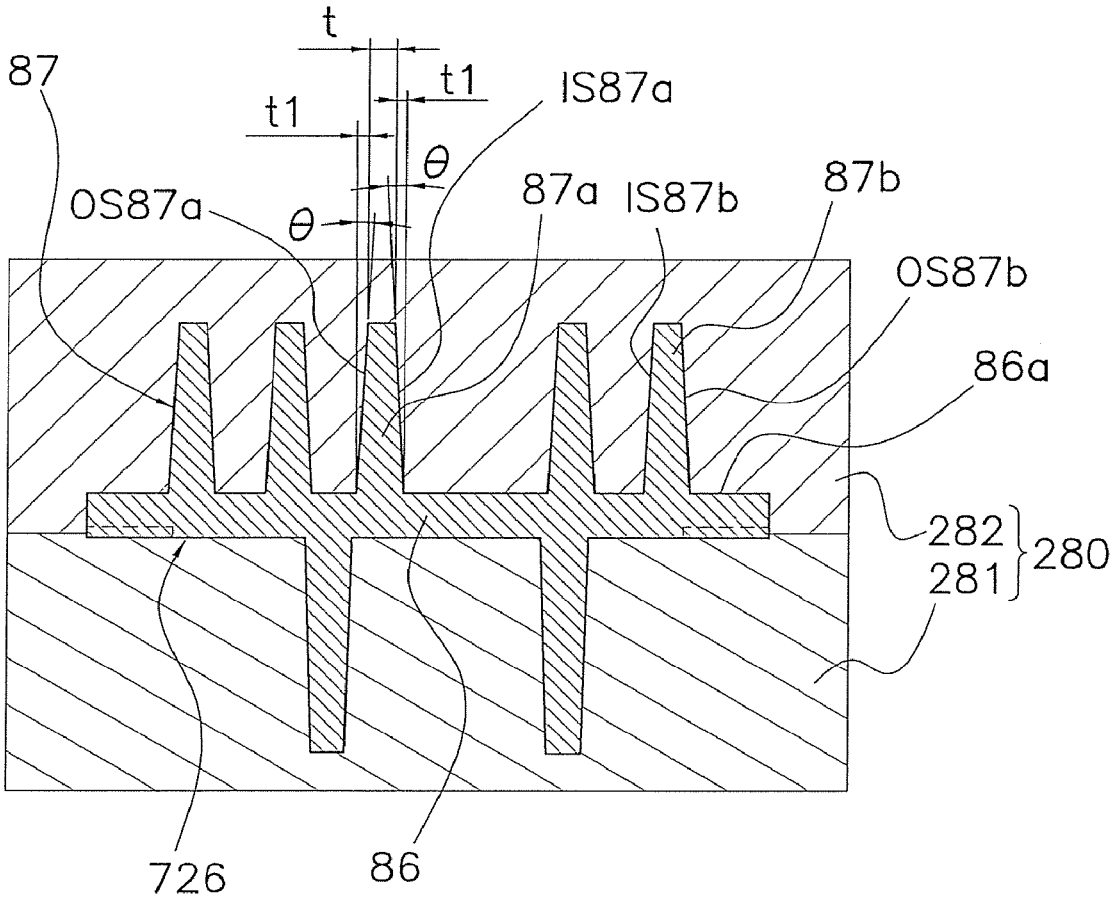
FIG. 48 is a longitudinal sectional view of a metal mold for manufacturing the movable scroll incorporated in a high-low pressure dome-type scroll compressor according to the fourth embodiment, and the movable scroll preform molded by semi-molten die casting.

A movable scroll preform 726 according to the fourth embodiment is formed by semi-molten die casting using a mold 280 shown in FIG. 48, for example.

A specific description is provided below.

The mold 280 for the semi-molten die casting of the movable scroll preform 726 is composed of a first mold portion 281 and a second mold portion 282, as shown in FIG. 48. The shape of a space portion that is formed when the first mold portion 281 and the second mold portion 282 are combined together corresponds to the shape of the external appearance of the movable scroll preform 726 to be molded. In the wrap-corresponding portion of the second mold portion 282 of the mold 280, the external shape is set so as to maintain the required draft angle when the movable scroll preform 726 is released from the mold 280. Specifically, the shape of the wrap-corresponding portion of the second mold portion 282 is determined so that the entire surface of the wrap-corresponding portion 87 is sloped at the first angle θ with respect to a line orthogonal to the portion 86*a* corresponding to the end plate. The thickness of the wrap-corresponding portion 87 of the movable scroll preform 726 in the boundary with the portion 86*a* corresponding to the end plate is t+t1+t1, where t is the thickness of the distal end.

The fixed scroll preform 724 is also manufactured in the same manner as the movable scroll preform 726.

The fixed scroll preform 724 and the movable scroll preform 726 molded by semi-molten die casting are further machined by cutting, whereby the final fixed scroll 734 and movable scroll 736 to be incorporated into a compressor are formed.

Figure 49:
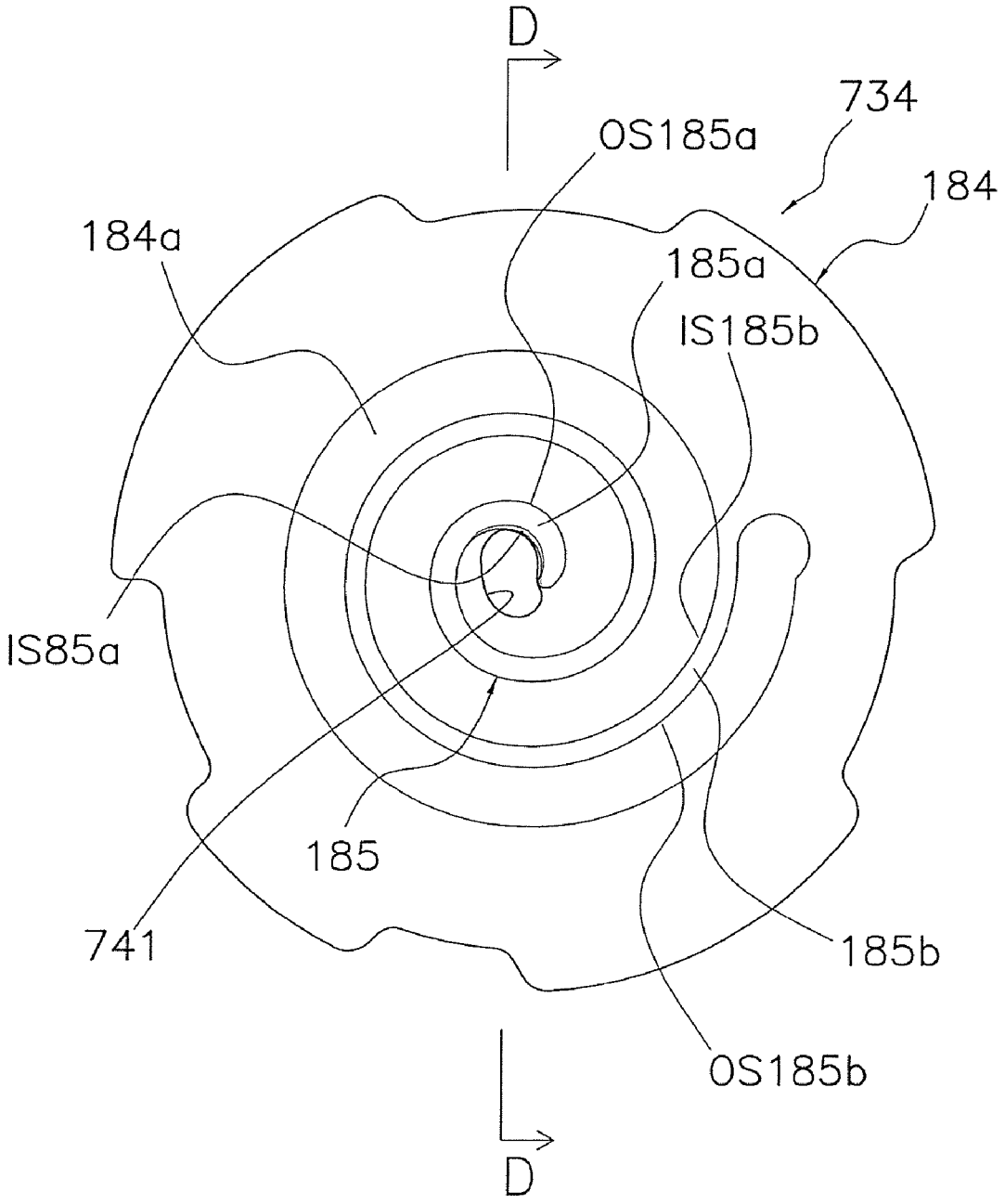
FIG. 49 is a bottom view of the fixed scroll incorporated in a high-low pressure dome-type scroll compressor according to the fourth embodiment.
Figure 50:
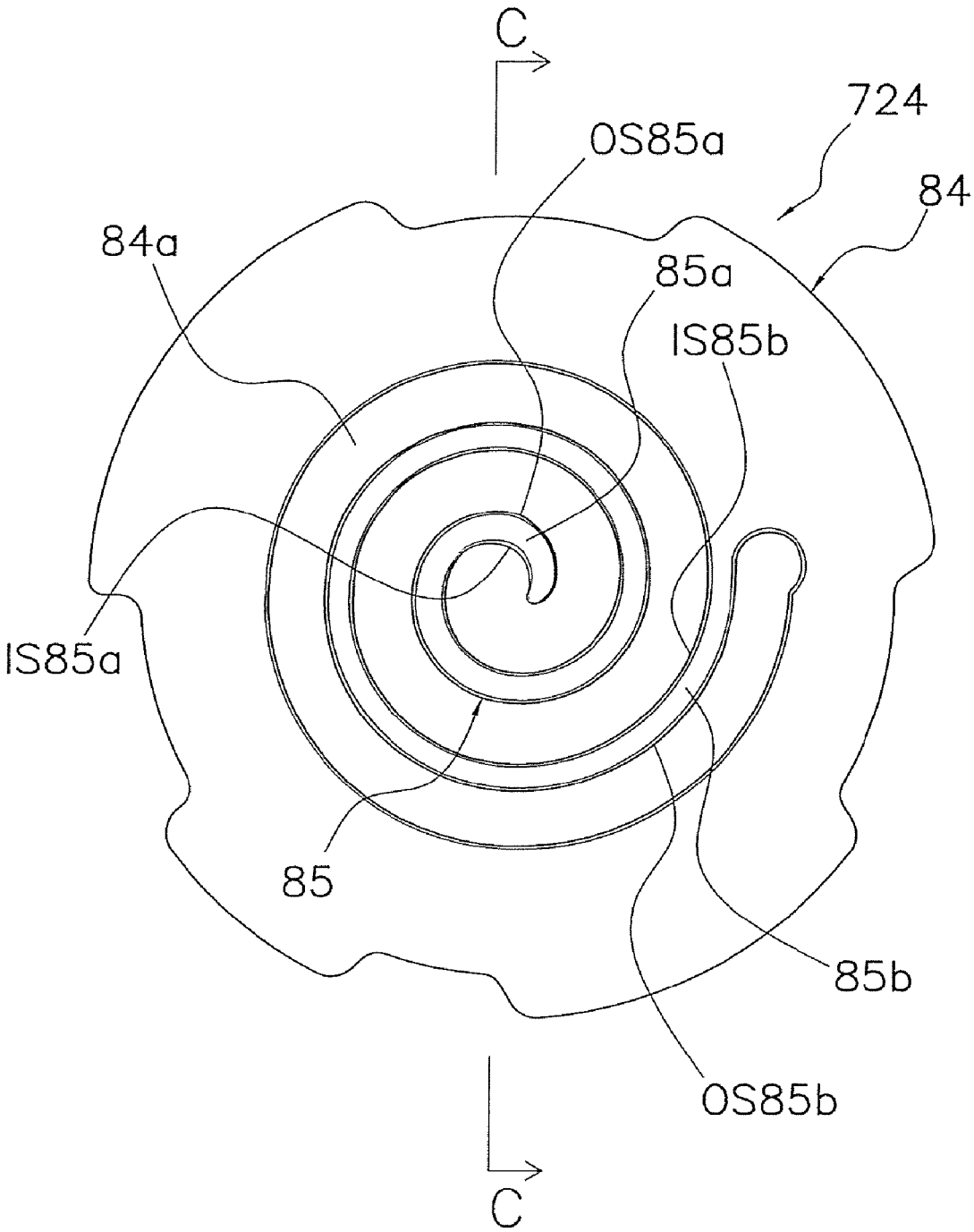
FIG. 50 is a bottom view of the fixed scroll preform according to the fourth embodiment.
Figure 51:
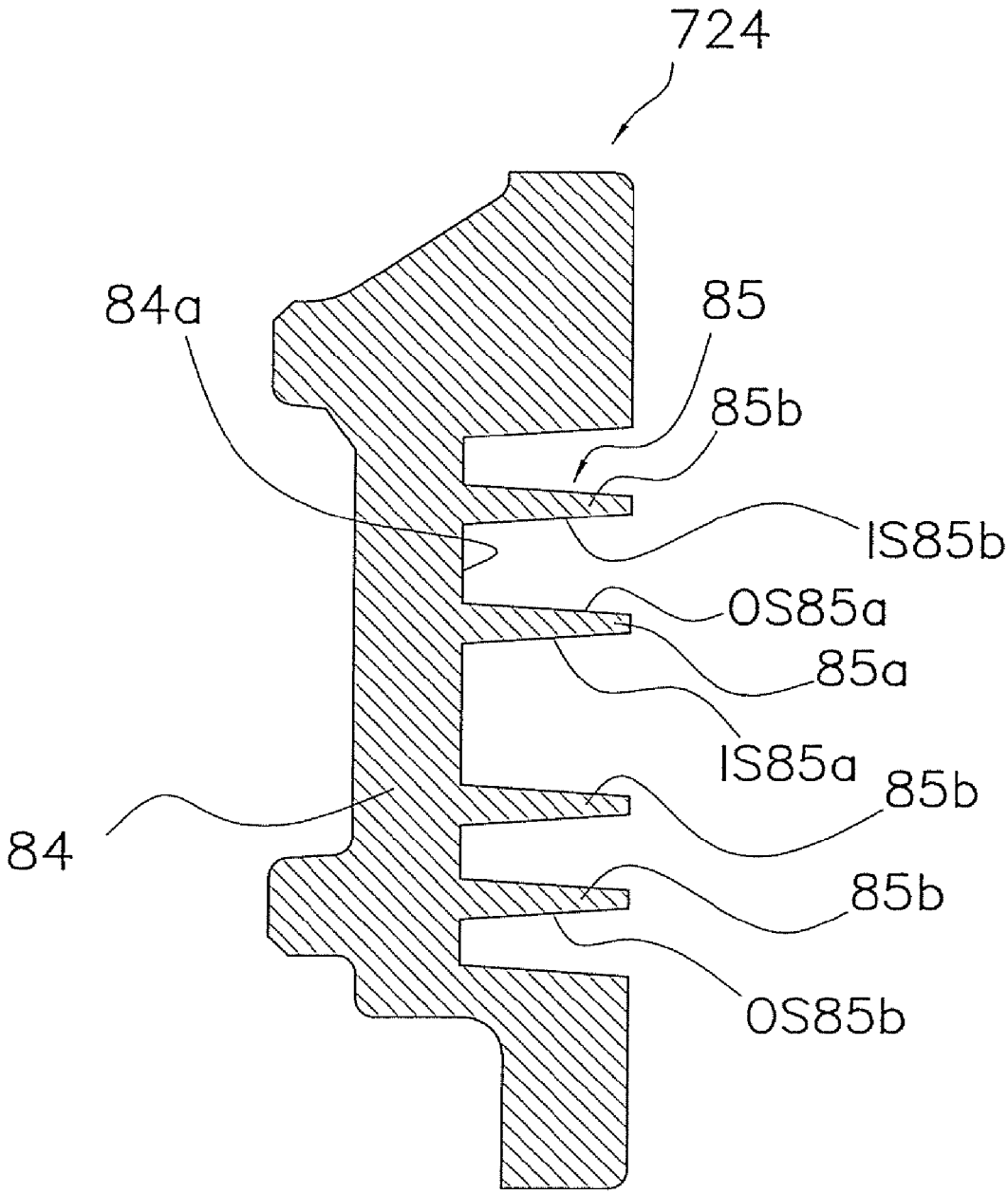
FIG. 51 is a cross-sectional view along the line C-C of the fixed scroll preform according to the fourth embodiment.

The fixed scroll 734 shown in FIG. 49 is manufactured by machining the fixed scroll preform 724 shown in FIGS. 50 and 51. A cutting operation for forming a wrap 185 from the wrap 85 will be described at this point. This operation is one of the machining processes that may be used. These processes also include drilling of a discharge hole 741.

Figure 52:
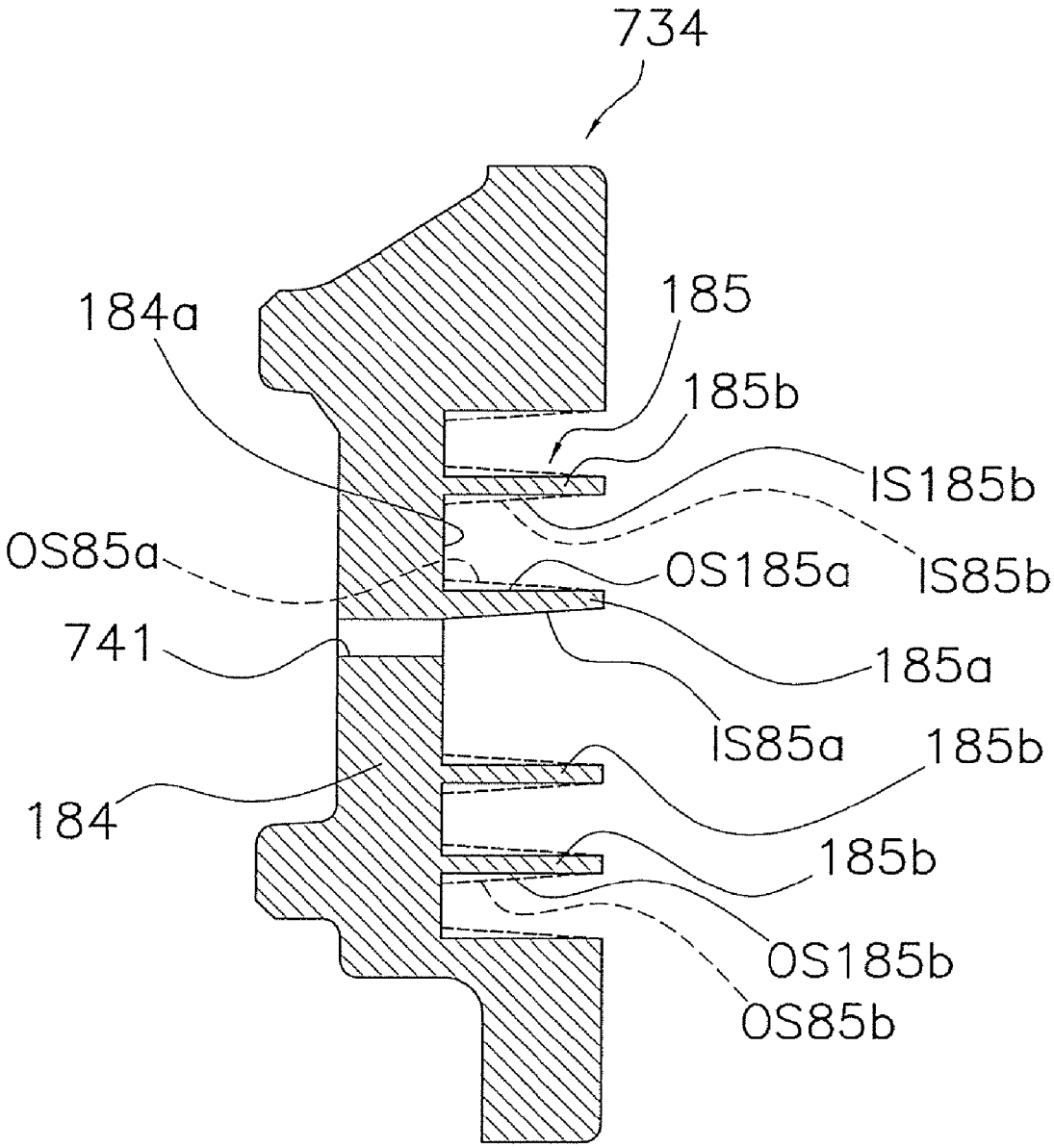
FIG. 52 is a cross-sectional view along the line D-D of the fixed scroll incorporated in a high-low pressure dome-type scroll compressor according to the fourth embodiment.
Figure 53:
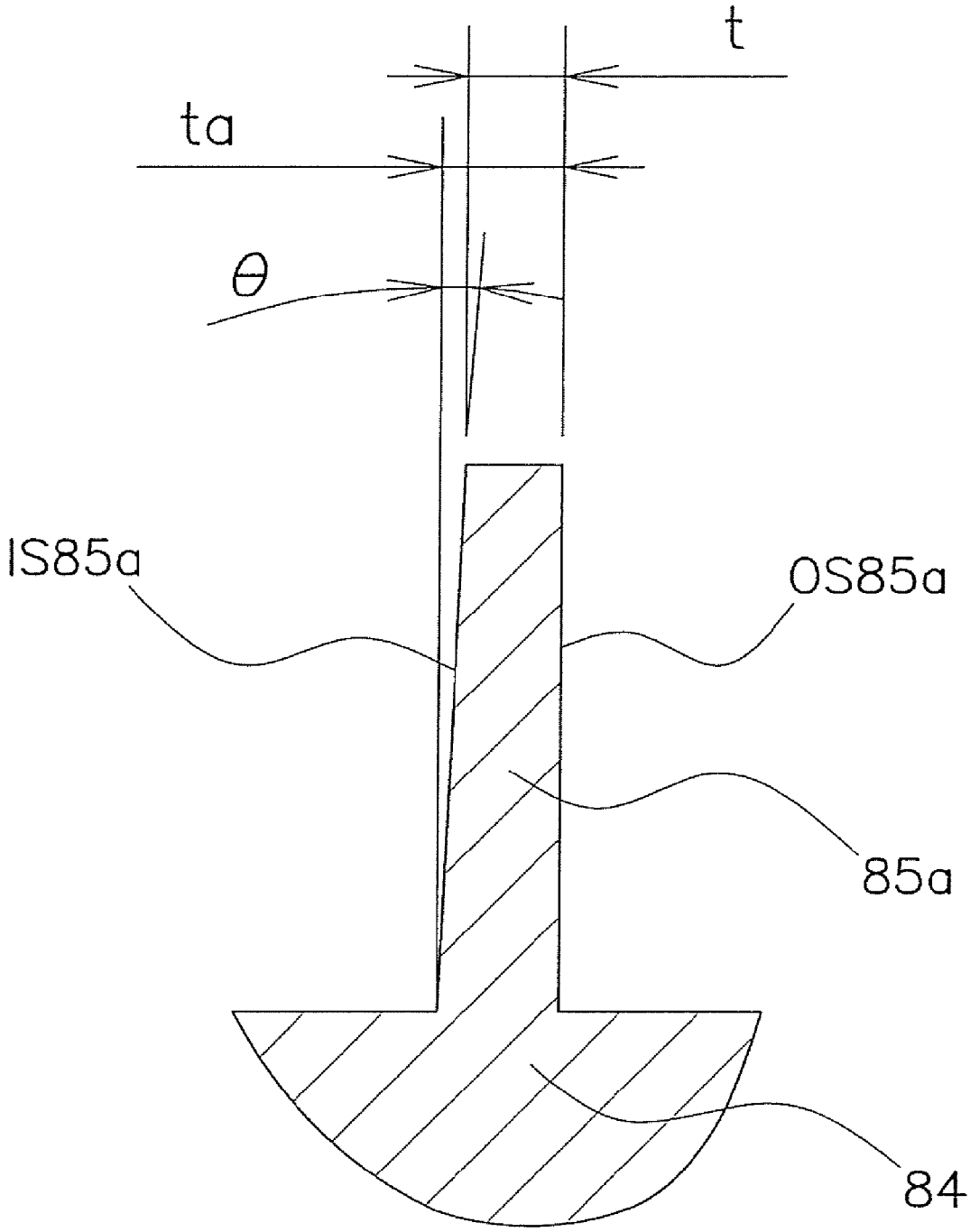
FIG. 53 is a partial enlarged view of the cross section along the line D-D of the fixed scroll incorporated in a high-low pressure dome-type scroll compressor according to the fourth embodiment.

In this case, the wrap 85 is differentiated into surfaces OS85*a*, IS85*b*, OS85*b*, which are in close contact with the wrap 187 of the movable scroll 36 as the other element of the meshing pair and which can form an end portion of the compression chamber 740, and into an internal peripheral surface IS85*a* of the portion 85*a* where winding starts (portion near the center of the wrap 85), which is not in close contact with the wrap 187 of the movable scroll 736 as the other element of the meshing pair. The former surfaces OS85*a*, IS85*b*, OS85*b* are machined by cutting, and the latter surface IS85*a* is not machined by cutting. Among the surfaces OS85*a*, IS85*b*, OS85*b*, the external peripheral surface OS85*a* of the portion 85*a* is near where winding starts; and the internal peripheral surface IS85*b* and the external peripheral surface OS85*b* of the portion 85*b* are nearer to where winding ends than the portion 85*a* near where winding starts. The surfaces OS85*a*, IS85*b*, OS85*b* are machined by cutting in an end mill process, the slopes shown in FIGS. 50 and 51 are removed, and the surfaces OS185*a*, IS185*b*, OS185*b* shown in FIGS. 49 and 52 are formed. The surfaces OS85*a*, IS85*b*, OS85*b* indicated by the broken lines in FIG. 52 are cut, and the surfaces OS185*a*, IS185*b*, OS185*b* indicated by solid lines are formed. The slope angle of the surfaces OS185*a*, IS185*b*, OS185*b* in relation to the line orthogonal to the end plate surface 184*a* is 0 degrees. On the other hand, the internal peripheral surface IS85*a* of the portion 85*a* of the wrap 85 near where winding starts is left unchanged as the internal peripheral surface of the portion 185*a* near where winding starts in the final wrap 185 as well. FIG. 53 shows an enlarged view of the portion 185*a* near where winding starts in FIG. 52. In the portion 185*a* of the wrap 185 near where winding starts, the external peripheral surface OS185*a* is orthogonal to the end plate surface 184*a*, whereas the internal peripheral surface IS85*a* slopes by a first angle θ with respect to the line orthogonal to the end plate surface 184*a*. The portion 85*a* of the wrap 185 near where winding starts is thereby given a thickness ta in the boundary with the end plate surface 184*a*, and this thickness is greater than that of the other portions 85*b* of the wrap 185. The portions 85*b* of the wrap 185 other than the portion 85*a* near where winding starts are machined by cutting so as to have the same thickness from the boundary with the end plate surface 184*a* to the distal end, and the thickness is set to be the same as the thickness t of the distal end of the portion 85*a* near where winding starts shown in FIG. 53.

Figure 54:
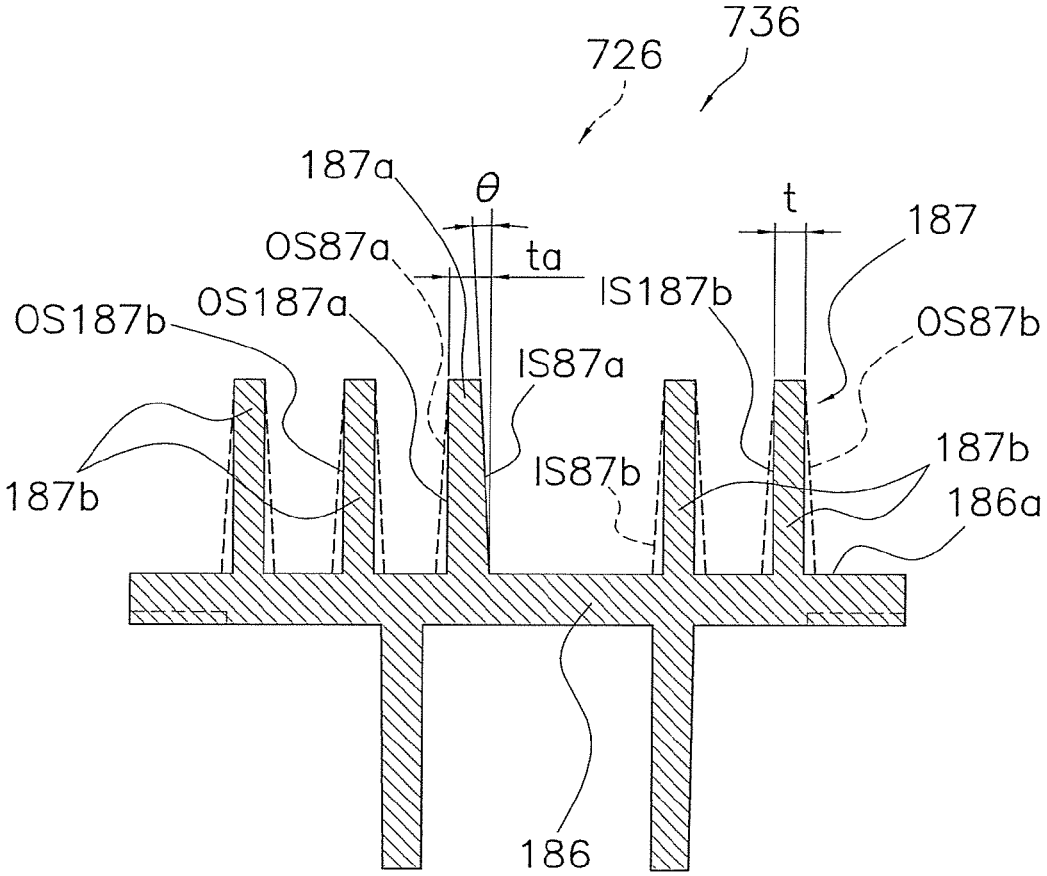
FIG. 54 is a longitudinal sectional view of the movable scroll incorporated in a high-low pressure dome-type scroll compressor according to the fourth embodiment.

The movable scroll 736 shown in FIG. 54 is manufactured by machining the movable scroll preform 726 shown in FIG. 48. Among the machining processes, the cutting operation for forming a wrap 187 from the wrap 87 will be described at this point.

In this case, the wrap 87 is differentiated into surfaces OS87*a*, IS87*b*, OS87*b*, which are in close contact with the wrap 185 of the fixed scroll 734 as the other element of the meshing pair and which can form an end portion of the compression chamber 740, and into an internal peripheral surface IS87*a* of the portion 87*a* where winding starts (portion near the center of the wrap 87), which is not in close contact with the wrap 185 of the fixed scroll 734 as the other element of the meshing pair. The former surfaces OS87*a*, IS87*b*, OS87*b* are machined by cutting, and the latter surface IS87*a* is not machined by cutting. Among the surfaces OS87*a*, IS87*b*, OS87*b*, the external peripheral surface OS87*a* of the portion 87*a* is near where winding starts; and the internal peripheral surface IS87*b* and the external peripheral surface OS85*b* of the portion 87*b* are nearer to where winding ends than the portion 87*a* near where winding starts. The surfaces OS87*a*, IS87*b*, OS87*b* are machined by cutting in an end mill process, the slopes shown in FIG. 48 are removed, and the surfaces OS187*a*, IS187*b*, OS187*b* shown in FIG. 54 are formed. The surfaces OS87*a*, IS87*b*, OS87*b* indicated by the broken lines in FIG. 54 are cut, and the surfaces OS187*a*, IS187*b*, OS187*b* indicated by solid lines are formed. The slope angle of the surfaces OS187*a*, IS187*b*, OS187*b* in relation to the line orthogonal to the end plate surface 186*a* is 0 degrees. On the other hand, the internal peripheral surface IS87*a* of the portion 87*a* of the wrap 87 near where winding starts is left unchanged as the internal peripheral surface of the portion 187*a* near where winding starts in the final wrap 187 as well. In the portion 187*a* of the wrap 187 near where winding starts, the external peripheral surface OS187*a* is orthogonal to the end plate surface 186*a*, whereas the internal peripheral surface IS87*a* slopes by a first angle θ with respect to the line orthogonal to the end plate surface 186*a*. The portion 87*a* of the wrap 187 near where winding starts is thereby given a thickness ta in the boundary with the end plate surface 186*a*, and this thickness is greater than that of the other portions 87*b* of the wrap 187. The portions 87*b* of the wrap 187 other than the portion 87*a* near where winding starts are machined by cutting so as to have the same thickness from the boundary with the end plate 186*a* to the distal end, and the thickness is set to the thickness t, which is less than the thickness ta, as shown in FIG. 54.

(Movement of the Scroll During Compression Operation)

Figure 55B:
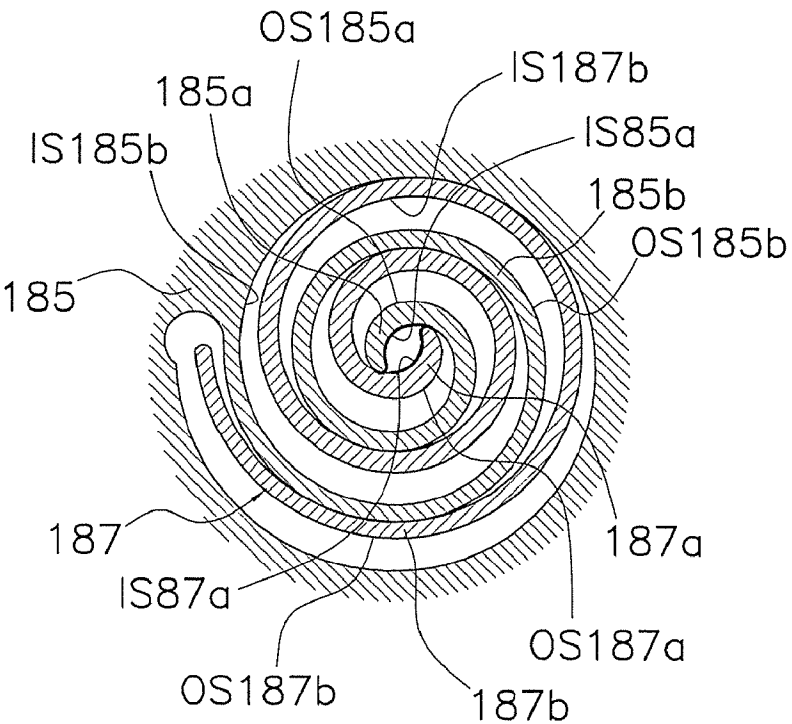
FIGS. 55(*a*) and 55(*b*) are diagrams showing a state in which a gas refrigerant is compressed by varying the state of the meshing of the wrap of the two scrolls in a high-low pressure dome-type scroll compressor according to the fourth embodiment.
Figure 55A:
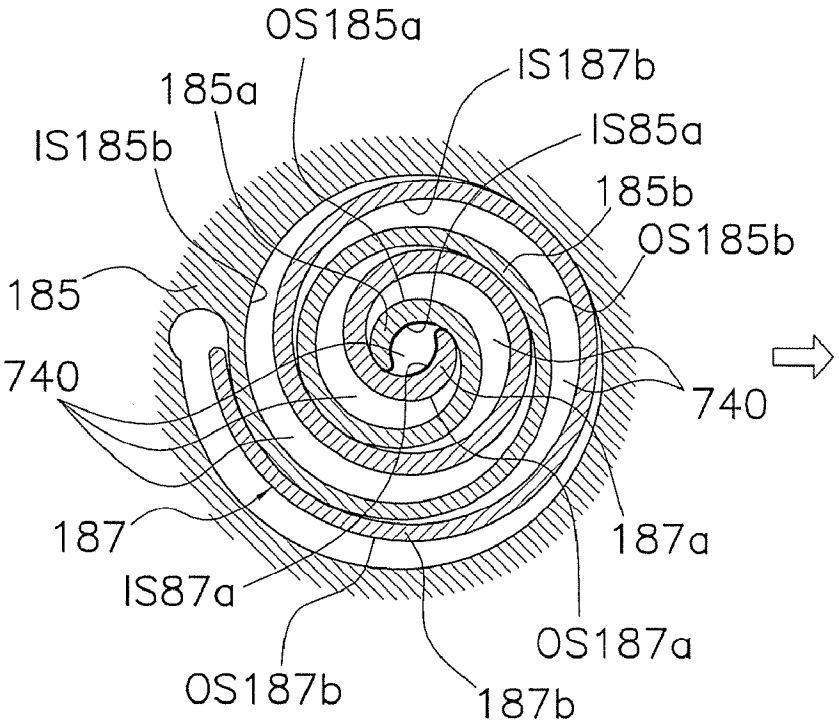
Figure 56B:
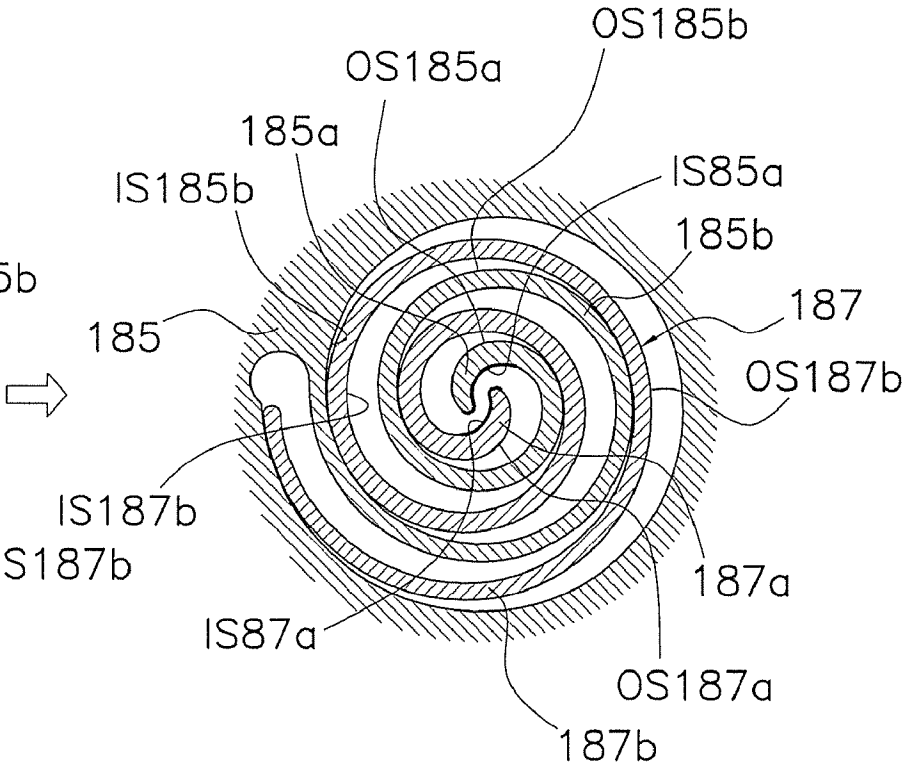
FIGS. 56(*a*) and 56(*b*) are diagrams showing a state in which a gas refrigerant is compressed by varying the state of the meshing of the wrap of the two scrolls in a high-low pressure dome-type scroll compressor according to the fourth embodiment.
Figure 56A:
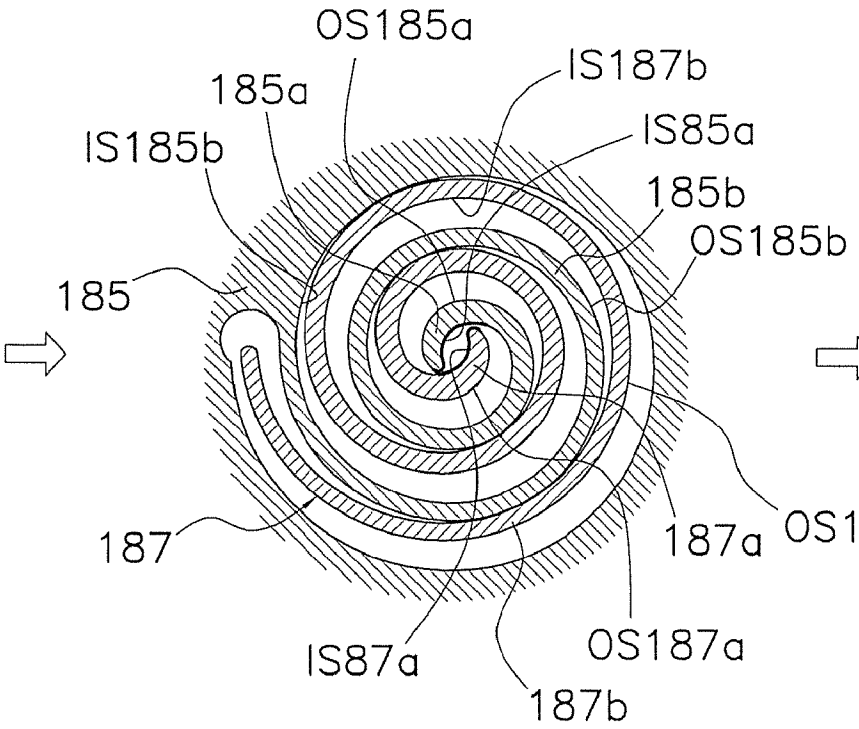
Figure 57B:
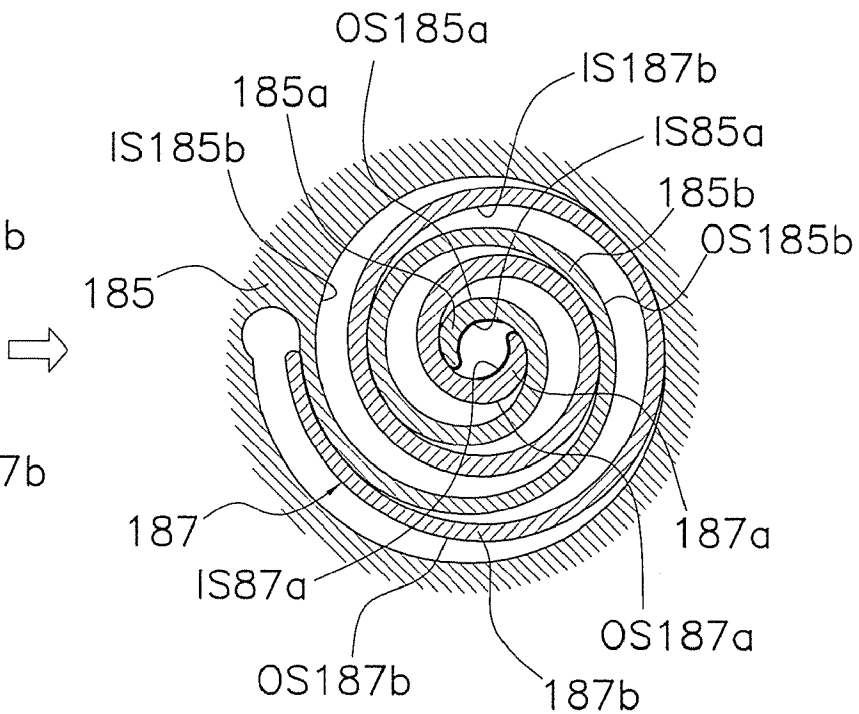
FIGS. 57(*a*) and 57(*b*) are diagrams showing a state in which a gas refrigerant is compressed by varying the state of the meshing of the wrap of the two scrolls in a high-low pressure dome-type scroll compressor according to the fourth embodiment.
Figure 57A:
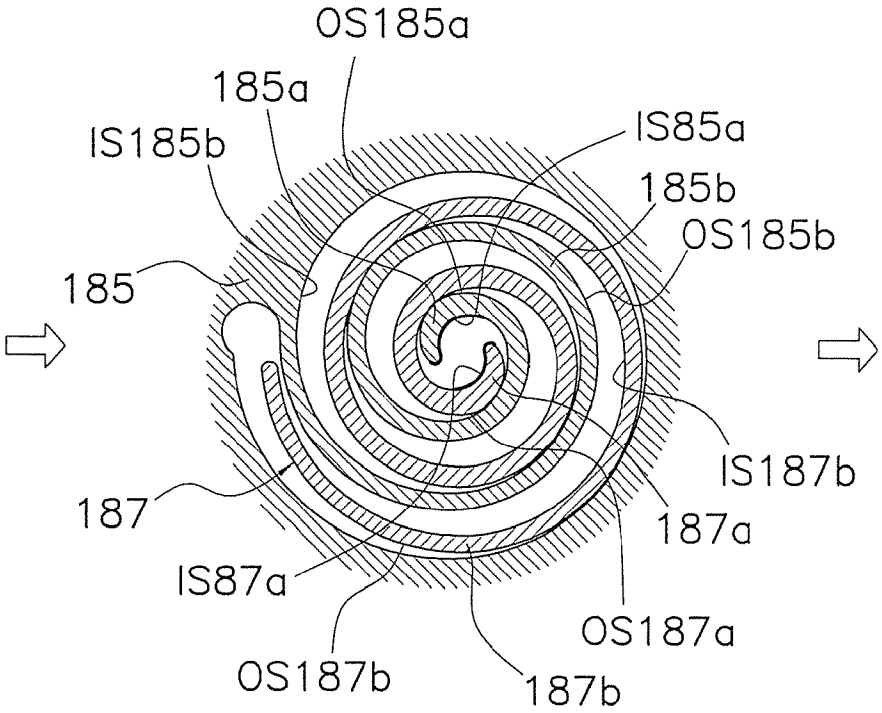
Figure 58B:
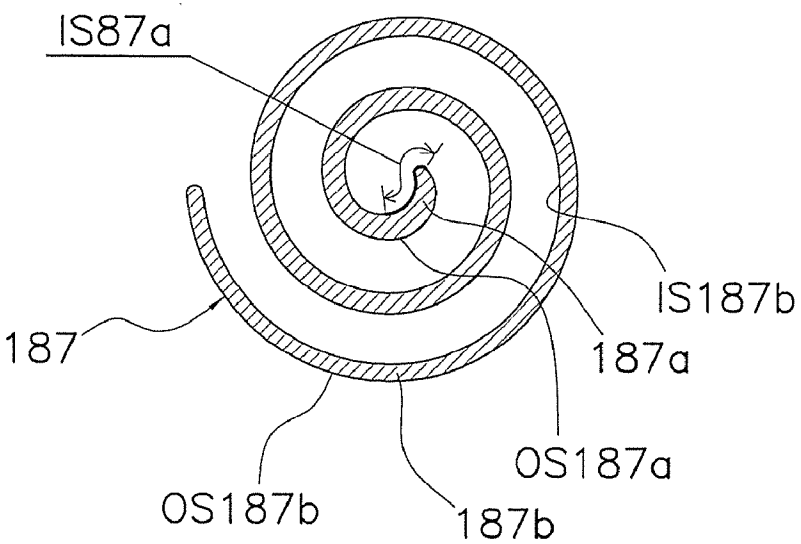
FIG. 58(*a*) is a diagram showing the range of the internal peripheral surface of the portion of the wrap of the fixed scroll adjacent to where winding starts according to the fourth embodiment.
Figure 58A:
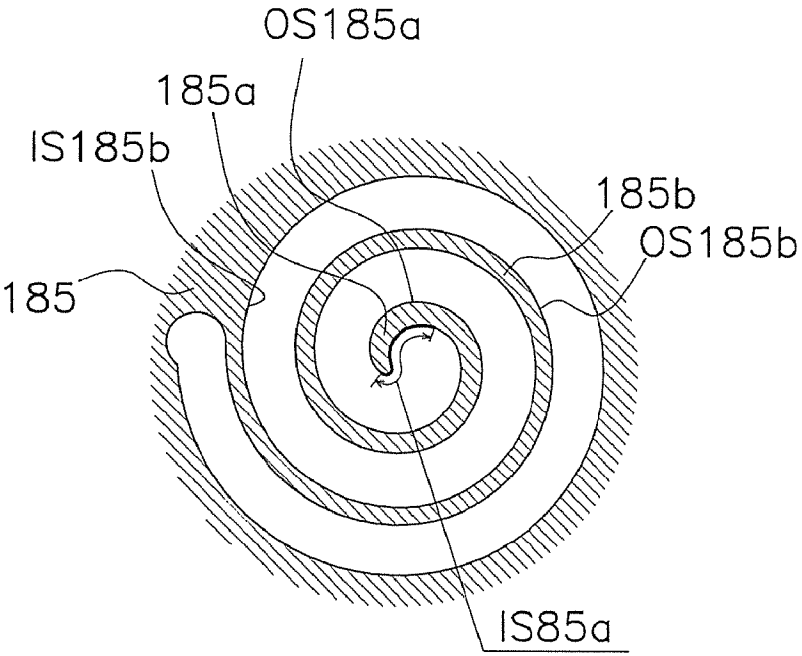

FIGS. 55(*a*) to 57(*b*) are diagrams showing a state in which a gas refrigerant is compressed in association with variation in the capacity of the compression chamber 740. FIGS. 55 to 57 are lateral cross-sectional views of the meshing portion of the wrap 185 of the fixed scroll 734 and the wrap 187 of the movable scroll, and are views from above. The movable scroll 736 turn with respect to the fixed scroll 734, whereby the state changes in the sequence of FIGS. 55(*a*), 55(*b*), 56(*a*), 56(*b*), 57(*a*), and 57(*b*). The internal peripheral surfaces IS85*a*, IS87*a* of the portions 185*a*, 187*a* of the wraps 185, 187 near where winding starts (surfaces with thick lines in the diagrams; see FIGS. 58(*a*) and 58(*b*)) are surfaces that do not make contact with the counterpart wrap, do not constitute end portions of the compression chamber 740, and do not contribute to compression work. Therefore, although these surfaces are sloped at a first angle θ, the surface precision of the surfaces IS85*a* and IS87*a* does not affect the airtightness of the compression chamber 740.

Characteristics of the High-Low Pressure Dome-Type Scroll Compressor According to Fourth Embodiment (1)

Using ductile cast iron and high-carbon steel, which are high-strength materials, makes it difficult to achieve a near-net shape and results in low machinability. Therefore, the scroll in a conventional scroll compressor is often manufactured using FC250 or another ordinary cast iron.

In contrast, in the compressor according to the fourth embodiment, the fixed scroll preform 724 and the movable scroll preform 726 are molded by semi-molten die casting, whereby high strength and high rigidity are achieved and the final fixed scroll 734 and movable scroll 736 are molded to a near-net shape.

However, the scroll preforms 724, 726, which are semi-molten die cast materials, are given higher strength by heat treatment, but the rigidity (Young's modulus) is fixed and cannot be adjusted. Therefore, the amount of deformation (flexing) of the wraps 185, 187 during operation increases when the wraps 185, 187 are merely made thinner as strength is increased, and noise and abrasion tend to be generated. When the gap between the two wraps 185, 187 is increased so as to allow a considerable amount of deformation in order to avoid this noise and abrasion, airtightness of the compression chamber is reduced and compression performance is degraded.

In order to avoid these drawbacks, it is possible to consider increasing the rigidity of the wraps 185, 187 overall by increasing the thickness of the base portion of the portion near the end plates 184, 186 and reducing the thickness of the distal end portion, rather than merely reducing the thickness of the wraps 185, 187. However, demerits occur in that the capacity of the compression chamber is reduced when the thickness of the base portion is increased overall. Also, it is possible that quality control (control of surface precision) will be made more difficult and performance will be compromised by leaving a slope on the wraps 185, 187 in which high precision is required.

In view of the above, in the compressor according to the fourth embodiment, a slope having a first angle θ is provided to the surfaces IS85*a*, IS87*a* of the internal peripheral side to increase strength and to considerably reduce the amount of deformation in the portions 185*a*, 187*a* near where winding starts in the wraps 185, 187. In these wraps, there is an increase in the pressure applied by the refrigerant gas compressed near the center. On the other hand, the slope is eliminated from the portions 185*b*, 187*b* that are set at a distance from the center of the wraps 185, 187, and a reduction in capacity is avoided. Also, the external peripheral surfaces OS185*a*, OS187*a* of the portions 185*a*, 187*a* of the wraps 185, 187 near where winding starts are surfaces that make contact with the counterpart scroll and that perform compression work. The slope is eliminated because control of the surface precision becomes difficult when a large slope is provided, and refrigerant gas leakage is likely to increase in the contact portions of the two scrolls 734, 736. A slope having a first angle θ is provided to the internal peripheral surfaces IS85*a*, IS87*a* of the portions 185*a*, 187*a* of the wraps 185, 187 near where winding starts, but there is no demerit because these surfaces IS85*a*, IS87*a* are not surfaces that make contact with a counterpart scroll and does not affect the airtightness of the compression chamber 740.

In this manner, in the compressor according to the fourth embodiment, the pressure is relatively low in the portions 185*b*, 187*b* other than the portions 185*a*, 187*a* of the wraps 185, 187 near where winding starts. Therefore, priority is placed on increasing capacity rather than increasing strength and reducing the amount of deformation, and the slope angle is set to zero. The pressure is relatively high in the internal peripheral surfaces IS85*a*, IS87*a* of the portions 185*a*, 187*a* of the wraps 185, 187 near where winding starts. Therefore, a slope angle (first angle θ) is provided with the aim of increasing strength and reducing the amount of deformation. In the external peripheral surfaces OS185*a*, OS187*a* of the portions 185*a*, 187*a* of the wraps 185, 187 near where winding starts, the slope angle is set to zero with consideration given to control of the surface precision and the airtightness of the compression chamber 740. For this reason, the thickness of the wraps 185, 187 is reduced overall and the capacity is assured, but a slope having a first angle θ is provided to the portions 185*a*, 187*a* near where winding starts of the wraps 185, 187, which received high-pressure, whereby strength can be assured and the amount of deformation can be kept within acceptable levels. There is an advantage in that control of surface precision and airtightness of the compression chamber 740 are assured because the slope angle is set to zero also for the portions 185*b*, 187*b* other than the portions 185*a*, 187*a* of the wraps 185, 187 near where winding starts.

(2)

In the compressor according to the fourth embodiment, all of the surfaces OS182*a*, IS185*b*, OS185*b*, OS187*a*, IS187*b*, OS187*b* in the scroll 124, 126 have a slope angle of zero, except for the surfaces IS85*a*, IS87*a*, which are provided with a slope having a first angle θ. In this manner, the surfaces that make contact with the wrap of the meshing counterpart scroll and perform compression work all have a slope angle of zero. Therefore, control of the surface precision for these surfaces is facilitated, and there is less of a drawback in which gas refrigerant leaks from the meshing portion of the wraps 185, 187 of the two scroll 124, 126 to the compression chamber 740 on the outer side during operation of the compressor.

(3)

In the compressor according to the fourth embodiment, the internal peripheral surfaces IS85*a*, IS87*a* of the portions 185*a*, 187*a* of the wraps 185, 187 near where winding starts are surfaces that do not make contact with meshing counterpart wraps 187, 185. In view of that fact that high surface precision is not required for these surfaces, machining by cutting the surfaces IS85*a* and IS87*a* is omitted. Reduced costs can thereby be assured and the time required for machining by cutting is reduced.

(4)

In the compressor according to the fourth embodiment, the draft angle maintained during mold release is provided to the preforms 724, 726 of the uncut scrolls 734, 736, and the draft angle is directly used as the slope of the surfaces IS85*a*, IS87*a* of the wraps 185, 187. Therefore, the surfaces IS85*a*, IS87*a* of the wraps 185, 187 are set to the first angle θ without cutting.

(5)

In the compressor according to the fourth embodiment, the portions 185*a*, 187*a* of the wraps 185, 187 near where winding starts in the scrolls 734, 736 have internal peripheral surfaces IS85*a*, IS87*a* that are sloped by a first angle θ with respect to the line orthogonal to the end plate surfaces 184*a*, 186*a* in contrast to the external peripheral surfaces OS185*a*, OS187*a* that are orthogonal to the end plate surfaces 184*a*, 186*a*. The portions 85*a*, 87*a* of the wraps 185, 187 near where winding starts have a thickness to in the boundary with the end plate surfaces 184*a*, 186*a*, and this thickness is greater than that of the other portions 85*b*, 87*b* of the wraps 185, 187. Strength is therefore increased in the portions 185*a*, 187*a* of the wraps 185, 187 near where winding starts in the scrolls 734, 736 of this compressor. Therefore, the scrolls 734, 736 of this compressor can withstand an increase in pressure due to a high pressure difference even when carbon dioxide or another high-pressure refrigerant is compressed. In addition, the height of the teeth of the scrolls 734, 736 can be increased by this effect. In other words, the capacity of the compression chamber 740 can be increased even while the wraps 185, 187 are reduced in diameter. The trunk casing 11 is reduced in diameter when the diameter of the compressor can be reduced in this manner. The trunk casing 11 having a reduced diameter can demonstrate the same compression strength with less thickness than a conventional trunk casing. Accordingly, the raw material costs and the like of the trunk casing 11 can be reduced. The diameter of the wraps 185, 187 of the scrolls 734, 736 can also be reduced. For this reason, the sliding surface area of the thrust portion, which is subject to rigorous conditions, can be increased.

(6)

In the compressor according to the fourth embodiment, the scrolls 734, 736 are manufactured by semi-molten die casting. Accordingly, the scrolls 734, 736 have a surface roughness that is less than that of scrolls obtained by conventional iron casting. For this reason, cracks are unlikely to occur from the surface of the scrolls 734, 736 even when carbon dioxide or another high-pressure refrigerant is compressed in this compressor.

Modified Example of Fourth Embodiment

In the fourth embodiment, the preforms 724, 726 of the compressor scrolls 734, 736 are manufactured by semi-molten die casting or another semi-molten molding method, but the present invention is not limited thereby. For example, only the slope angle of the internal peripheral surfaces of the portion near where winding starts in the center of the wrap, which does not make contact with the counterpart scroll during compressor operation, may be increased, and the capacity of the compression chamber can be increased while reducing the amount of deformation and increasing the strength. This is true even in the case of a scroll that has been cast by injecting high-temperature molten metal material into the mold.

However, the problem of the deformation amount (flexing) in the portion near where winding starts in the center of the wrap is mainly considered in the case of a scroll in which relatively higher rigidity is not desired as much as the desired for higher strength obtained using a high-strength material. Therefore, the present invention is made more useful in that the rigidity of this portion alone can be improved.

Fifth Embodiment

A compressor in which the slider according to a fifth embodiment is used will be described below using a swing compressor as an example.

Figure 59:
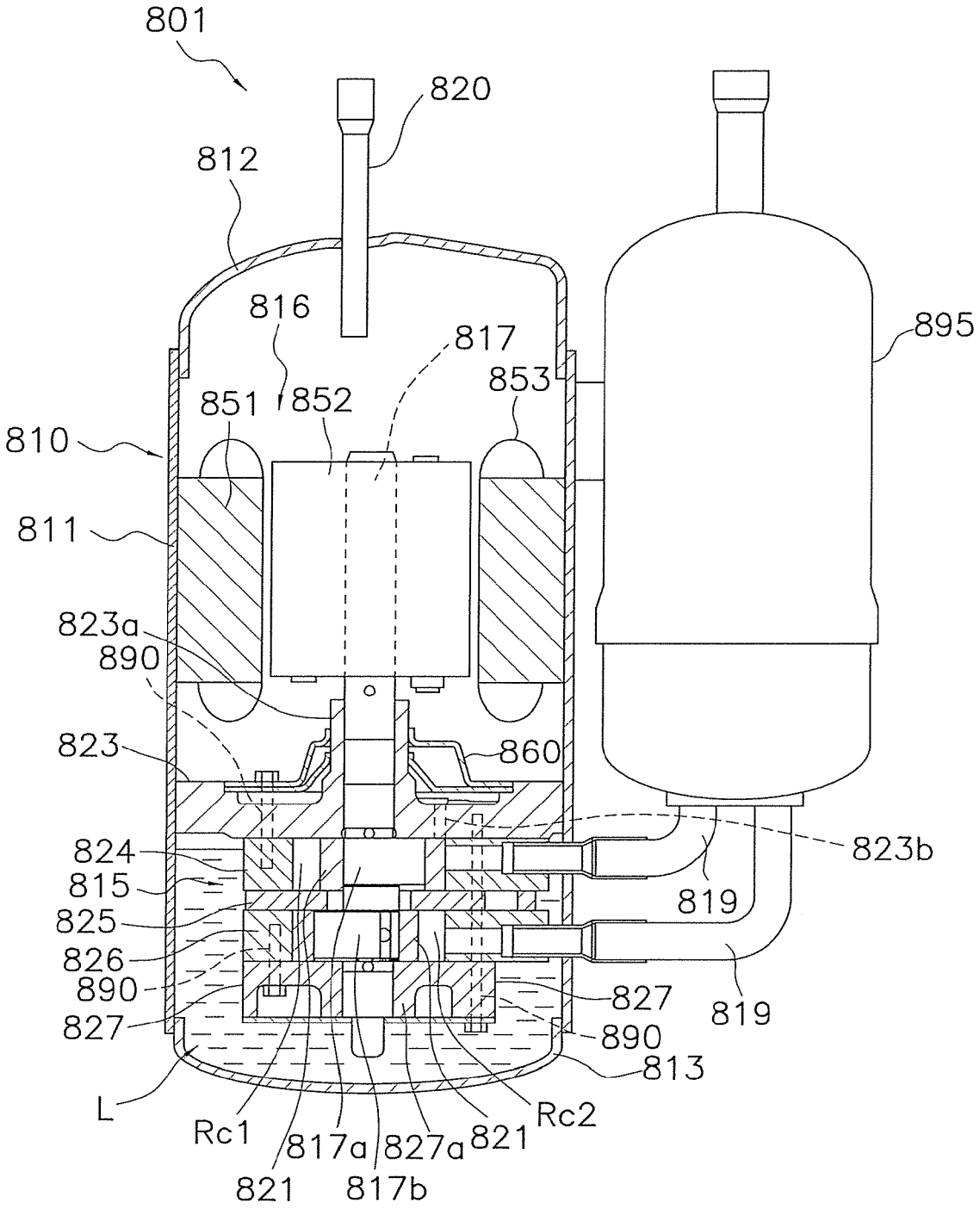
FIG. 59 is a longitudinal sectional view of a swing compressor according to the fifth embodiment.

The swing compressor 801 according to the fifth embodiment is a two-cylinder swing compressor, as shown in FIG. 59, and is primarily composed of a cylindrical airtight dome-type casing 810, a swing compression mechanism 815, a drive motor 816, a suction tube 819, a discharge tube 820, and a muffler 860. The swing compressor 801 has an accumulator (vapor-liquid separator) 895 mounted on the casing 810. The constituent elements of the swing compressor 801 are described below.

(Details of the Constituent Elements of the Swing Compressor)

(1) Casing

The casing 810 has a substantially cylindrical trunk casing 811, a saucer-shaped upper wall portion 812 welded in an airtight manner to an upper end of the trunk casing 811, and a saucer-shaped lower wall portion 813 welded in an airtight manner to a lower end of the trunk casing 811. Primarily accommodated in the casing 810 are the swing compression mechanism 815 for compressing a gas refrigerant, and the drive motor 816 disposed above the swing compression mechanism 815. The swing compression mechanism 815 and the drive motor 816 are connected by a crankshaft 817 disposed so as to extend in the vertical direction inside the casing 810.

(2) Swing Compression Mechanism

Figure 61:
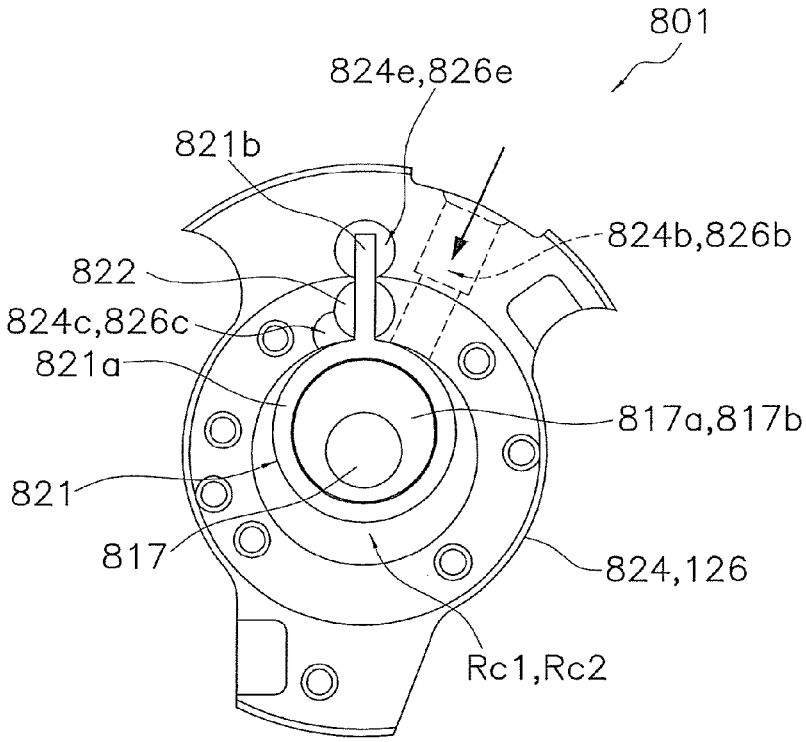
FIG. 61 is a lateral cross-sectional view of a cylinder chamber of the swing compressor according to the fifth embodiment.

The swing compression mechanism 815 is primarily composed of a crankshaft 817, a piston 821, a bushing 822, a front head 823, a first cylinder block 824, a middle plate 825, a second cylinder block 826, and a rear head 827, as shown in FIGS. 59 and 61. In the fifth embodiment, the front head 823, first cylinder block 824, middle plate 825, second cylinder block 826, and rear head 827 are integrally fastened by a plurality of bolts 890. Also, in the fifth embodiment, the swing compression mechanism 815 is immersed in lubricating oil L pooled in the bottom portion of the casing 810, and the lubricating oil L is fed to the swing compression mechanism 815 by differential pressure. The constituent elements of the swing compression mechanism 815 will be described in detail below.

a) First Cylinder Block

Figure 60:
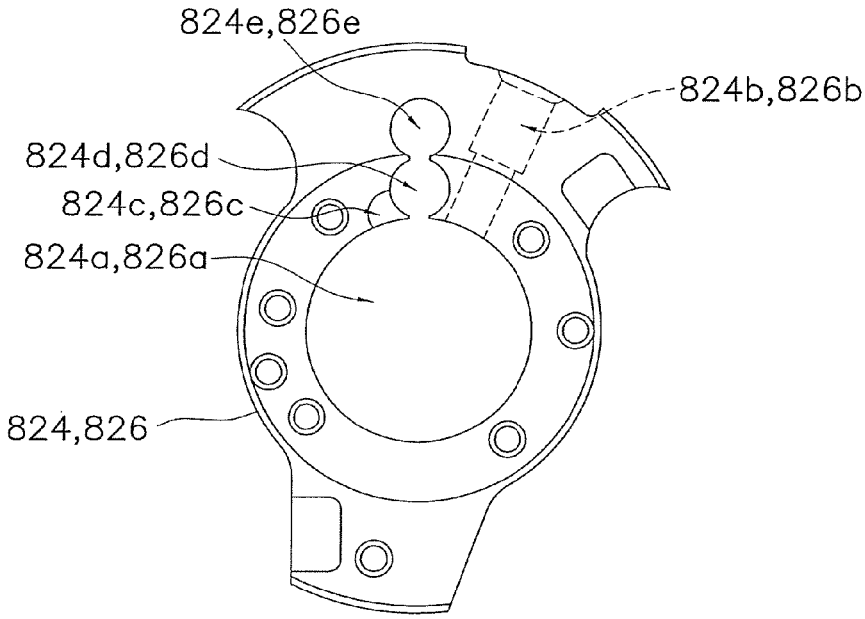
FIG. 60 is a top view of a cylinder block according to the fifth embodiment.

A cylinder hole 824*a*, a suction hole 824*b*, a discharge channel 824*c*, a bushing accommodation hole 824*d*, and a blade accommodation hole 824*e* are formed on the first cylinder block 824, as shown in FIG. 60. The cylinder hole 824*a* is a cylindrical hole that passes along the plate thickness direction, as shown in FIGS. 59 and 60. The suction hole 824*b* passes through the cylinder hole 824*a* from the external peripheral wall surface. The discharge channel 824*c* is formed by notching a portion of an internal peripheral part of the cylindrical portion that forms the cylinder hole 824*a*. The bushing accommodation hole 824*d* is a hole that extends in the plate thickness direction and is disposed between the suction hole 824*b* and the discharge channel 824*c* when viewed in the plate thickness direction. The blade accommodation hole 824*e* is a hole that extends in the plate thickness direction and is in communication with the bushing accommodation hole 824*d*.

The first cylinder block 824 is fitted into the front head 823 and the middle plate 825 so that the discharge channel 824*c* faces the front head 823 in a state in which an eccentric shaft portion 817*a* of the crankshaft 817 and a roller portion 821*a* of the piston 821 are accommodated in the cylinder hole 824*a*, a blade portion 821*b* of the piston 821 and the bushing 822 are accommodated in the bushing accommodation hole 824*d*, and the blade portion 821*b* of the piston 821 is accommodated in the blade accommodation hole 824*e* (see FIG. 61). As a result, a first cylinder chamber Rc1 is formed on the swing compression mechanism 815; and the first cylinder chamber Rc1 is partitioned by the piston 821 into a suction chamber that is in communication with the suction hole 824*b*, and a discharge chamber that is communication with the discharge channel 824*c*.

b) Second Cylinder Block

A cylinder hole 826*a*, a suction hole 826*b*, a discharge channel 826*c*, a bushing accommodation hole 826*d*, and a blade accommodation hole 826*e* are formed on the second cylinder block 826 in the same manner as the first cylinder block 824, as shown in FIG. 60. A cylinder hole 826*a* is a cylindrical hole that extends in the plate thickness direction, as shown in FIGS. 59 and 60. The suction hole 826*b* passes from the external peripheral wall surface to the cylinder hole 826*a*. The discharge channel 826*c* is formed by notching a portion of an internal peripheral portion of the cylinder part that forms the cylinder hole 826*a*. The bushing accommodation hole 826*d* is a hole that extends in the plate thickness direction and is disposed between the suction hole 826*b* and the discharge channel 826*c* when viewed in the plate thickness direction. The blade accommodation hole 826*e* is a hole that extends in the plate thickness direction and is in communication with the bushing accommodation hole 826*d*.

The second cylinder block 826 is fitted into the rear head 827 and the middle plate 825 so that the discharge channel 826*c* faces the rear head 827 in a state in which an eccentric shaft portion 817*b* of the crankshaft 817 and a roller portion 821*a* of the piston 821 are accommodated in the cylinder hole 826*a*, a blade portion 821*b* of the piston 821 and the bushing 822 are accommodated in the bushing accommodation hole 826*d*, and the blade portion 821*b* of the piston 821 is accommodated in the blade accommodation hole 826*e* (see FIG. 61). As a result, a second cylinder chamber Rc2 is formed on the swing compression mechanism 815; and the second cylinder chamber Rc2 is partitioned by the piston 821 into a suction chamber that is in communication with the suction hole 826*b*, and a discharge chamber that is communication with the discharge channel 826*c*.

c) Crankshaft

The crankshaft 817 has two eccentric shaft portions 817*a*, 817*b* provided to one of the end portions. The two eccentric shaft portions 817*a*, 817*b* are formed so that the eccentric axes face each other across the center axis of the crankshaft

817. The crankshaft 817 is secured to the rotor 852 of the drive motor 816 on the side in which the eccentric shaft portions 817*a*, 817*b* are not provided.

d) Piston

Figure 62:
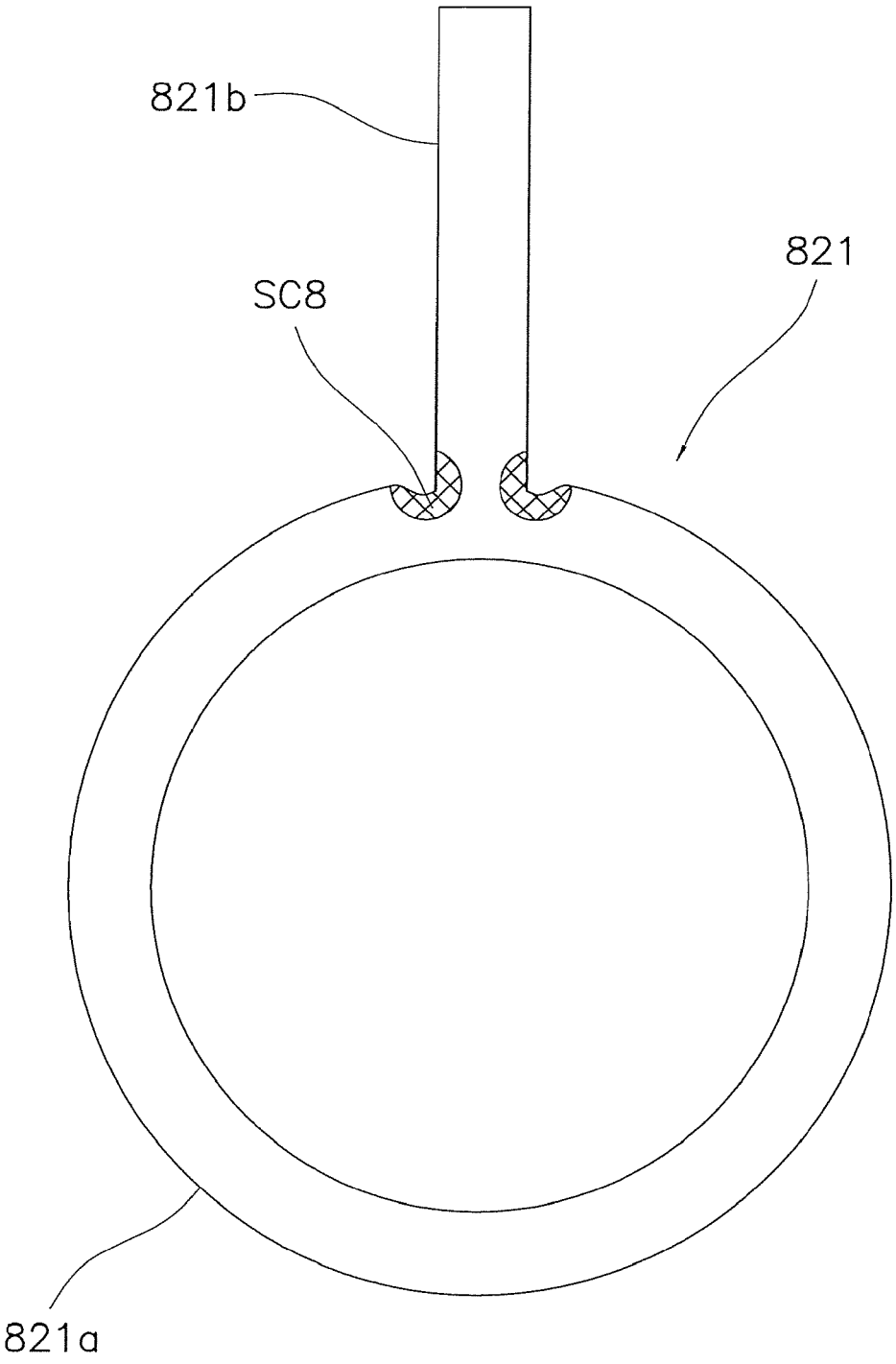
FIG. 62 is a top view of a piston of the swing compressor according to the fifth embodiment.

The piston 821 has a substantially cylindrical roller portion 821*a*, and a blade portion 821*b* that protrudes outward in the radial direction of the roller portion 821*a*, as shown in FIGS. 59 and 62. The roller portion 821*a* is fitted into the eccentric shaft portions 817*a*, 817*b* of the crankshaft 817, and is inserted in this state into the cylinder holes 824*a*, 826*a* of the cylinder blocks 824, 826. The roller portion 821*a* thereby moves in an orbiting fashion about the rotational axis of the crankshaft 817 when the crankshaft 817 rotates. The blade portion 821*b* is accommodated in bushing accommodation holes 824*d*, 826*d* and blade accommodation holes 824*e*, 826*e*. The blade portion 821*b* thereby swings and simultaneously moves in a reciprocating fashion in the lengthwise direction.

e) Bushing

The bushing 822 is a substantially semicylindrical member and is accommodated in the bushing accommodation holes 824*d*, 826*d* so as to hold the blade portion 821*b* of the piston 821 on both sides.

f) Front Head

The front head 823 is a member that covers the first cylinder block 824 on the side of the discharge channel 824*c* and is fitted into the casing 810. A bearing portion 823*a* is formed on the front head 823, and the crankshaft 817 is inserted into the bearing portion 823*a*. Also, formed in the front head 823 is an opening 823*b* for feeding to the discharge tube 820 a refrigerant gas that flows in through the discharge channel 824*c* formed in the first cylinder block 824. The opening 823*b* is opened and closed by a discharge valve (not shown) for preventing the backflow of refrigerant gas.

g) Rear Head

The rear head 827 covers the second cylinder block 826 on the side of the discharge channel 826*c*. A bearing portion 827*a* is formed on the rear head 827, and the crankshaft 817 is inserted into the bearing portion 827*a*. Also, an opening (not shown) for feeding to the discharge tube 820 a refrigerant gas that flows in through the discharge channel 826*c* formed in the second cylinder block 826 is formed in the rear head 827. The opening is opened and closed by a discharge valve (not shown) for preventing the backflow of refrigerant gas.

h) Middle Plate

The middle plate 825 is disposed between the first cylinder block 824 and the second cylinder block 826, and partitions the first cylinder chamber Rc1 and the second cylinder chamber Rc2.

(3) Drive Motor

The drive motor 816 is a DC motor in the fifth embodiment, and is primarily composed of an annular stator 851 secured to the internal wall surface of the casing 810, and a rotor 852 rotatably accommodated with a slight gap (air gap channel) on the inner side the stator 851. Copper wire is wound about a tooth portion (not shown) of the stator 851, and a coil end 853 is formed above and below the stator. The external peripheral surface of the stator 851 is provided with core cut portions (not shown) that have been formed as a notch in a plurality of locations from the upper end surface to the lower end surface of the stator 851 at prescribed intervals in the peripheral direction.

A crankshaft 817 is secured along the rotational axis to the rotor 852.

(4) Suction Tube

The suction tube 819 is provided so as to pass through the casing 810, and has one end that is fitted into the suction holes 824*b*, 826*b* formed in the first cylinder block 824 and the second cylinder block 826, and another end that is fitted into the accumulator 895.

(5) Discharge Tube

The discharge tube 820 is provided so as to pass through the upper wall portion 812 of the casing 810.

(6) Muffler

The muffler 860 is used to muffle the discharge noise of the refrigerant gas, and is mounted on the front head 823.

(Method for Manufacturing a Slider)

In the swing compressor 801 according to the fifth embodiment, the cylinder blocks 824, 826, the piston 821, and the crankshaft 817 are manufactured by the same manufacturing method as the one used to manufacture the slider of the first embodiment. In this case, the piston 821 and the crankshaft 817 are heat treated in the heat treatment step under conditions at which the hardness is greater than HRB 90 but less than HRB 100.

In the fifth embodiment, after the finishing step, high-frequency heaters are inserted into the bushing accommodation holes 824*d*, 826*d* of the cylinder blocks 824, 826, and the cylinder blocks 824, 826 are subjected to a high-frequency heating treatment so that the hardness of the portions on the periphery of the bushing accommodation holes 824*d*, 826*d* is set to be greater than HRC 50 but less than HRC 65. The cylinder blocks 824, 826 prior to the high-frequency heating treatment are heat treated under conditions at which the hardness is greater than HRB 90 but less than HRB 100. After finishing, the crankshaft 817 is subjected to high-frequency heating treatment in the main shaft and secondary shaft portions accommodated in the front head 823 and the rear head 827.

In the fifth embodiment, after the finishing step, the peripheral portion SC8 of the base of the blade portion 821*b* of the piston 821 in which stress is readily concentrated (see FIG. 62; the partial heating treatment locations are shaded) is subjected to partial heat treatment.

(Operation of the Swing Compressor)

When the drive motor 816 is driven, the eccentric shaft portions 817*a*, 817*b* rotate eccentrically about the crankshaft 817, and the roller portion 821*a* fitted into the eccentric shaft portions 817*a*, 817*b* orbits while the external peripheral surface of the roller portion 821*a* makes contact with the internal peripheral surface of the cylinder chambers Rc1, Rc2. The blade portion 821*b* reciprocates while the two side surfaces are held by the bushing 822, in accompaniment with the orbiting of the roller portion 821*a* inside the cylinder chambers Rc1, Rc2. At this point, a low-pressure refrigerant gas is suctioned from the suction port 819 into the suction chamber and is compressed to a high pressure in the discharge chamber, and the high-pressure refrigerant gas is thereafter discharged from the discharge channels 824*c*, 826*c*.

(Characteristics of the Swing Compressor)

(1)

In the fifth embodiment, the cylinder blocks 824, 826 and the piston 821 are manufactured via a semi-molten die casting step and a heat treatment step. Accordingly, a cylinder block and piston can be readily provided with higher tensile strength and hardness than a cylinder block and piston composed of flake graphite cast iron manufactured using conventional sand casting (because higher strength and rigidity than FC250 can be achieved by performing heat treatment).

(2)

In the fifth embodiment, the cylinder blocks 824, 826 and the piston 821 are manufactured via a semi-molten die casting step and a heat treatment step, and the hardness of these components is adjusted so as to be greater than HRB 90 but less than HRB 100. In this case, the hardness of the cylinder blocks 824, 826 and the piston 821 substantially corresponds to a tensile strength within a range of 600 MPa to 900 MPa. Accordingly, the cylinder blocks 824, 826 and the piston 821 can be made thinner by adopting this method for manufacturing a compressor slider. Therefore, the swing compressor 801 can be reduced in diameter, and the abrasion of the cylinder blocks 824, 826 and the piston 821 can consequently be reduced and the compression capacity increased.

(3)

In the heat treatment step of the fifth embodiment, the cylinder block preform and the piston preform are heat treated to a hardness greater than HRB 90 but less than HRB 100. Accordingly, when this method for manufacturing a compressor slider is adopted, the cylinder blocks 824, 826 and the piston 821 can be manufactured so that sufficient durability can be demonstrated during compressor operation, "breaking-in" occurs as early as possible, and seizing during abnormal operation does not occur. When the hardness is in this range, the machinability of the cylinder block preform and the piston preform is good, the cylinder block preform and the piston preform are not readily damaged, and handling is facilitated. Accordingly, tool abrasion and tool chipping is less likely to occur, tool service life is extended, a built-up edge is less likely to form, grinding processability is good, and machining costs are reduced because machining time can be reduced. Regardless the scrolls have superior tool abrasion and machining time because of lower hardness in relation to FCD having the same tensile strength (tensile strength is high at the same level of hardness), it can be said that higher tensile strength can be achieved.

(4)

In the fifth embodiment, the cylinder blocks 824, 826 are manufactured by a semi-molten die casting and a heat treatment step, after which high-frequency heaters are inserted into the bushing accommodation holes 824*d*, 826*d*, and hardening is carried out so that the hardness of the portions of the periphery of the bushing accommodation holes 824*d*, 826*d* is greater than HRC 50 but less than HRC 65. For this reason, the abrasion of the portions of the periphery of the bushing accommodation holes 824*d*, 826*d* is reduced even when CO2 or another natural refrigerant is suctioned in.

(5)

In the fifth embodiment, the main shaft portion, the secondary shaft portion accommodated in the front head 823 and the rear head 827, and the eccentric shaft portion of the crankshaft 817 are subjected to high-frequency heating treatment. Accordingly, sufficient abrasion resistance can be imparted to the main shaft portion, the secondary shaft portion, and the eccentric shaft portion. Therefore, the service life of the crankshaft 817 can be extended.

(6)

In the fifth embodiment, the peripheral portion SC8 of the base of the blade portion 821*b* of the piston 821 in which stress is readily concentrated is partially heat treated. Accordingly, the piston 821 is not likely to be destroyed even if a somewhat large load is applied to the blade portion 821*b*.

Modified Example of Fifth Embodiment (A)

Figure 63:
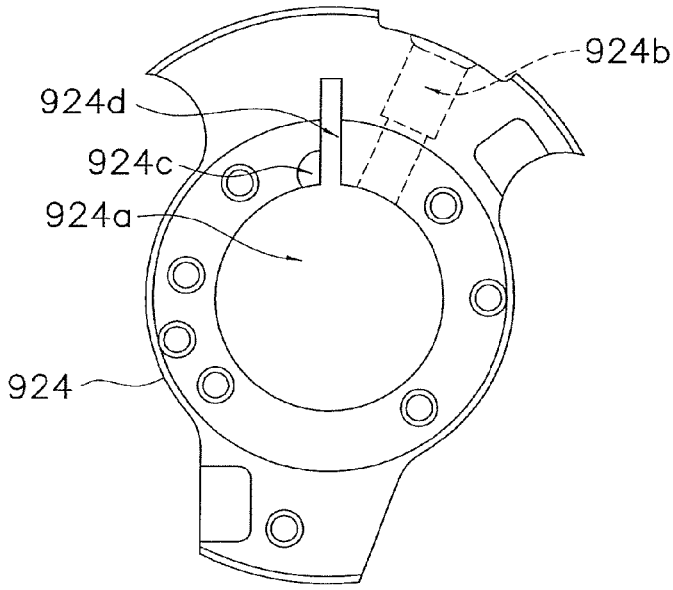
FIG. 63 is a top view of a cylinder block of a rotary compressor according to a modified example (A) of the fifth embodiment.
Figure 64:
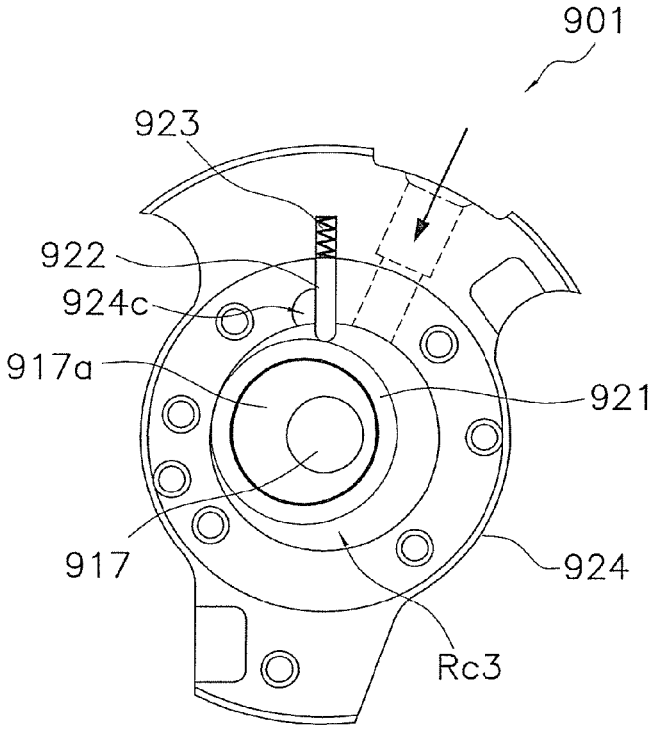
FIG. 64 is a lateral cross-sectional view of a cylinder chamber of a rotary compressor according to a modified example (A) of the fifth embodiment.

In the fifth embodiment, the cylinder blocks 824, 826 and the piston 821 were heat treated so that the hardness of the cylinder blocks 824, 826 and the piston 821 of the swing compressor 801 was greater than HRB 90 but less than HRB 100, after which high-frequency heaters were inserted in the bushing accommodation holes 824*d*, 826*d* and a hardening treatment was performed so that the hardness of the portions in the periphery of the bushing accommodation holes 824*d*, 826*d* was made to be greater than HRC 50 but less than HRC 65. In this case, such a hardness adjustment technique may be applied to a cylinder block 924 and a roller 921 of a rotary compressor 901 such as that shown in FIG. 64. In other words, the roller 921 and the cylinder block 924 of the rotary compressor 901 are heat treated so that the hardness of the cylinder block 924 and the roller 921 is greater than HRB 90 but less than HRB 100. Thereafter, a high-frequency heater is inserted into a vane accommodation hole 924*d*, and the cylinder block 924 is subjected to a hardening treatment so that the hardness of the portions in the periphery of the vane accommodation hole 924*d* is greater than HRC 50 but less than HRC 65 (see FIG. 63). A vane 922 may be manufactured using the same method. In FIGS. 63 and 64, the reference numeral 924*a* indicates a cylinder hole, 924*c* is a discharge channel, 924*b* is a suction hole, 917 is a crankshaft, 917*a* is an eccentric shaft of the crankshaft, 923 is a spring, and Rc3 is a cylinder chamber. The roller 921 and the cylinder block 924 may be manufactured in accordance with the manufacturing method described in modified example (H) of the first embodiment.

(B)

The swing compressor 801 according to the fifth embodiment was a two-cylinder swing compressor, but the swing compressor may also be a single-cylinder swing compressor.

(C)

In the swing compressor 801 according to the fifth embodiment, the cylinder blocks 824, 826 and the piston 821 were manufactured via a semi-molten die casting step and a heat treatment step, but the crankshaft 817, the front head 823, the rear head 827, the middle plate 825, and other sliders may be manufactured via the same steps.

INDUSTRIAL APPLICABILITY

The compressor slider according to the present invention has high tensile strength, can demonstrate sufficient durability during operation, is readily "broken in" as early as possible, does not seize during abnormal operation, and can therefore be useful as a compressor designed for upgrade demand.

What is claimed is:

1. A compressor slider comprising:
a carbon content of 2.3 wt % to 2.4 wt %;
a silicon content of 1.95 wt % to 2.05 wt %;
a manganese content of 0.6 wt % to 0.7 wt %;
a phosphorus content of less than 0.035 wt %;
a sulfur content of less than 0.04 wt %;
a chromium content of 0.00 wt % to 0.50 wt %;
a nickel content of 0.50 wt % to 1.00 wt %;
a balance of iron having unavoidable impurities;
a metal structure being primarily composed of a pearlite structure, ferrite structure, and granular graphite; and
a hardness being greater than HRB 90 and less than HRB 100 in at least a portion of the slider,
the compressor slider being manufactured by semi-molten die casting, then rapid cooling, and then a heat treatment.

2. The compressor slider as recited in claim 1, wherein
a ratio of tensile strength to Young's modulus of at least part of the slider is 0.0046 or less.

3. The compressor slider as recited in claim 1, wherein
a portion of the compressor slider is partially heat treated.

4. The compressor slider as recited in claim 3, wherein
the hardness of a location that has been partially heat treated is greater than HRC 50 and less than HRC 65.

5. The compressor slider as recited in claim 3, wherein
a location that is partially heat treated is a stress concentration area.

6. The compressor slider as recited in claim 1, being manufactured using a mold having a convexity that allows a prescribed portion in the vicinity of a center to be thinly formed, and being provided with a thin prescribed portion in the vicinity of the center.

7. The compressor slider as recited in claim 1, wherein
a slider preform provided with a thin prescribed portion in the vicinity of a center is molded using a mold having a convexity that allows a prescribed portion in the vicinity of the center to be thinly formed, and a through-hole is formed in the thin prescribed portion in the preform.

8. A compressor scroll part comprising:
a carbon content of 2.3 wt % to 2.4 wt %;
a silicon content of 1.95 wt % to 2.05 wt %;
a manganese content of 0.6 wt % to 0.7 wt %;
a phosphorus content of less than 0.035 wt %;
a sulfur content of less than 0.04 wt %;
a chromium content of 0.00 wt % to 0.50 wt %;
a nickel content of 0.50 wt % to 1.00 wt %;
a balance of iron having unavoidable impurities;
a metal structure being primarily composed of a pearlite structure, a ferrite structure, and granular graphite;
a plate portion having a first plate portion; and
a scroll portion extending from the first plate surface of the plate portion in a direction perpendicular to the first plate surface while a scroll shape is maintained, the plate portion and the scroll portion having a hardness that is greater than HRB 90 and less than HRB 100,
the compressor scroll being manufactured by semi-molten die casting, then rapid cooling, and then a heat treatment.

9. The compressor scroll part as recited in claim 8, wherein
a draft angle of the scroll portion in relation to a mold varies in accordance with a winding angle.

10. The compressor scroll part as recited in claim 9, wherein
the scroll portion has a scroll shape in which a draft angle in relation to the mold in the portion where winding starts near a center is larger than the draft angle of an outside portion were winding ends.

11. The compressor scroll part as recited in claim 9, wherein
the scroll portion has a scroll shape in which a draft angle in relation to the mold in the portion where winding ends at the outer side is larger than a draft angle of the portion where winding starts near the center.

12. The compressor scroll part as recited in claim 8, wherein
the scroll portion has a first surface that slopes at a first angle with respect to a line that is orthogonal to the flat surface portion, the first surface being positioned on the internal peripheral side of the portion in the vicinity of the start of winding near the center, and
a surface other than the first surface has a slope angle in relation to the line orthogonal to the flat plate portion that is less than the first angle.

13. The compressor scroll part as recited in claim 12, wherein
the portion of a wrap near where winding starts has a thickness at the boundary with the flat portion that is greater than in other portions of the wrap.

14. A compressor slider preform comprising:
a carbon content of 2.3 wt % to 2.4 wt %;
a silicon content of 1.95 wt % to 2.05 wt %;
a manganese content of 0.6 wt % to 0.7 wt %;
a phosphorus content of less than 0.035 wt %;
a sulfur content of less than 0.04 wt %;
a chromium content of 0.00 wt % to 0.50 wt %;
a nickel content of 0.50 wt % to 1.00 wt %;
a balance of iron having unavoidable impurities;
a metal structure being primarily composed of a pearlite structure, a ferrite structure, and granular graphite; and
a hardness being greater than HRB 90 and less than HRB 100 in at least a portion of the slider preform,
the compressor slider perform being manufactured by semi-molten die casting, then rapid cooling, and then a heat treatment.

15. A compressor, comprising:
a slider having
a carbon content of 2.3 wt % to 2.4 wt %;
a silicon content of 1.95 wt % to 2.05 wt %;
a manganese content of 0.6 wt % to 0.7 wt %;
a phosphorus content of less than 0.035 wt %;
a sulfur content of less than 0.04 wt %;
a chromium content of 0.00 wt % to 0.50 wt %;
a nickel content of 0.50 wt % to 1.00 wt %;
a balance of iron having unavoidable impurities,
a metal structure being primarily composed of a pearlite structure, a ferrite structure, and granular graphite, and
a hardness being greater than HRB 90 and less than HRB 100 in at least a portion of the slider,
the slider being manufactured by semi-molten die casting, then rapid cooling, and then a heat treatment.

16. The compressor as recited in claim 15, being configured to accommodate a carbon dioxide refrigerant.

* * * * *

UNITED STATES PATENT AND TRADEMARK OFFICE

CERTIFICATE OF CORRECTION

PATENT NO. : 8,366,425 B2
APPLICATION NO. : 12/280927
DATED : February 5, 2013
INVENTOR(S) : Mie Arai et al.

It is certified that error appears in the above-identified patent and that said Letters Patent is hereby corrected as shown below:

In the Claims:

Column 56,
Line 55, "structure, ferrite structure, and granular graphite; and" should read
-- structure, a ferrite structure, and granular graphite; and --.

Signed and Sealed this
Fourteenth Day of May, 2013

Teresa Stanek Rea
*Acting Director of the United States Patent and Trademark Office*